US005093227A

United States Patent [19]

Nakazyo et al.

[11] Patent Number: 5,093,227

[45] Date of Patent: Mar. 3, 1992

[54] METHOD FOR PROCESSING SILVER HALIDE COLOR PHOTOGRAPHIC MATERIAL

[75] Inventors: Kiyoshi Nakazyo; Kazuaki Yoshida, both of Minami-ashigara, Japan

[73] Assignee: Fuji Photo Film Co., Ltd., Kanagawa, Japan

[21] Appl. No.: 416,638

[22] Filed: Oct. 3, 1989

[30] Foreign Application Priority Data

Oct. 3, 1988 [JP] Japan ..... 63-249240

[51] Int. Cl.[5] ..... G03C 7/32

[52] U.S. Cl. ..... 430/372; 430/380; 430/382; 430/383; 430/386; 430/387; 430/467; 430/551; 430/558; 430/963

[58] Field of Search ..... 430/372, 551, 558, 963, 430/467, 382, 380, 376, 558 A, 383, 386, 387

[56] References Cited

U.S. PATENT DOCUMENTS

| | | | |
|---|---|---|---|
| 4,770,987 | 9/1988 | Takahashi et al. | 430/546 |
| 4,830,955 | 5/1989 | Kajiwara et al. | 430/505 |
| 4,851,326 | 7/1989 | Ishikawa et al. | 430/380 |
| 4,853,321 | 8/1989 | Momoki et al. | 430/380 |
| 4,880,728 | 11/1989 | Ishikawa et al. | 430/380 |

FOREIGN PATENT DOCUMENTS

| | | |
|---|---|---|
| 258662 | 3/1988 | European Pat. Off. . |
| 0277589 | 8/1988 | European Pat. Off. . |

OTHER PUBLICATIONS

Derwelt Abstract for European Patent #277589 Aug. 8, 1988-Fuji Photo.

*Primary Examiner*—Marion E. McCamish
*Assistant Examiner*—Janis L. Dote
*Attorney, Agent, or Firm*—Sughrue, Mion, Zinn, Macpeak & Seas

[57] ABSTRACT

There is disclosed a method for processing a silver halide color photographic material with a color developer containing at least one aromatic primary amine color-developing agent. In the method a silver halide color photographic material which comprises a pyrazoloazole-type coupler and an image-dye stabilizer, and has at least one of the layers comprising a silver halide emulsion of a high silver chloride and the total coating amount of silver of 0.75 g/m$^2$ or below is processed, after exposure to light, with a color developer containing a specified amount of chloride ions and bromide ions, to improve development treatment characteristics, desilvering ability, and stability of an image.

13 Claims, No Drawings

METHOD FOR PROCESSING SILVER HALIDE COLOR PHOTOGRAPHIC MATERIAL

FIELD OF THE INVENTION

The present invention relates to a method for processing a silver halide color photographic material, and more particularly a development processing method that uses a silver halide color photographic material having a high silver chloride content (hereinafter referred to as a high-silver-chloride color photographic material) and containing a pyrazoloazole-type coupler and an image dye stabilizer, which is improved in development treatment characteristics and is excellent in desilvering ability and stability of an image.

BACKGROUND OF THE INVENTION

In recent years in the photographic processing of color photographic materials, with the shortening of the time of delivery of finished goods and the reduction of labor in laboratories, it is desired to shorten the processing time. To accomplish this, while generally the temperature or the replenishing amount is increased, other various techniques have also been proposed, such as the intensification of stirring or the addition of various accelerators.

Among others, for the purpose of making the color development rapid and/or of reducing the replenishing amount, it is known to use a method wherein a color photographic material containing a silver chloride emulsion, instead of the conventionally widely used silver bromide type emulsions or silver iodide emulsions, is processed. For example, in International Publication No. WO-87-04534, a method is described for rapidly processing a high-silver-chloride color photographic material with a color developer substantially free from sulfite ions and benzyl alcohol.

In JP-A ("JP-A" means unexamined published Japanese patent application) Nos. 30250/1987, 246054/1987, 249149/1987, 257156/1987, 11939/1988, and 100545/1988, methods for processing a silver halide color photographic material comprising silver chloride or silver chlorobromide containing pyrazoloazole-type coupler are described, and techniques being capable to carry out a rapid processing, and being excellent in color reproduction, high in maximum density of magenta color-forming layer, and low in fogging are disclosed.

However, it has been found that when development processing is carried out by an automatic processor for papers according to the above method, streaked fogging occurs. This is assumed to occur as follow: when the photographic material comes in contact with a roller or the like in the developing tank of an automatic processor, the photographic material becomes scarred and is pressure-sensitized, resulting in streaked fogging due to the pressure sensitization, that is, so-called insolution pressure-sensitized streaks (hereinafter referred to as pressure-sensitized streaks) occur. Further, facts have been apparent that when the method is used for continuous processing, fluctuation of photographic quality, in particular fluctuation of the minimum density (fogging, Dmin) and the maximum density (Dmax), becomes conspicuous, and insufficient desilvering takes place such that the white background is greatly stained.

Thus, rapid development processing that uses a high-silver-chloride color photographic material is accompanied by such serious problems as pressure-sensitized streaks, fluctuation of the photographic quality, and the occurrence of insufficient desilvering, and therefore such processing could not be practically used.

Further, in a rapid process that uses a high-silver-chloride color photographic material, in order to reduce the fluctuation of photographic quality, in particular the fluctuation of minimum density (Dmin), involved in continuous processing, the use of organic antifoggants is known, as described in JP-A Nos. 95345/1983 and 23342/1984. However, it has been found that the use of the organic antifoggants prevents neither the occurrence of pressure-sensitized streaks, as mentioned above, nor the increase of Dmin involved in continuous processing, and it has also been found that the occurrence of insufficient desilvering involved in continuous processing further increases.

JP-A No. 70552/1986 describes a process for lowering the replenishing amount of a developer, wherein a high-silver-chloride color photographic material is used and a replenisher is added in such an amount that overflow to the developing bath will not take place during the development processing, while JP-A No. 106655/1988 describes a process for processing a high-silver-chloride color photographic material with a color developer containing a hydroxylamine compound and a chloride, in a certain concentration or over, to stabilize the processing. However, it is found that these methods are difficult to use practically because of pressure-sensitized streaks occurring in a process using an automatic processor, the fluctuation of photographic quality in continuous processing, the occurrence of insufficient desilvering, and the occurrence of after-processing stain at the unexposed (uncolored) part.

BRIEF SUMMARY OF THE INVENTION

Therefore, the first object of the present invention is to provide a method for rapid development processing wherein streaked fogging due to pressure sensitization is prevented.

The second object of the present invention is to provide a method for development processing that will result in excellent photographic characteristics low in Dmin and high in Dmax, and that is improved with respect to the fluctuation of photographic characteristics involved in continuous processing.

The third object of the present invention is to provide a method for development processing that will result in a smaller amount of residual silver after processing, and that is improved in bleach ability.

The fourth object of the present invention is to provide a method for development processing that is improved in image-lasting quality after processing, and that particularly suppresses the increase in staining after processing.

The above and other objects, features, and advantages of the invention will become apparent in the following detailed description.

DETAILED DESCRIPTION OF THE INVENTION

The inventors have made concerted efforts and found that the above objects can be accomplished by a method for processing a silver halide color photographic material with a color developer containing at least one aromatic primary amine color developer, wherein said silver halide color photographic material comprises at least one of pyrazoloazole couplers represented by the following formula (A):

Formula (A)

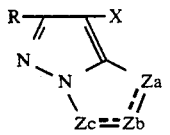

wherein R represents a hydrogen atom or a substituent, X represents a hydrogen atom or a group that can split off in the coupling reaction with the oxidized product of the aromatic primary amine developing agent, Za, Zb, and Zc each represent methine, substituted methine, =N—, or —NH—, one of the Za—Zb bond and the Zb—Zc bond is a double bond, and the other is a single bond, and when Zb—Zc is a carbon-carbon double bond, the double bond may be part of the aromatic ring, a dimer or higher polymer may be formed through R or X, and when Za, Zb, or Zc is a substituted methine, a dimer or higher polymer may be formed through the substituted methine, and at least one of compounds represented by the following formula (I), (II), or (III):

Formula (I)

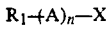

Formula (II)

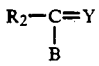

wherein $R_1$ and $R_2$ each represent an aliphatic group, an aromatic group, or a heterocyclic group, X represents a group that can react with the aromatic amine developing agent to split off, A represents a group that will react with the aromatic amine developing agent to form a chemical bond, n is 1 or 0, B represents a hydrogen atom, an aliphatic group an aromatic group, a heterocyclic group, an acyl group, or a sulfonyl group, Y represents a group that facilitates the addition of the aromatic amine developing agent to the compound of formula (II), and $R_1$ and X, or Y and $R_2$ or B may bond together to form a cyclic structure, Formula (III)

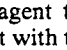

wherein $R_3$ represents an aliphatic group, an aromatic group, or a heterocyclic group, and Z represents a nucleophilic group or a group that can be decomposed in the photographic material to release a nucleophilic group, and has at least one silver halide emulaion layer comprising 80 mol % or over of silver chloride and the total coating amount of silver of 0.75 g/m$^2$ or below, and said color developer contains chloride ions in an amount of $3.5\times10^{-2}$ to $1.5\times10^{-1}$ mol/l, and bromide ions in an amount of $3.0\times10^{-5}$ to $1.0\times10^{-3}$ mol/l.

The compounds represented by formula (A) will now be described in more detail.

In formula (A), the term "polymer" means one having two or more groups represented by formula (A) in one molecule, and it includes bis-compounds and polymer couplers. The polymer coupler may be a homopolymer, consisting of a monomer having a part represented by formula (A) (preferably a monomer having a vinyl group, hereinafter referred to as a vinyl monomer), or it may form a copolymer with a non-color-forming ethylenically unsaturated monomer that will not couple with the oxidized product of the aromatic primary amine developer.

The compound represented by formula (A) is a 5-membered-ring-5-membered-ring condensed nitrogen heterocyclic-type coupler, whose color-forming mother nucleus has a chemical structure that exhibits an aromatic character electronically equivalent to naphthalene, which is generally called azapentalene. Preferable compounds of the couplers represented by formula (A) are 1H-imidazo [1,2-b]pyrazoles, 1H-pyrazolo[1,5-b]pyrazoles, 1H-pyrazolo[ 5,1-c][1,2,4]triazoles, 1H-pyrazolo[1,5-b][1,2,4]triazoles, 1H-pyrazolo[1,5-b]tetrazoles, and 1H-pyrazolo[1,5-a]benzimidazoles, which are represented by formulae (A-1), (A-2), (A-3), (A-4), (A-5), and (A-6), respectively, with the compounds represented by formulae (A-1), (A-3), and (A-4) being preferred, and the compounds represented by formulae (A-3) and (A-4) being more preferred.

Formula (A-1)

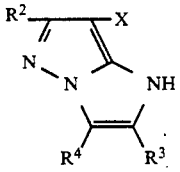

Formula (A-2)

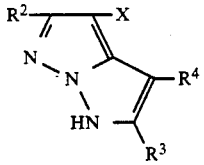

Formula (A-3)

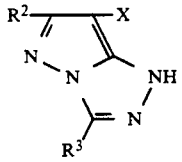

Formula (A-4)

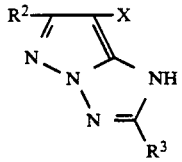

Formula (A-5)

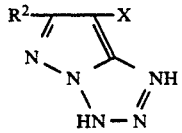

Formula (A-6)

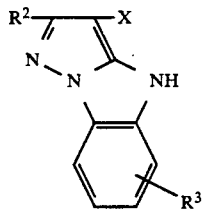

In formulae (A-1) to (A-6), substituents $R^2$, $R^3$, and $R^4$ each represent a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group, X represents a hydrogen atom, a halogen atom, a carboxy group, or a group that bonds to the carbon atom in the coupling position through the oxygen atom, the nitrogen atom, or the sulfur atom, and which will split off by the coupling reaction, and $R^2$, $R^3$, $R^4$, or X may become a divalent group to form a bis-compound.

When the part represented by any of formulae (A-1) to (A-6) is present in a vinyl monomer, $R^2$, $R^3$, or $R^4$ represents simply a bond or a linking group, through which the part represented by formula (A-1) (A-2), (A-3), (A-4), (A-5), or (A-6) is bonded to the vinyl group.

More particularly, $R^2$, $R^3$, or $R^4$ represents a hydrogen atom, a halogen atom (e.g., chlorine and bromine), an alkyl group (e.g., methyl, propyl, t-butyl, trifluoromethyl, tridecyl, 3-(2,4-di-t-amylphenoxy)propyl, 2-dodecyloxyethyl, 3-phenoxypropyl, 2-hexylsulfonylethyl, cyclopentyl, and benzyl), an aryl group (e.g., phenyl, 4-t-butylphenyl, 2,4-di-t-amylphenyl, and 4-tetradecaneamidophenyl), a heterocyclic group (e.g., 2-furyl, 2-thienyl, 2-pyrimidinyl, and 2-benzothiazolyl), a cyano group, an alkoxy group (e.g., methoxy, ethoxy, 2-methoxyethoxy, 2-dodecyloxyethoxy, and 2-methanesulfonylethoxy), an aryloxy group (e.g., phenoxy, 2-methylphenoxy, and 4-t-butylphenoxy), a heterocyclic oxy group (e.g., 2-benzimidazolyloxy), an acyloxy group (e.g., acetoxy and hexadecanoyloxy), a carbamoyloxy group (e.g., N-phenylcarbamoyloxy, and N-ethylcarbamoyloxy), a silyloxy group (e.g., trimethylsilyloxy), a sulfonyloxy group (e.g., dodecylsulfonyloxy), an acylamino group (e.g., acetamido, benzamido, tetradecaneamido, α-(2,4-di-t-amylphenoxy)-butylamido, γ-(3-t-butyl-4-hydroxyphenoxy)-butylamido, and α-{4-(4-hydroxyphenylsulfonyl)-phenoxy}decaneamido), an anilino group (e.g., phenylamino, 2-chloroanilino, 2-chloro-5-tetradecaneamidoanilino, 2-chloro-5-dodecyloxycarbonylanilino, N-acetylanilino, and 2-chloro-5-{α-(3-t-butyl-4-hydroxyphenoxy)dodecaneamido}anilino), a ureido group (e.g., phenylureido, methylureido, and N,N-dibutylureido), an imido group (e.g., N-succinimido, 3-benzylhydantoinyl, and 4-(2-ethylhexanoylamino)phthalimido), a sulfamoylamino group (e.g., N,N-dipropylsulfamoylamino and N-methyl-N-decylsulfamoylamino), an alkylthio group (e.g., methylthio, octylthio, tetradecylthio, 2-phenoxyethylthio, 3-phenoxypropylthio, and 3-(4-t-butylphenoxy)propylthio), an arylthio group (e.g., phenylthio, 2-butoxy-5-t-octylphenylthio, 3-pentadecylphenylthio, 2-carboxyphenylthio, and 4-tetradecaneamidophenylthio), a heterocyclic thio group (e.g., 2-benzothiazolylthio), an alkoxycarbonylamino group (e.g., methoxycarbonylamino and tetradecyloxycarbonylamino), an aryloxycarbonylamino group (e.g., phenoxycarbonylamino and 2,4-di-tert-butylphenoxycarbonylamino), a sulfonamido group (e.g., methanesulfonamido, hexadecanesulfonamido, benzenesulfonamido, p-toluenesulfonamido, octadecanesulfonamido, and 2-methyloxy-5-t-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, and N-{3-(2,4-di-tert-amylphenoxy)propyl}carbamoyl), an acyl group (e.g., acetyl, (2,4-di-tert-amylphenoxy)acetyl, and benzoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a sulfonyl group (e.g., methanesulfonyl, octanesulfonyl, benzenesulfonyl, and toluenesulfonyl), a sulfinyl group (e.g., octanesulfinyl, dodecylsulfinyl, and phenylsulfinyl), an alkoxycarbonyl group (e g., methoxycarbonyl, butyloxycarbonyl, dodecylcarbonyl, and octadecylcarbonyl), an aryloxycarbonyl group (e.g., phenyloxycarbonyl and 3-pentadecyloxycarbonyl), and X represents a hydrogen atom, a halogen atom (e.g., chlorine, bromine, and iodine), a carboxyl group, a group that bonds through the oxygen atom (e.g., acetoxy, propanoyloxy, benzoyloxy, 2,4-dichlorobenzoyloxy, ethoxyoxazoyloxy, pyruvinyloxy, cinnamoyloxy, phenoxy, 4-cyanophenoxy, 4-methanesulfonamidophenoxy, 4-methanesulfonylphenoxy, α-naphthoxy, 3-pentadecylphenoxy, benzyloxycarbonyloxy, ethoxy, 2-cyanoethoxy, benzyloxy, 2-phenetyloxy, 2-phenoxyethoxy, 5-phenyltetrazolyloxy, and 2-benzothiazolyloxy), a group that bonds through the nitrogen atom (e.g., benzenesulfonamido, N-ethyltoluenesulfonamido, heptafluorobutaneamido, 2,3,4,5,6-pentafluorobenzamido, octanesulfonamido, p-cyanophenylureido, N,N-diethylsulfamoylamino, 1-piperidyl 5,5-dimethyl-2,4-dioxo-3-oxazolidinyl, 1-benzyl-ethoxy-3-hydantoinyl, 2N-1,1-dioxo-3(2H)-oxo-1,2-benzoisothiazolyl, 2-oxo-1,2-dihydro-1-pyridinyl, imidazolyl, pyrazolyl, 3,5-diethyl-1,2,4-triazol-1-yl, 5- or 6-bromo-benztriazol-1-yl, 5-methyl-1,2,3,4-triazol-1-yl, benzimidazolyl, 3-benzyl-1-hydantoinyl, 1-benzyl-5-hexadecyloxy-3-hydantoinyl, 5-methyl-1-tetrazolyl, 4-methoxyphenylazo, 4-pivaloylaminophenylazo, and 2-hydroxy-4-propanoylphenylazo), or a group that bonds through the sulfur atom (e.g., phenylthio, 2-carboxyphenylthio, 2-methoxy-5-t-octylphenylthio, 4-methanesulfonylphenylthio, 5-octanesulfonamidophenylthio, 2-butoxyphenylthio, 2-(2-hexasulfonylethyl)-5-tert-octylphenylthio, benzylthio, 2-cyanoethylthio, 1-ethoxycarbonyltridecylthio, 5-phenyl-2,3,4,5-tetrazolylthio, 2-benzothiazolylthio, 2-dodecylthio-5-thiophenylthio, and 2-phenyl-3-dodecyl-1,2,4-triazolyl-5-thio). When $R^2$, $R^3$, $R^4$ or X becomes a divalent group to form a bis-compound, the divalent group includes a substituted or unsubstituted alkylene group (e.g., methylene, ethylene, 1,10-decylene, and $—CH_2CH_2—O—CH_2CH_2—$), a substituted or unsubstituted phenylene group (e.g., 1,4-phenylene, 1,3-phenylene,

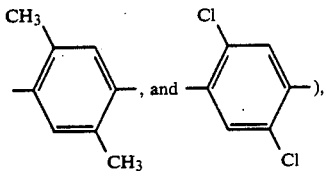

—NHCO—$R^5$—CONH— (wherein $R^5$ represents a substituted or unsubstituted alkylene group or phenylene group).

When the compound represented by any one of formulae (A-1) to (A-6) is present in a vinyl monomer, the linking group represented by $R^2$, $R^3$, or $R^4$ includes a group formed by the combination of two or more of an alkylene group (including a substituted or unsubstituted alkylene group, e.g., methylene, ethylene, 1,10-decylene, and —$CH_2CH_2OCH_2CH_2$—), a phenylene group (including a substituted or unsubstituted phenylene group, e.g., 1,4-phenylene, 1,3-phenylene,

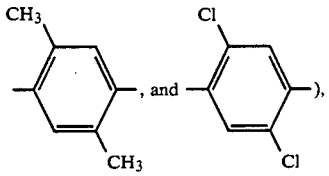

—NHCO—, —CONH—, —O—, —OCO—, and an aralkylene group (e.g.,

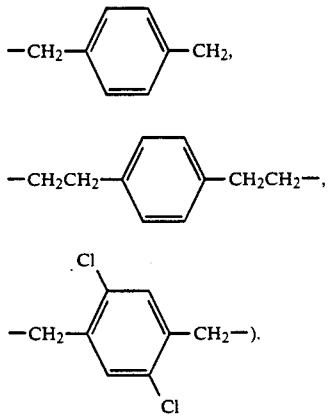

The vinyl group in the vinyl monomer includes, in addition to those represented by formulae (A-1) to (A-6), those having a substituent. Preferable substituents are a hydrogen atom, a chlorine atom, and a lower alkyl group having 1 to 4 carbon atoms.

The non-color-forming ethylenically-unsaturated monomer that will not couple with the oxidized product of the aromatic primary amine developer includes acrylic acid, α-chloroacrylic acid, α-alacryl acids (e.g., methacrylic acid), esters or amides derived from these acrylic acids (e.g., acrylamide, n-butyl acrylamide, t-butyl acrylamide, diacetone acrylamide, methacrylamide, methyl acrylamide, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate, and β-hydroxy methacrylate), methylenedibisacrylamide, vinyl esters (e.g., vinyl acetate, vinyl propionate, and vinyl laurate), acrylonitrile, methacrylonitrile, aromatic vinyl compounds (e.g., styrene and its derivatives, vinyl toluene, divinyl benzene, vinyl acetophenone, and sulfostyrene), itaconic acid, citraconic acid, crotonic acid, vinylidene chloride, vinyl alkyl ethers (e.g., vinyl ethyl ether), maleic acid, maleic anhydride, maleates, N-vinyl-2-pyrrolidone, N-vinylpyridine, and 2- and 4-vinylpyridines, which may be used alone or as a mixture of two or more of them.

Examples of the couplers represented by formulae (A-1) to (A-6), and the synthesis processes thereof are described in the publications given below.

Compounds represented by formula (A-1) are described, for example, in JP-A No. 162548/1974, compounds represented by formula (A-2), for example, in JP-A No. 43659/1985, compounds represented by formula (A-3), for example, in JP-B ("JP-B" means examined Japanese patent publication) No. 27411/1972, compounds represented by formula (A-4), for example, in JP-A No. 171956/1984, compounds represented by formula (A-5), for example, in JP-A No. 33552/1985, and the compounds represented by formula (A-6), for example, in U.S. Pat. No. 3,061,432. Highly-color-forming ballasting groups described, for example, in JP-A Nos. 42045/1983, 214854/1984, 177553/1984, 177554/1984, and 177557/1984 can be applied to any of the compounds represented by formulae (A-1) to (A-6).

Specific examples of the pyrazoloazole coupler used in the present invention are given below, but the present invention is not limited to them.

| Coupler | $R^2$ | $R^3$ | X |
|---|---|---|---|
| | | 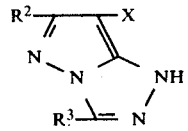 | Formula (A-3) |
| (A-3)-1 | $CH_3$— | 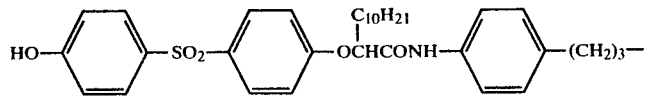 | Cl |
| (A-3)-2 | $CH_3$— | 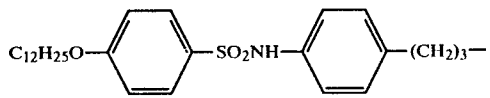 | Cl |
| (A-3)-3 | 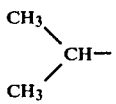 | 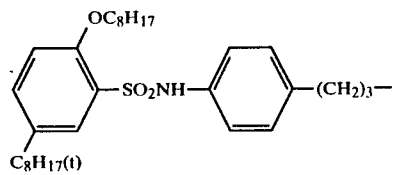 | Cl |
| (A-3)-4 | $CH_3$— | 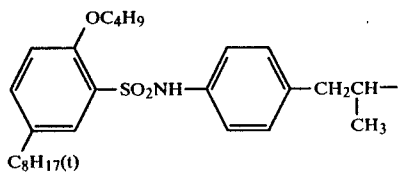 | Cl |
| (A-3)-5 | 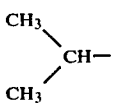 | 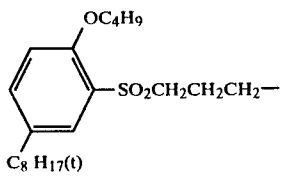 | Cl |

-continued

| Coupler | $R^2$ | $R^3$ | X |
|---|---|---|---|
| (A-3)-6 | $(CH_3)_2CH-$ | $C_{12}H_{25}O-C_6H_4-SO_2NH-C_6H_4-O(CH_2)_2S-$ | $OC_4H_9$, $-S-C_6H_3-C_8H_{17}(t)$ |
| (A-3)-7 | $CH_3-$ | $OC_8H_{17}$, $C_8H_{17}(t)$, $-C_6H_3-SO_2NH-C_6H_4-CH_2S-$ | $OC_4H_9$, $-S-C_6H_3-C_8H_{17}(t)$ |
| (A-3)-8 | $(CH_3)_3C-$ | $OC_4H_9$, $C_8H_{17}(t)$, $-C_6H_3-SO_2(CH_2)_2-$ | Cl |
| (A-3)-9 | $CH_3-$ | $OC_4H_9$, $C_8H_{17}(t)$, $-C_6H_3-SO_2(CH_2)_3-$ | $OC_4H_9$, $-S-C_6H_3-C_8H_{17}(t)$ |
| (A-3)-10 | $CH_3-$ | $OC_8H_{17}$, $-C_6H_3-SO_2NH-C_6H_4-(CH_2)_3-$; $OC_4H_9$, $HO-C_6H_2-SO_2NH-$, $C_4H_9(t)$ | Cl |

-continued
| Coupler | $R^2$ | $R^3$ | X |
|---|---|---|---|
| (A-3)-11 | $CH_3$— | $C_6H_{13}$ / $C_8H_{17}$ $CHCH_2SO_2(CH_2)_2$— | Cl |
| | | 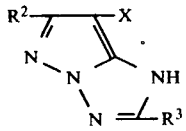 | Formula (A-4) |
| (A-4)-1 | $CH_3$— | 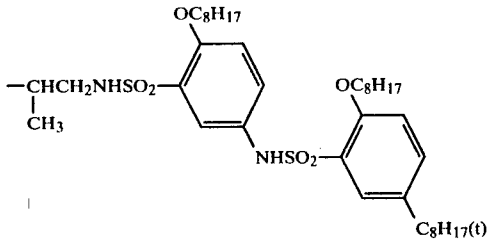 | Cl |
| (A-4)-2 | $CH_3$— | 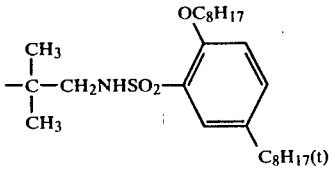 | Cl |
| (A-4)-3 | $C_2H_5O$— | 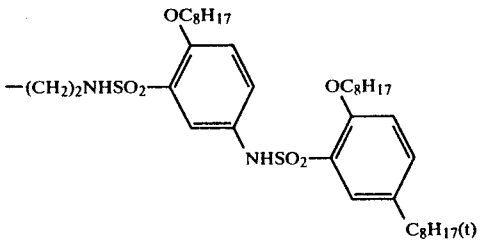 | 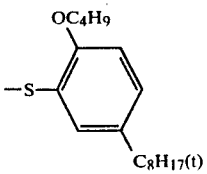 |

-continued
| Coupler | $R^2$ | $R^3$ | X |
|---|---|---|---|
| (A-4)-4 | 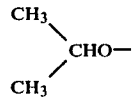 | 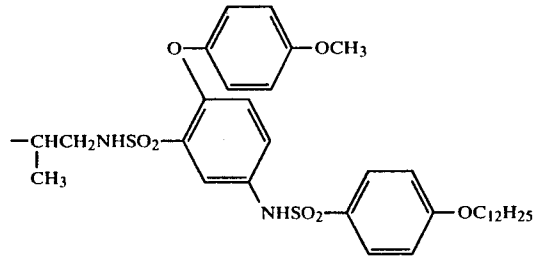 | 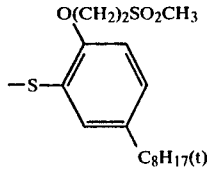 |
| (A-4)-5 | $CH_3O(CH_2)_2O$— | 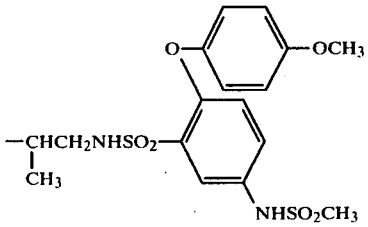 | 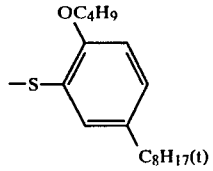 |
| (A-4)-6 | $CH_3NHCONH$— | 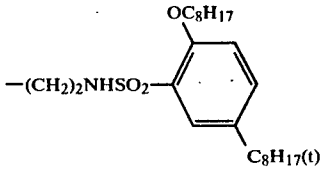 | |
| (A-4)-7 | 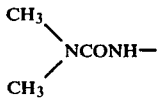 | 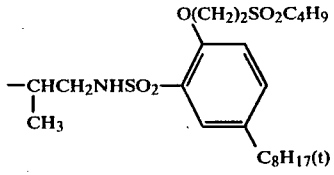 | 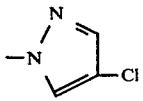 |

-continued
| Coupler | $R^2$ | $R^3$ | X |
|---|---|---|---|
| (A-4)-8 | $CF_3CH_2O-$ | 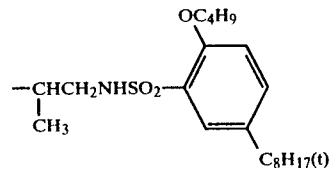 | 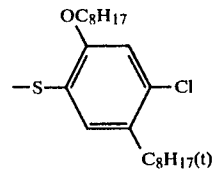 |
| (A-4)-9 | 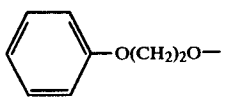 | 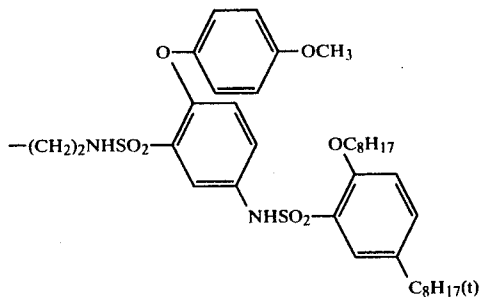 | 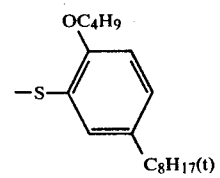 |
| (A-4)-10 | $CH_3SO_2(CH_2)_2O-$ | 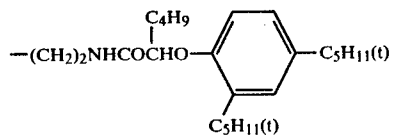 | |
| (A-4)-11 | 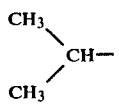 | 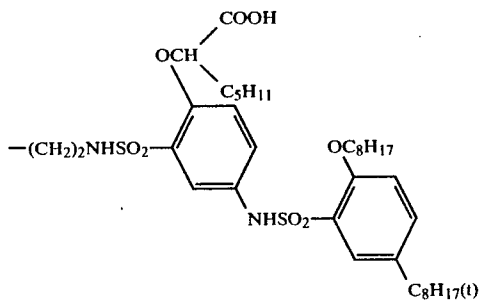 | 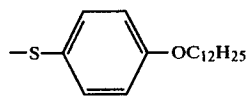 |

-continued
| Coupler | $R^2$ | $R^3$ | X |
|---|---|---|---|
| (A-4)-12 | $CH_3$— | 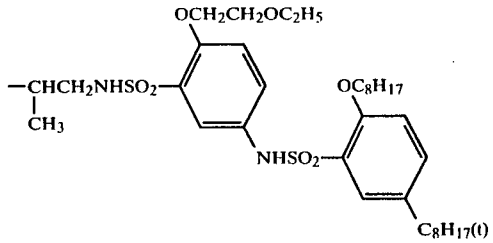 | Cl |
| (A-4)-13 | $CH_3$— | 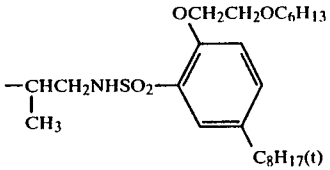 | Cl |
| (A-4)-14 | 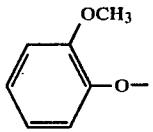 | 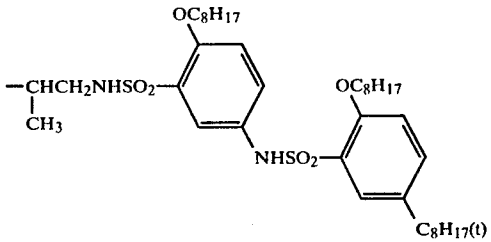 | 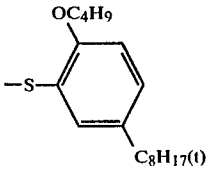 |
| (A-4)-15 | 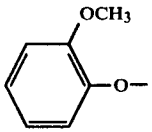 | 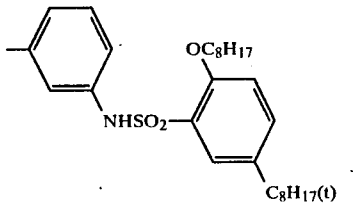 | |

-continued
| Coupler | $R^2$ | $R^3$ | X |
|---|---|---|---|
| (A-4)-16 | 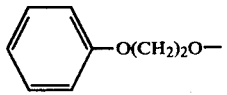 | 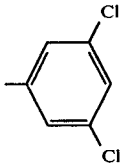 | 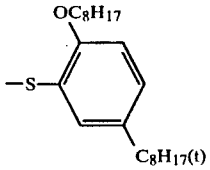 |
| (A-4)-17 | 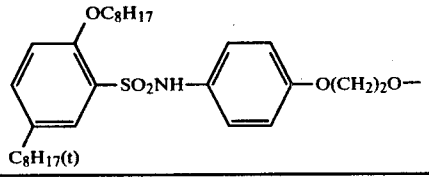 | 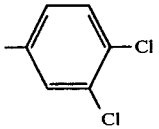 | 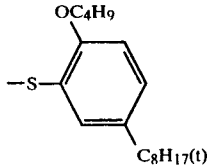 |
(A-1)-1
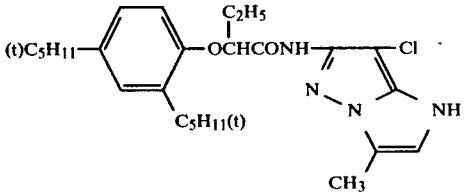
(A-1)-2
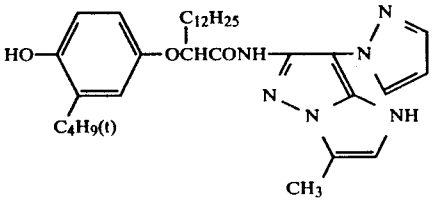
(A-1)-3

-continued
| Coupler | $R^2$ | $R^3$ | X |
|---|---|---|---|
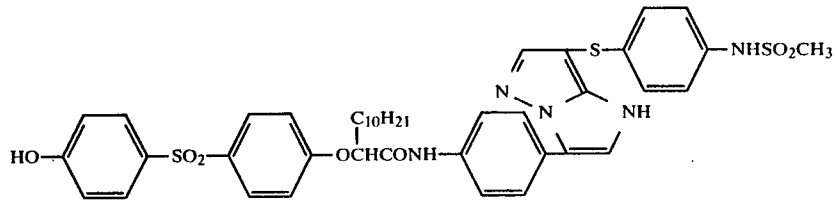
(A-6)-1
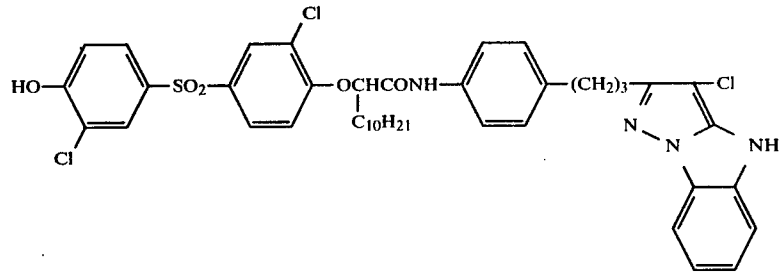
(A-6)-2
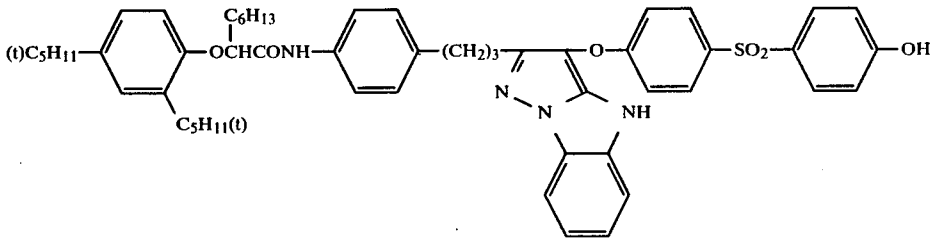
(A-2)-1

-continued
| Coupler | $R^2$ | $R^3$ | X |
|---|---|---|---|
| | 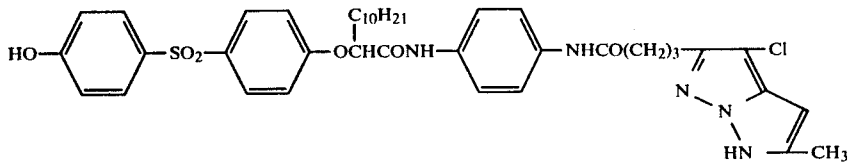 | | |
Example of polymer coupler
(A-3)-12
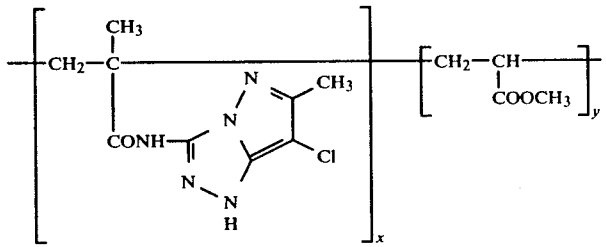
x:y = 40:60 (in molar ratio)
(A-4)-18
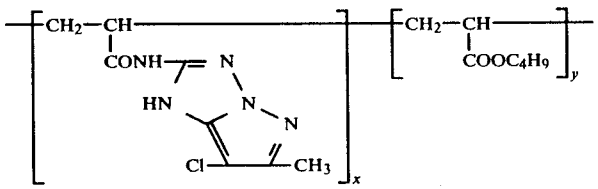
x:y = 50:50 (in molar ratio)

These couplers are added in an amount of $2\times10^{-3}$ to $5\times10^{-1}$ mol, and preferably $1\times10^{-2}$ to $5\times10^{-1}$ mol, per mol of silver in the emulsion layer.

The above couplers, etc. may be used as a mixture of two or more in the same layer to satisfy characteristics required for the photographic material, or the same compound may also be added to two or more layers.

Herein, the above emulsion layer is preferably a green-sensitive emulsion layer consisting of a high-silver-chloride emulsion.

To introduce the coupler to the silver halide emulsion layer, known methods, for example the method described in U.S. Pat. No. 2,322,027, can be used. The coupler, for example, is dissolved, for example, in a phthalic acid alkyl ester (e.g., dibutyl phthalate and dioctyl phthalate), a phosphate (e.g., diphenyl phosphate, triphenyl phosphate, tricresyl phosphate, and dioctylbutyl phosphate), a citrate (e.g., acetyl tributyl citrate), a benzoate (e.g., octyl benzoate), an alkylamide (e.g., diethyllaurylamide), a fatty acid ester (e.g., dibutoxyethyl succinate and diethyl azelate), a trimesate (e.g., tributyl trimesate), or an organic solvent having a boiling point of about 30° to 150° C., such as a lower alkyl acetate, for example ethyl acetate and butyl acetate, ethyl propionate, sec-butyl alcohol, methyl isobutyl ketone, β-ethoxyethyl acetate, and methyl cellosolve acetate, and it is dispersed in a hydrophilic colloid. The above high-boiling organic solvents and the above low-boiling organic solvents can be mixed for use.

Steps in latex dispersion processes as a polymer dispersion process for dispersing the couplers used in the present invention, the effects thereof, and specific examples of the latexes for impregnation are described, for example, in U.S. Pat. No. 4,199,363 and West German Patent Application (OLS) Nos. 2,541,274 and 2,541,230, and a dispersion process by organic-solvent-soluble polymers is described in PCT/JP87/00492.

Now the compounds represented by formula (I), (II), and (III) will be described in more detail.

Formula (I)

$$R_1\text{-}(A)_n\,X$$

Formula (II)

$$R_2-\underset{\underset{B}{|}}{C}=Y$$

wherein $R_1$ and $R_2$ each represent an aliphatic group, an aromatic group, or a heterocyclic group, X represents a group that will split off by reacting with the aromatic amine developer, A represents a group that will react with the aromatic amine developer to form a chemical bond, n is 1 or 0, B represents a hydrogen atom, an aliphatic group, an aromatic group, a heterocyclic group, an acyl group, or a sulfonyl group, Y represents a group that facilitates the addition of the aromatic amine developer to the compound represented by formula (II), and $R_1$ and X, or Y and $R_2$, or B may bond together to form a ring structure.

Formula (III)

$$R_3-Z$$

wherein $R_3$ represents an aliphatic group, an aromatic group, or a heterocyclic group, and Z represents a nucleophilic group or a group that will decompose in the photographic material to release a nucleophilic group.

The compounds represented by formula (I), (II), and (III) will now be described in more detail.

Preferably the compound represented by formula (I) or (III) is one that can react with p-anishidine at the second-order reaction-specific rate $k_2$ (80° C.), measured by the method described in JP-A No. 158545/1988, in the range of 1.0 l/mol·sec to $1\times10^{-5}$ l/mol·sec. On the other hand, preferably the compound represented by formula (II) is one wherein Z is a group that is derived from a nucleophilic functional group having a Pearson's nucleophilic $^{n}CH_3I$ value of 5 or over (R. G. Pearson, et al., J. Am. Chem. Soc., 90, 319 (1968)).

Of the compounds represented by formulae (I) to (III), a combination of a compound represented by formula (I) or (II) with a compound represented by formula (III) is preferably used.

The groups in the compounds represented by formula (I), (II), or (III) will now be described in more detail.

The aliphatic group represented by $R_1$, $R_2$, B, and $R_3$ refers to a linear, branched, or cyclic alkyl group, alkenyl group, or alkynyl group, which may be substituted. The aromatic group represented by $R_1$, $R_2$, B, and $R_3$ refers to a carbocyclic aromatic group (e.g., phenyl and naphthyl) or a heterocyclic aromatic group (e.g., fury, thienyl, pyrazolyl, pyridyl, and indolyl) that may be of a monocyclic type or a condensed ring type (e.g., benzofuryl and phenanthridinyl). These aromatic rings may be substituted.

The heterocyclic group represented by $R_1$, $R_2$, B, and $R_3$ is preferably a group having a 3- to 10-membered cyclic structure made up of carbon atoms, oxygen atoms, nitrogen atoms, sulfur atoms or hydrogen atoms, and the heterocyclic ring itself may be a saturated ring or an unsaturated ring that may be substituted (e.g., chromanyl, pyrrolidyl, pyrrolinyl, and morpholinyl).

X of formula (I) represents a group that will split off by reacting with the aromatic amine developer, an oxygen atom, a sulfur atom, or a nitrogen atom, and preferably represents a group that bonds through the oxygen atom, the sulfur atom, or the nitrogen atom (e.g., 2-pyridyloxy, 2-pyrimidyloxy, 4-pyrimidyloxy, 2-(1,2,3-triazine)oxy, 2-benzimidazolyl, 2-imidazolyl, 2-thiazolyl, 2-benzthiazolyl, 2-furyloxy, 2-thiophenyloxy, 4-pyridyloxy, 3-isooxazolyloxy, 3-pyrazolidinyloxy, 3-oxo-2-pyrazolonyl, 2-oxo-1-pyridinyl, 4-oxo-1-pyridinyl, 1-benzimidazolyl, 3-pyrazolyloxy, 3H-1,2,4-oxadiazoline-5-oxy, aryloxy, alkoxy, alkylthio, arylthio, a substituted N-oxy), or a halogen atom.

A of formula (I) represents a group that will react with the aromatic amine developer to form a chemical bond, and it includes a group containing an atom with a low electron density, such as $$-L-\overset{\overset{Y}{\|}}{C}-,\ -L-\overset{\overset{Y}{\|}}{S}-,\ -L-\underset{\underset{Y'}{\|}}{\overset{\overset{Y}{\|}}{S}}-,$$

$$-L-\underset{\underset{Y'}{\|}}{\overset{\overset{Y}{\|}}{P}}-,\ \text{and}\ -L-\underset{\underset{R''}{|}}{\overset{\overset{R'}{|}}{Si}}-.$$

When X is a halogen atom, n is 0. Herein L represents a single bond, an alkylene group, —O—, —S—,

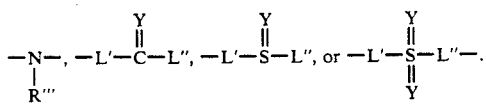

(e.g., carbonyl, sulfonyl, sulfinyl, oxycarbonyl, phosphonyl, thiocarbonyl, aminocarbonyl, and silyloxy).

Y has the same meaning as that of Y of formula (II), and Y' has the same meaning as that of Y.

R' and R'', which may be the same or different, each represent -L'''-$R_1$. R''' represents a hydrogen atom, an aliphatic group (e.g., methyl, isobutyl, t-butyl, vinyl, benzyl, octadecyl, and cyclohexyl), an aromatic group (e.g., phenyl, pyridyl, and naphthyl), a heterocyclic group (e.g., piperidinyl, pyranyl, furanyl, and chromanyl), an acyl group (e.g., acetyl and benzoyl), or a sulfonyl group (e.g., methanesulfonyl, and benzenesulfonyl). L', L''', and L'' each represent —O—, —S—, or

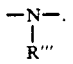

L'' may represent a single bond.

Preferably A represents, in particular, a divalent group such as

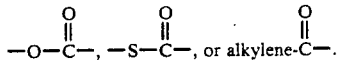

Of the compounds represented by formula (I), more preferable compounds are those represented by formulae (I-a), (I-b), (I-c) or (I-d) that react with p-anisidine at the second-order reaction-specific rate $k_2$ (80° C.) in the range of $1\times10^{-1}$ l/mol sec to $1\times10^{-5}$ l/mol sec.

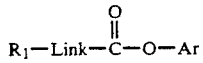

Formula (I-a)

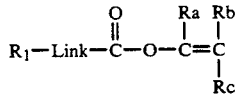

Formula (I-b)

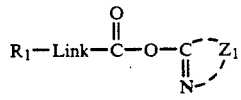

Formula (I-c)

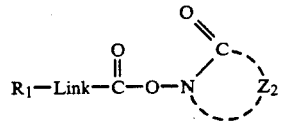

Formula (I-d)

wherein $R_1$ has the same meaning as that of $R_1$ of formula (I), and Link represents a single bond or —O—. Ar has the same meaning as that of the aromatic group defined for $R_1$, $R_2$, and B in formula (I) and (II), except those that will react with the aromatic amine developer to release a group useful as a reducer for photography, such as hydroquinone derivatives and catechol derivatives. Ra, Rb, and Rc, which may be the same or different, each represent a hydrogen atom, an aliphatic group, an aromatic group, or a heterocyclic group that has the same meaning as defined for those of $R_1$, $R_2$, and B, or an alkoxy group, an aryloxy group, a heterocyclic oxy group, an alkylthio group, an arylthio group, a heterocyclic thio group, an amino group, an alkylamino group, an acyl group, an amido group, a sulfonamido group, a sulfonyl group, an alkoxycarbonyl group, a sulfo group, a carboxyl group, a hydroxy group, an acyloxy group, a ureido group, a urethane group, a carbamoyl group, or a sulfamoyl group, Ra and Rb, or Rb and Rc may bond together to form a 5- to 7-membered heterocyclic ring, which may be substituted, or they may form, for example, a spiro-ring or a bicyclo-ring, to which an aromatic ring may be fused, and $Z_1$ and $Z_2$ each represent a group of nonmetal atoms required to form a 5- to 7-membered heterocyclic ring, which may be substituted, or they may form a spiro-ring or a bicyclo-ring, to which an aromatic ring may be fused.

In formula (I-a) of formulae (I-a) to (I-d), to adjust the second-order reaction-specific rate $k_2$ (80° C.) with p-anisidine within the range of $1\times10^{-1}$ l/mol.sec to $1\times10^{-5}$ l/mol.sec, use can be made of substituents if Ar is a carbocyclic aromatic group. Preferably, the total of δ values of Hammett of the substituents is 0.2 or over, more preferably 0.4 or over, and particularly preferably 0.6 or over, although it will be influenced by the type of group represented by $R_1$.

When the compound represented by any one of formulae (I-a) to (I-d) is added in the production of the photographic material, it is preferable that the total number of carbon atoms of the compound itself is 13 or over. In order to accomplish the objects of the present invention, it is not preferable that the compounds of the present invention decompose when development is effected.

Preferably Y of formula (II) represents an oxygen atom, a sulfur atom, =N—$R_4$, or

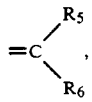

wherein $R_4$, $R_5$, and $R_6$ each represent a hydrogen atom, an aliphatic group (e.g., methyl, isopropyl, t-butyl, vinyl, benzyl, octadecyl, and cyclohexyl), an aromatic group (e.g., phenyl, pyridyl, and naphthyl), a heterocyclic group (e.g., piperidyl, pyranyl, furanyl, and chromanyl), an acyl group (e.g., acetyl and benzoyl), or a sulfonyl (e.g., methanesulfonyl and benzenesulfonyl), and $R_5$ and $R_6$ may bond together to form a ring structure.

Of the compounds represented by formula (I) and (II), those represented by formula (I) are particularly preferable. Of them, more preferable compounds are those represented by formula (I-a) or (I-c), with those represented by formula (A-a) particularly preferable.

Z of formula (III) represents a nucleophilic group or a group that will decompose in the photographic material to release a nucleophilic group. Examples thereof are nucleophilic groups wherein the atom that will chemically bond directly to the oxidized product of the aromatic amine developer is an oxygen atom, a sulfur atom, or a nitrogen atom (e.g., amine compounds, azide compounds, hydrazine compounds, mercapto compounds, sulfide compounds, sulfinic acid compounds, cyano compounds, thiocyano compounds, thiosulfuric acid compounds, seleno compounds, halide compounds, carboxy compounds, hydroxamic acid compounds, active methylene compounds, phenol compounds, and nitrogen heterocyclic compounds).

Preferable compounds of those represented by formula (III) can be represented by the following formula (III-a):

Formula (III-a)

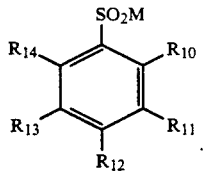

wherein M represents an atom or a radical that will form an inorganic salt (e.g., Li, Na, K, Ca, and Mg) or an organic salt (e.g., triethylamine, methylamine, and ammonia), or

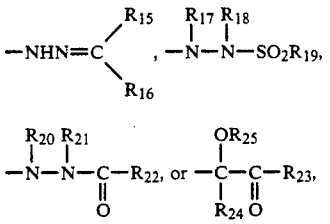

in which $R_{15}$ and $R_{16}$, which may be the same or different, each represent a hydrogen atom, an aliphatic group, an aromatic group, or a heterocyclic group, $R_{15}$ and $R_{16}$ may bond together to form a 5- to 7-membered ring, $R_{17}$, $R_{18}$, $R_{20}$, and $R_{21}$, which may be the same or different, each represents a hydrogen atom, an aliphatic group, a heterocyclic group, an acyl group, an alkoxycarbonyl group, a sulfonyl group, a ureido group, or a urethane group, provided that at least one of $R_{17}$ and $R_{18}$ and at least one of $R_{20}$ and $R_{21}$ each is a hydrogen atom, $R_{19}$ and $R_{22}$ each represent a hydrogen atom, an aliphatic group, an aromatic group, or a heterocyclic group, $R_{19}$ may represent an alkylamino group, an arylamino group, an alkoxy group, an aryloxy group, an acyl group, an alkoxycarbonyl group, or an aryloxycarbonyl group, at least two of $R_{17}$, $R_{18}$, and $R_{19}$ may bond together to form a 5- to 7-membered ring, at least two of $R_{20}$, $R_{21}$, and $R_{22}$ may bond together to form a 5- to 7-membered ring, $R_{23}$ represents a hydrogen atom, an aliphatic group, an aromatic group, or a heterocyclic group, $R_{24}$ represents a hydrogen atom, an aliphatic group, an aromatic group, a halogen atom, an acyloxy group, or a sulfonyl group, and $R_{25}$ represents a hydrogen atom or a hydrolyzable group, $R_{10}$, $R_{11}$, $R_{12}$, $R_{13}$, and $R_{14}$, which may be the same or different, each represent a hydrogen atom, an aliphatic group (e.g., methyl, isopropyl, t-butyl, vinyl, benzyl, octadecyl, and cyclohexyl), an aromatic group (e.g., phenyl, pyridyl, and naphthyl), a heterocyclic group (e.g., piperidyl, pyranyl, furanyl, and chromanyl), a halogen atom (e.g., chlorine and bromine), $-SR_{26}$, $-OR_{26}$,

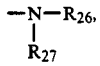

an acyl group (e.g., acetyl and benzoyl), an alkoxycarbonyl group (e.g., methoxycarbonyl, butoxycarbonyl, cyclohexylcarbonyl, and octyloxycarbonyl), an aryloxycarbonyl group (e.g., phenyloxycarbonyl and naphthyloxycarbonyl), a sulfonyl group (e.g., methanesulfonyl and benzenesulfonyl), a sulfonamido group (e.g., methanesulfonamido and benzenesulfonamido), a sulfamoyl group, a ureido group, a urethane group, a carbamoyl group, a sulfo group, a carboxyl group, a nitro group, a cyano group, an alkoxalyl group (e.g., methoxalyl, isobutoxalyl, octyloxalyl, and benzoyloxalyl), an aryloxalyl group (e.g., phenoxalyl and naphthoxalyl), a sulfonyloxy group (e.g., methanesulfonyloxy and benzenesulfonyloxy),

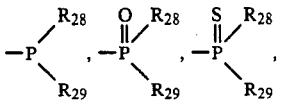

or a formyl group, in which $R_{26}$ and $R_{27}$, which may be the same or different, each represent a hydrogen atom, an aliphatic group, an aromatic group, an acyl group, or a sulfonyl group, and $R_{28}$ and $R_{29}$, which may be the same or different, each represent a hydrogen atom, an aliphatic group, an aromatic group, an alkoxy group, or an aryloxy group.

It is preferable that the total of values of Hammett of the benzene substituents is 0.5 or over for the group $-SO_2M$, in view of the effect of the present invention.

Typical examples of these compounds are given below, but the present invention is not limited to these examples.

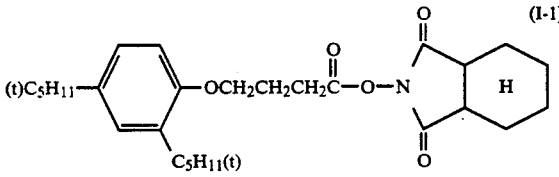

(I-1)

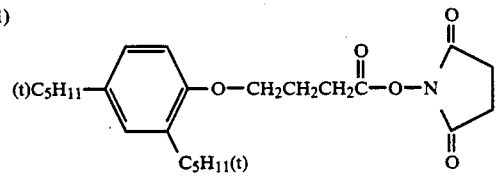

(I-2)

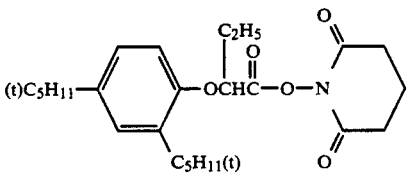

(I-3)

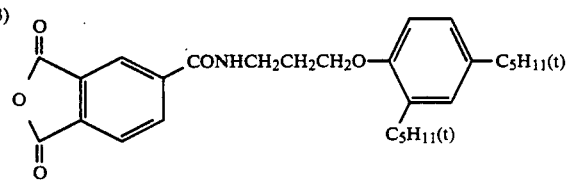

(I-4)

-continued
(I-5)
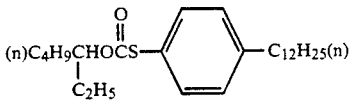
(I-6)
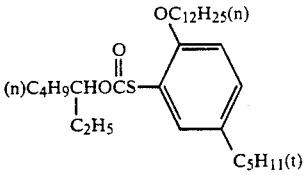
(I-7) $(n)C_{18}H_{37}I$
(I-8) $(n)C_{18}H_{37}Br$
(I-9)
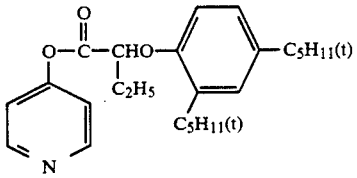
(I-10)
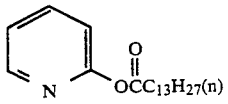
(I-11)
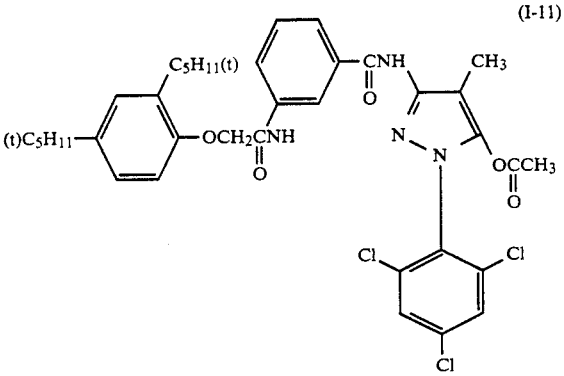
(I-12)
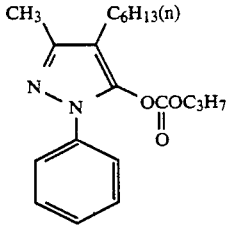
(I-13)
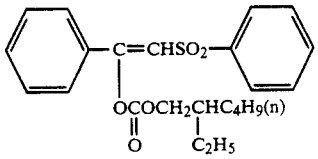
(I-14)
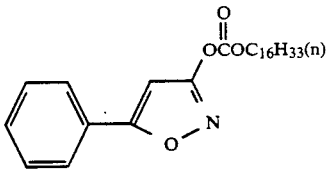
(I-15)
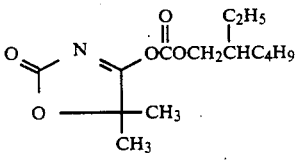
(I-16)
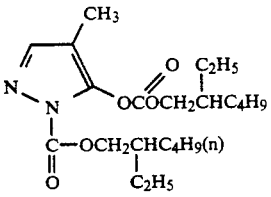
(I-17)
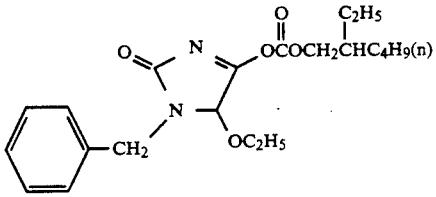
(I-18)
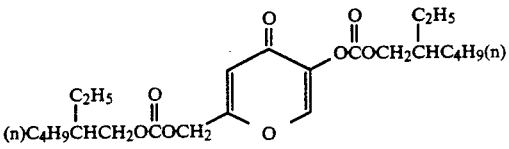
(I-19)
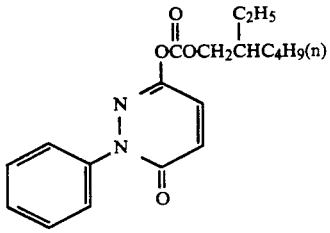
(I-20)
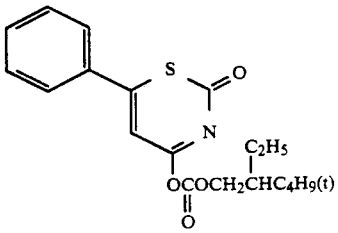

-continued
(I-21)
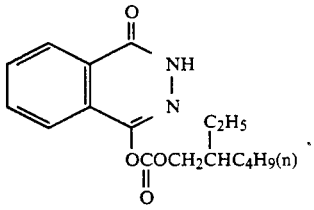
(I-22)
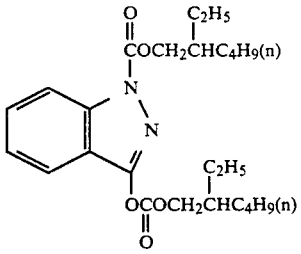
(I-23)
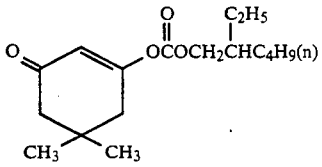
(I-24)
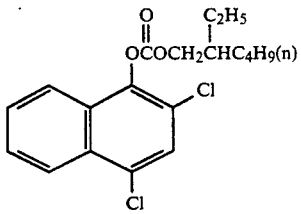
(I-25)
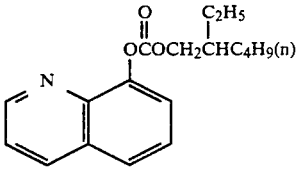
(I-26)
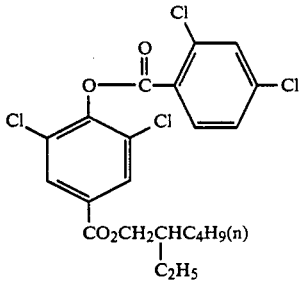
(I-27)
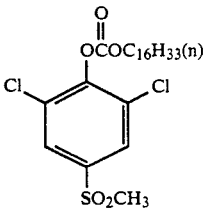
(I-28)
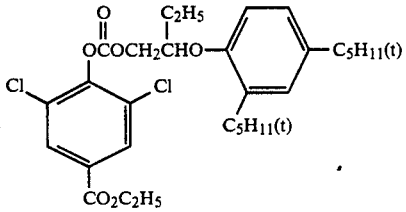
(I-29)
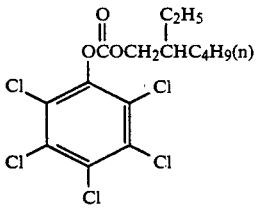
(I-30)
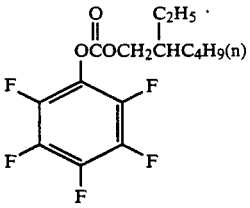
(I-31)
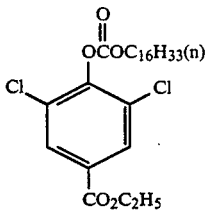
(I-32)
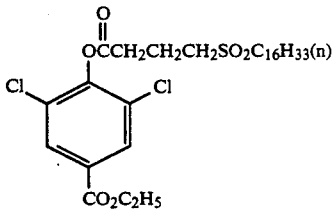
(I-33)
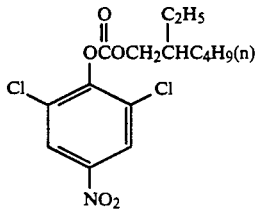
(I-34)
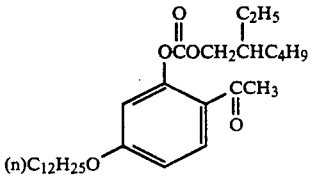

-continued
(I-35)
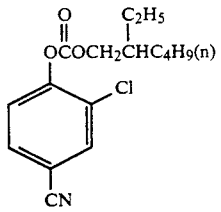
(I-36)
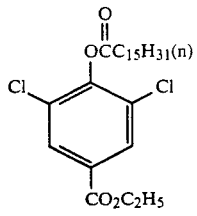
(I-37)
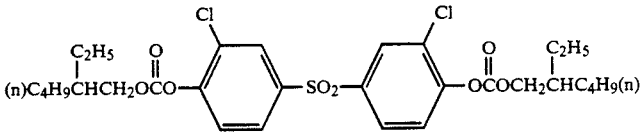
(I-38)
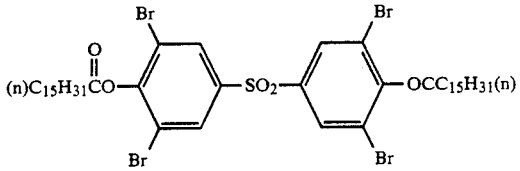
(I-39)
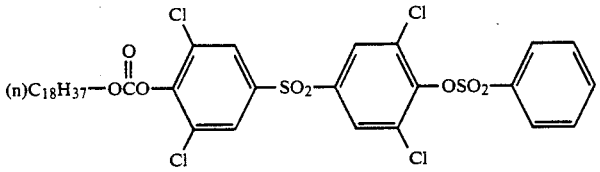
(I-40)
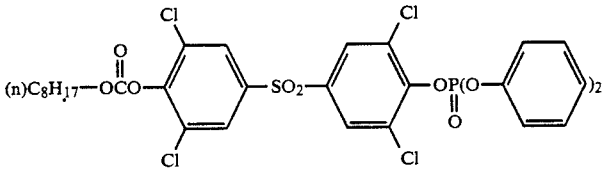
(I-41)
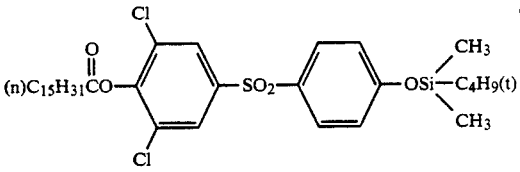
(I-42)
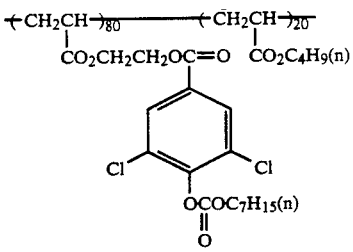
(I-43)
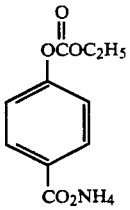
(I-44)
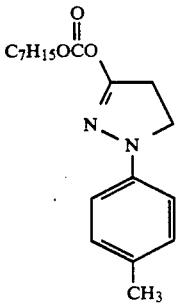

-continued
(I-45)
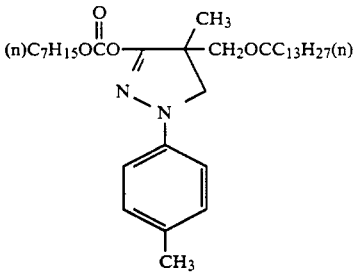
(I-46)
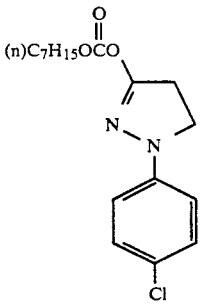
(I-47)
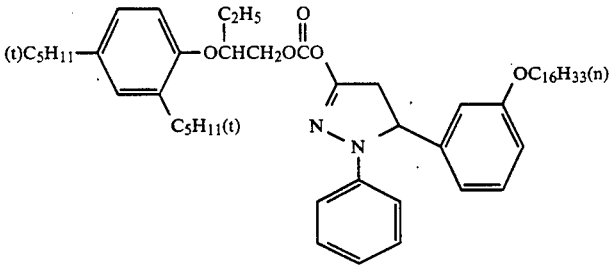
(I-48)
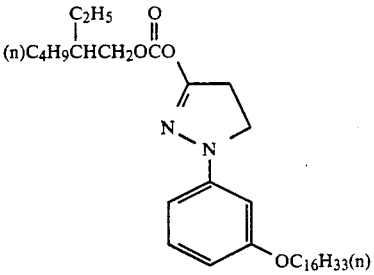
(I-49)
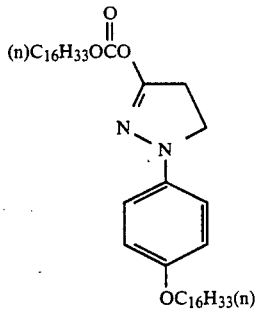
(I-50)
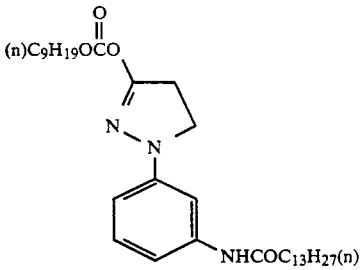
(I-51)
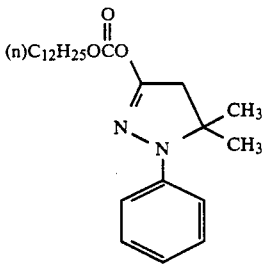
(II-1)
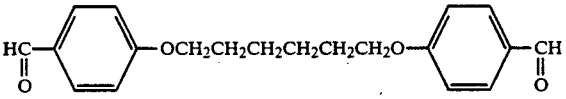
(II-2)
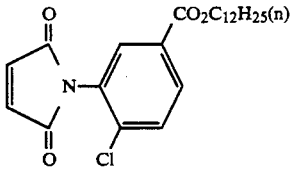
(II-3)
$CH_2{=}CH{-}SO_2{-}C_{18}H_{37}(n)$
(II-4)
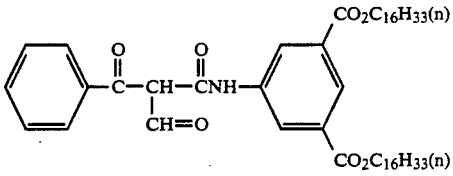
(II-5)
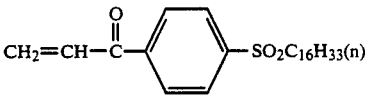

-continued
(III-1)
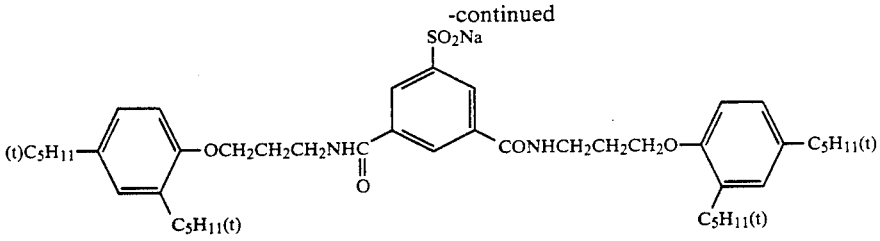
(III-2)
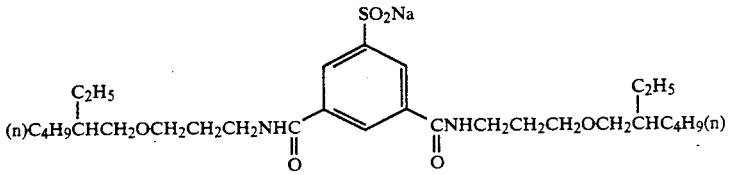
(III-3)
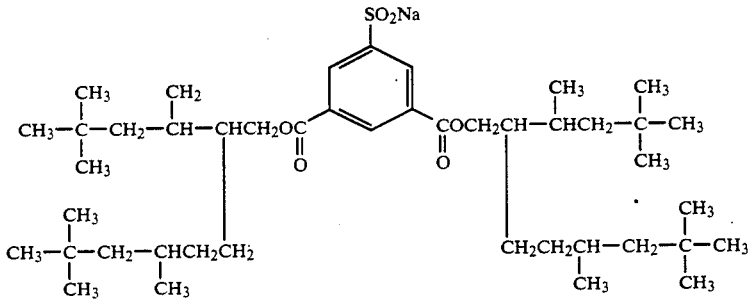
(III-4)
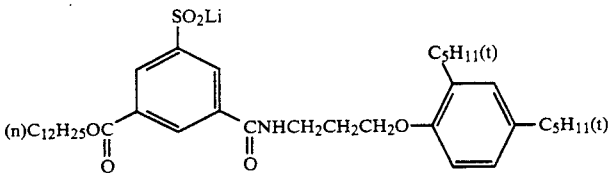
(III-5)
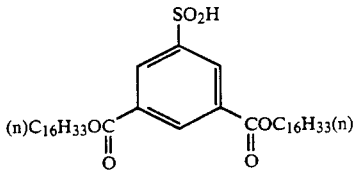
(III-6)
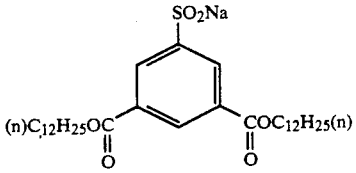
(III-7)
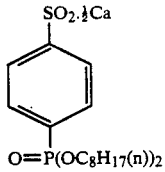
(III-8)
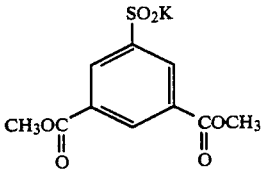
(III-9)
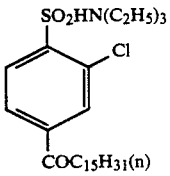
(III-10)
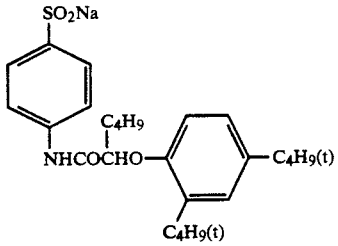
(III-11)
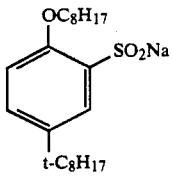
(III-12)
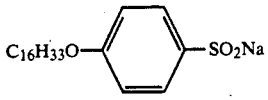

-continued
(III-13)
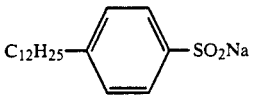
(III-14)
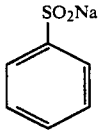
(III-15)
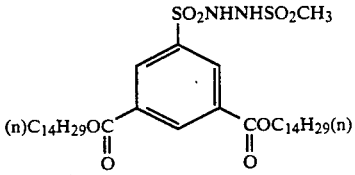
(III-16)
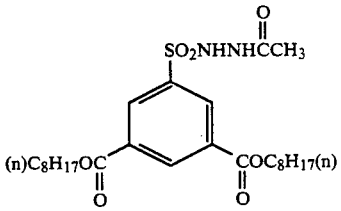
(III-17)
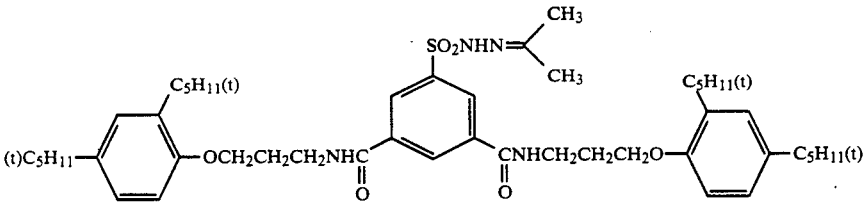
(III-18)
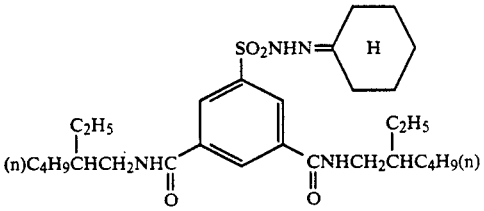
(III-19)
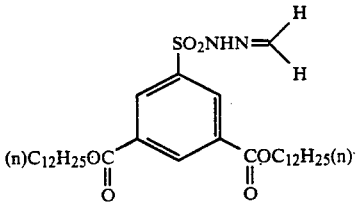
(III-20)
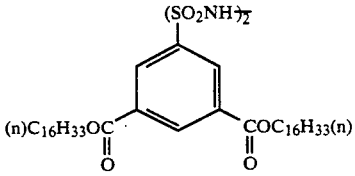
(III-21)
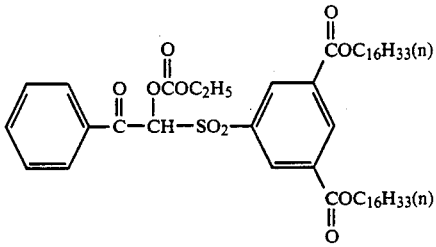
(III-22)
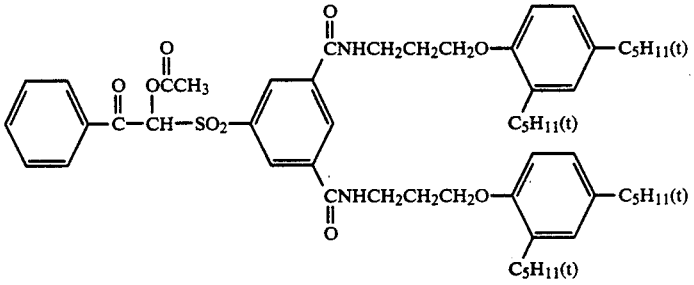
(III-23)
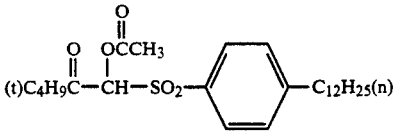
(III-24)
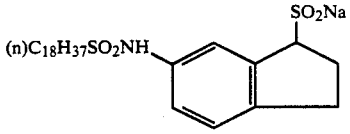

-continued (III-25)

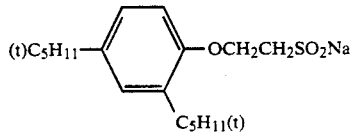

(III-26)

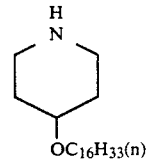

(III-27)

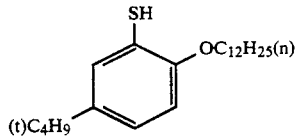

(III-28)

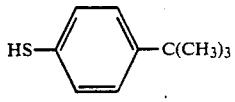

(III-29)

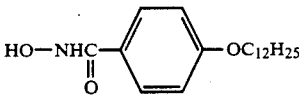

(III-30)

$NaN_3$ (III-31)

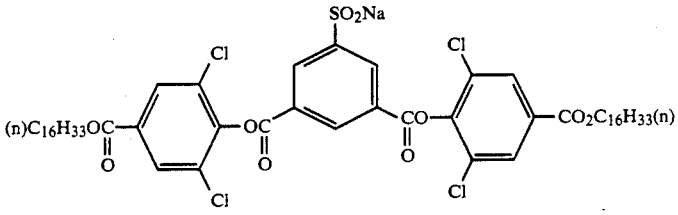

These compounds can be synthesized by or based on the processes described in JP-A Nos. 143048/1987, 115855/1988, 115866/1988, 158545/1988, and European Patent Publication No. 255722.

Preferable compounds of the present invention include compounds exemplified specifically in JP-A Nos. 283338/1987 and 229145/1987.

Of the compounds represented by formula (I), (II), and (III), compounds having a low molecular weight or those that can be readily soluble in water may be added to the processing solution, thereby allowing the compound to be taken into the photographic material in the step of development processing. Preferably such compounds are added to a hydrophilic colloid layer of the photographic material when the photographic material is produced.

In the latter case the compound is dissolved in a high-boiling solvent (oil), having a boiling point of 170 C. under atmospheric pressure, or in a low-boiling solvent, or in a mixed solvent of such an oil and a low-boiling solvent, and the resulting solution is emulsified and dispersed in a hydrophilic colloid aqueous solution, such as a gelatin aqueous solution.

In the present invention, preferably the compounds represented by formula (I), (II), or (III) are soluble in high-boiling organic solvents. Although there is no limit on the grain size of the grains of the emulsified dispersion, preferably the grain size is 0.05 to 0.5 μm, and particularly preferably 0.1 to 0.3 μm.

When the compound represented by formula (I), (II), or (III) of the present invention is used in a layer containing a coupler, it is preferable that the compound is added together with the coupler. In this case the oil/coupler weight ratio is from 0.01 to 3.0. In the present invention, the proportion of the compound represented by formula (I), (II), or (III) is $5\times10^{-3}$ to 5 mols, and preferably $1\times10^{-2}$ to 2 mols, per mol of the coupler.

When a compound represented by formula (I), (II), or (III) of the present invention is used in a layer other than the above layer, depending on the purpose of the other compound used in the particular layer, the compound of the present invention may be added to the particular layer together with the other compound in the same emulsified dispersion system, or it may be added as a separate emulsified dispersion to the particular layer. The compound of the present invention may be added as an aqueous solution, or as a solution of an organic solvent miscible with water. Further, if necessary, another layer may be provided in the photographic material in the above way. The amount of the compounds represented by formula (I), (II), and (III) of the present invention contained in one layer is $1\times10^{-2}$ to $1\times10^{-7}$ mol/m$^2$, and preferably $5\times10^{-3}$ to $5\times10^{-6}$ mol/m$^2$.

If the amount is too small, there is a tendency that the effect of the present invention is hardly exhibited, while if the amount is excessive, the color-forming reaction is sometimes hampered.

As the compounds represented by formulae (I), (II), and (III) of the present invention, a combination use of a compound represented by formula (I) or (II) and a compound represented by formula (III) is preferable rather than each independent use. A combination of a compound represented by formula (I) and a compound represented by formula (III) is more preferable.

The high-silver-chloride color photographic material of the present invention can be constituted by applying at least each of a blue-sensitive silver halide emulsion layer, a green-sensitive silver halide emulsion layer, and a red-sensitive silver halide emulsion layer on a base. For common color print papers, the above silver halide emulsion layers are applied in the above-stated order on the base, but the order may be changed. Color reproduction by the subtractive color process can be performed by incorporating, into these photosensitive emulsion layers, silver halide emulsions sensitive to respective wavelength ranges, and so-called couplers capable of forming dyes complementary to light to which the couplers are respectively sensitive, that is, capable of forming yellow complementary to blue, magenta complementary to green, and cyan complementary to red. However, the constitution may be such that the photosensitive layers and the color formed from the couplers do not have the above relationship.

As the silver halide emulsion of the present invention, a emulsion of high silver chloride content, so-called a high-silver-chloride emulsion may be used. The content of silver chloride is 80 mol % or over, preferably 95 mol % or over, more preferably 98 mol % or over.

As the silver halide emulsion used in the present invention, one comprising silver chlorobromide or silver chloride and being substantially free from silver iodide can be preferably used. Herein the term "substantially free from silver iodide" means that the silver iodide content is 1 mol % or below, and preferably 0.2 mol % or below. Although the halogen compositions of the emulsions may be the same or different from grain to grain, if emulsions whose grains have the same halogen composition are used, it is easy to make the properties of the grains homogeneous. With respect to the halogen composition distribution in a silver halide emulsion grain, for example, a grain having a so-called uniform-type structure, wherein the composition is uniform throughout the silver halide grain, a grain having a so-called layered-type structure, wherein the halogen composition of the core of the silver halide grain is different from that of the shell (which may comprises a single layer or layers) surrounding the core, or a grain having a structure with nonlayered parts different in halogen composition in the grain or on the surface of the grain (if the nonlayered parts are present on the surface of the grain, the structure has parts different in halogen composition joined onto the edges, the corners, or the planes of the grain) may be suitably selected and used. To secure high sensitivity, it is more advantageous to use either of the latter two than to use grains having a uniform-type structure, which is also preferable in view of the pressure resistance. If the silver halide grains have the above-mentioned structure, the boundary section between parts different in halogen composition may be a clear boundary, or an unclear boundary, due to the formation of mixed crystals caused by the difference in composition, or it may have positively varied continuous structures.

The silver chloride content of these high-silver-chloride emulsions is preferably 90 mol % or over, and more preferably 95 mol % or over.

In these high-silver-chloride emulsions, the structure is preferably such that the silver bromide localized layer in the layered form or nonlayered form is present in the silver halide grain and/or on the surface of the silver halide grain as mentioned above. The silver bromide content of the composition of the above-mentioned localized layer is preferably at least 10 mol %, and more preferably over 20 mol %. The localized layer may be present in the grain, or on the edges, or corners of the grain surfaces, or on the planes of the grains, and a preferable example is a localized layer epitaxially grown on each corner of the grain.

On the other hand, for the purpose of suppressing the lowering of the sensitivity as much as possible when the photographic material undergoes pressure, even in the case of high-silver-chloride emulsions having a silver chloride content of 90 mol % or over, it is preferably also practiced to use grains having a uniform-type structure, wherein the distribution of the halogen composition in the grain is small.

In order to reduce the replenishing amount of the development processing solution, it is also effective to increase the silver chloride content of the silver halide emulsion. In such a case, an emulsion whose silver chloride is almost pure, that is, whose silver chloride content is 98 to 100 mol %, is also preferably used.

The average grain size of the silver halide grains contained in the silver halide emulsion used in the present invention (the diameter of a circle equivalent to the projected area of the grain is assumed to be the grain size, and the number average of grain sizes is assumed to be an average grain size) is preferably 0.1 to 2 μm.

Further, the grain size distribution thereof is preferably one that is a so-called monodisperse dispersion, having a deviation coefficient (obtained by dividing the standard deviation of the grain size by the average grain size) of 20% or below, and desirably 15% or below. In this case, for the purpose of obtaining one having a wide latitude, it is also preferable that monodisperse emulsions as mentioned above are blended to be used in the same layer, or are applied in layers.

As to the shape of the silver halide grains contained in the photographic emulsion, use can be made of grain in a regular crystal form, such as cubic, tetradecahedral, or octahedral, or grains in an irregular crystal form, such as spherical or planar, or grains that are a composite of these. Also, a mixture of silver halide grains having various crystal forms can be used. In the present invention, of these, grains containing grains in a regular crystal form in an amount of 50% or over, preferably 70% or over, and more preferably 90% or over, are preferred.

Further, besides those mentioned above, an emulsion wherein the tabular grains having an average aspect ratio (the diameter of a circle calculated/the thickness) of 5 or over, and preferably 8 or over, exceed 50% of the total of the grains in terms of the projected area, can be preferably used.

The silver chloromide emulsion used in the present invention can be prepared by methods described, for example, by P. Glafkides, in *Chimie et Phisique Photographique* (published by Paul Montel, 1967), by G. F. Duffin in *Photographic Emulsion Chemistry* (published by Focal Press, 1966), and by V. L. Zelikman et al. in *Making and Coating Photographic Emulsion* (published by Focal Press, 1964). That is, any of the acid process, the neutral process, the ammonia process, etc. can be used, and to react a soluble silver salt and a soluble halide, for example, any of the single-jet process, the double-jet process, or a combination of these can be used. A process of forming grains in an atmosphere having excess silver ions (the so-called reverse precipitation process) can also be used. A process wherein the pAg in the liquid phase where a silver halide is to be formed is kept constant, that is, the so-called controlled double-jet process, can be used as one type of double-jet process. According to the controlled double-jet process, a silver halide emulsion wherein the crystal form is regular and the grain sizes are nearly uniform can be obtained.

Into the silver halide emulsion used in the present invention, various polyvalent metal ion impurities can be introduced during the formation or physical ripening of the emulsion grains. Examples of such compounds to be used include salts of cadmium, zinc, lead, copper, and thallium, and salts or complex salts of an element of Group VIII, such as iron, ruthenium, rhodium, palladium, osmium, iridium, and platinum. Particularly the elements of Group VIII can be preferably used. Although the amount of these compounds to be added varies over a wide range according to the purpose, preferably the amount is $10^{-9}$ to $10^{-2}$ mol for the silver halide.

The silver halide emulsion used in the present invention is generally chemically sensitized and spectrally sensitized.

With respect to the chemical sensitization, sulfur sensitization, wherein typically an unstable sulfur compound is added, noble metal sensitization—typically gold sensitization—or reduction sensitization, can be used alone or in combination. With respect to compounds used in the chemical sensitization, it is preferable to use those described in JP-A No. 215372/1987, in the lower right column on page 18 to the upper right column on page 22.

Spectral sensitization is performed for the emulsions of the layers of the present photographic material, so as to provide the emulsions with spectral sensitivities in the desired light wavelength ranges. In the present invention, it is preferable to add a dye for absorbing light in the wavelength range corresponding to the intended spectral sensitivity, that is, a spectral-sensitizing dye. As the spectral-sensitizing dye used, those described, for example, by F. M. Harmer in *Heterocyclic compounds—Cyanine dyes and related compounds* (published by John Wiley & Sons (New York, London), 1964) can be mentioned. Examples of specific compounds are preferably those described in the above-mentioned JP-A No. 215272/1987, page 22 (the upper right column) to page 38.

The silver halide emulsion used in the present invention may contain various compounds or their precursors to prevent fogging during photographic processing, storage, or manufacturing process of the photographic material or to stabilize the photographic performance. These are generally referred to as photographic stabilizers. Examples of these compounds to be used preferably include those described on pages 39 to 72 of the above-mentioned JP-A No. 215272/1987.

Silver halide emulsions for use in the present invention may be a so-called surface latent-image-type emulsion, which form a latent image primarily on the grain surface or a so-called interior-latent-image-type emulsion, which form a latent image primarily in the interior of the grains.

The total coating amount of silver in the high-silver-chloride color photographic material of the present invention is preferably 0.40 to 0.75 g/m$^2$, more preferably 0.45 to 0.70 g/m$^2$. When the total coating amount of silver is over 0.75 g/m$^2$, the purpose of the present invention is not attained, since the fluctuation of photographic characteristics during continuous processing become large and the residual silver after processing become large. The lower limit of the total coating amount of silver may be determined in accordance with the density of the color image desired. Thus generally the total coating amount of silver more than 0.40 g/m$^2$ may be preferable in view of the color density necessary to form image.

Known photographic additives including those to be used in preparing an emulsion that can be used in the present invention are described in *Research Disclosure* No. 17643 and ibid. No. 18716, and the involved sections are listed in the following Table.

| Additive | RD 17643 | RD 18716 |
|---|---|---|
| 1 Chemical sensitizer | p. 23 | p. 648 (right column) |
| 2 Sensitivity-enhancing agents | " | " |
| 3 Spectral sensitizers, Supersensitizers | pp. 23–24 | pp. 648 (right column)–649 (right column) |
| 4 Brightening agents | p. 24 | |
| 5 Antifogging agents and Stabilizers | pp. 24–25 | p. 648 (right column) |
| 6 Light absorbers, Filter dyes and UV absorbers | pp. 25–26 | pp. 649 (right column)–650 (right column) |
| 7 Stain-preventive agents | p. 25 (right column) | p. 650 (left to right column) |
| 8 Image-dye stabilizers | p. 25 | — |
| 9 Hardeners | p. 26 | p. 651 (left column) |
| 10 Binders | p. 26 | " |
| 11 Plasticizers and Lubricants | p. 27 | p. 650 (right column) |
| 12 Coating aids and Surface-active agents | pp. 26–27 | " |
| 13 Antistatic agents | p. 27 | " |

Generally, a yellow coupler, a magenta coupler, and a cyan coupler that will couple with the oxidized product of an aromatic amine color-developing agent to develop yellow, magenta, and cyan, respectively, are used in the color photographic material.

Of yellow couplers that can be used in the present invention, acylacetamide derivatives, such as pivaloylacetanilide and benzoylacetanilide, are preferable.

As the yellow coupler, among others, couplers represented by the following formulae (Y-1) and (Y-2) are preferable:

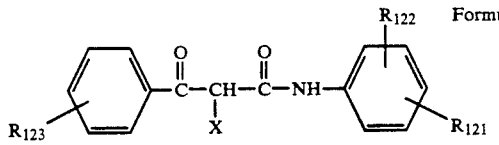

Formula (Y-1)

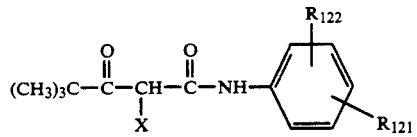

Formula (Y-2)

wherein X represents a hydrogen atom or a coupling split-off group, $R_{121}$ represents a ballast group having 8 to 32 carbon atoms in all, $R_{122}$ represents a hydrogen atom, one or more halogen atoms, a lower alkyl group, a lower alkoxy group, or a ballast group having 8 to 32 carbon atoms in all, $R_{123}$ represents a hydrogen atom or a substituent, and if there are two or more $R_{123}$'s, they may be the same or different.

Details of pivaloylacetanilide yellow couplers are described in U.S. Pat. No. 4,622,287 (column 3, line 15 to column 8, line 39) and U.S. Pat. No. 4,623,616 (column 14, line 50 to column 19, line 41).

Details of benzoylacetanilide yellow couplers are described in U.S. Pat. Nos. 3,408,194, 3,933,501, 4,046,575, 4,133,958, and 4,401,752.

Specific examples of pivaloylacetanilide yellow couplers are compound examples (Y-1) to (Y-39), described in the above-mentioned U.S. Pat. No. 4,622,287 (columns 37 to 54), and among others, (Y-1), (Y-4), (Y-6), (Y-7), (Y-15), (Y-21), (Y-22), (Y-23), (Y-26), (Y-35), (Y-36), (Y-37), (Y-38), and (Y-39) are preferable.

Further, compound examples (Y-1) to (Y-33), described in the above-mentioned U.S. Pat. No. 4,623,616 (columns 19 to 24), can be mentioned, and among others, for example, (Y-2), (Y-7), (Y-8), (Y-12), (Y-20), (Y-21), (Y-23), and (Y-29) are preferable.

Other preferable compounds include a typical example (34) described in U.S. Pat. No. 3,408,194 (column 6), compound examples (16) and (19) described in U.S. Pat. No. 3,933,501 (column 8), compound example (9) described in U.S. Pat. No. 4,046,575 (columns 7 to 8), compound example (1) described in U.S. Pat. No. 4,133,958 (columns 5 to 6), compound example 1 described in U.S. Pat. No. 4,401,752 (column 5), and compounds (a) to (h) given below.

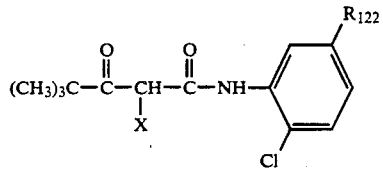

| Compound | $R_{122}$ | X |
|---|---|---|
| a | $-CO_2CH(CH_3)CO_2C_{12}H_{25}$ | 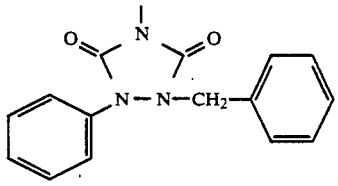 |
| b | $-CO_2CH(C_4H_9)CO_2C_{12}H_{25}$ | The same as the above |
| c | 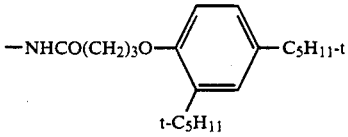 | 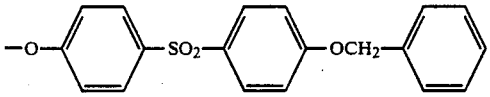 |
| d | The same as the above | 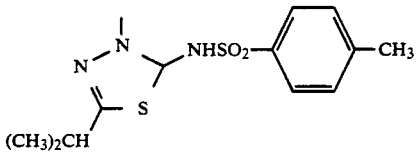 |
| e | the same as the above | 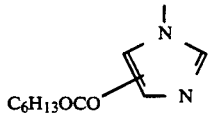 |
| f | $-NHSO_2C_{12}H_{25}$ | 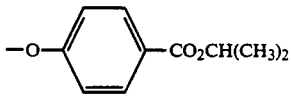 |
| g | $-NHSO_2C_{16}H_{33}$ | 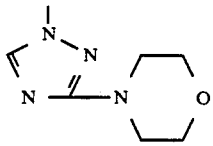 |

-continued

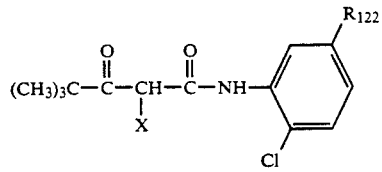

| Compound | $R_{122}$ | X |
|---|---|---|
| h | $-NHCOCH(CH_3)CH_2SO_2C_{12}H_{25}$ | 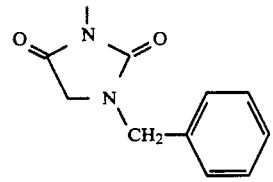 |

Of the above couplers, ones whose atom that can be coupling split-off is a nitrogen atom are particularly preferable.

Other magenta couplers used in combination with the pyrazoloazole-type coupler in the present invention include oil-protected-type indazolone couplers, cyanoacetyl couplers, preferably 5-pyrozolone couplers. Among 5-pyrazolone couplers, couplers wherein an arylamino group or an acylamino group is substituted at the 3-position are preferable in view of the color density and the hue of the color-developed dye, and typical examples thereof are described, for example, in U.S. Pat. Nos. 2,311,082, 2,343,703, 2,600,788, 2,908,573, 3,062,653, 3,152,896, and 3,936,015. As the coupling split-off group of 2-equivalent 5-pyrazolone couplers, nitrogen-linked coupling split-off groups, described in U.S. Pat. No. 4,310,619, and arylthio groups, described in U.S. Pat. No. 4,351,897, and International Publicaiton Patent WO No. 88/4795, are preferable. 5-Pyrazolone couplers having a ballast group described in European Patent No. 73,636 can give a high color density.

These compounds can be represented specifically by the following formula (M-1) or (M-2).

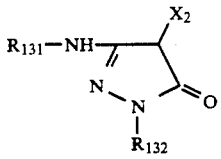

Formula (M-1)

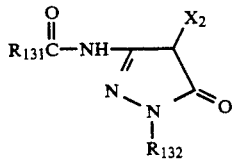

Formula (M-2)

wherein $R_{131}$ represents an antidiffusionable group having 8 to 32 carbon atoms in all, $R_{132}$ represents an unsubstituted or a substituted phenyl group, and $X_2$ represents a hydrogen atom or a coupling split-off group.

As the cyan coupler, phenol series cyan couplers and naphthol series cyan couplers are the most typical.

The phenol series cyan coupler includes those which have an acylamino group at the 2-position of the phenol nucleus, and an alkyl group at the 5-position of the phenol nucleus (inclusive of polymer couplers) described, for example, in U.S. Pat. Nos. 2,369,929, 4,518,687, 4,511,647, and 3,772,002, and as typical examples thereof can be mentioned the coupler described in Example 2 in Canadian Patent No. 625,822, Compound (1) described in U.S. Pat. No. 3,772,002, Compounds (1-4) and (1-5) described in U.S. Pat. No. 4,564,590, Compounds (1), (2), (3), and (4) described in JP-A 39045/1986, and Compound (C-2) described in JP-A No. 70846/1987.

The phenol series cyan coupler includes 2,5-diacylaminophenol couplers described in U.S. Pat. Nos. 2,772,162, 2,895,826, 4,334,011, and 4,500,653, and JP-A No. 164555/1984, and as typical examples thereof can be mentioned Compound (V) described in U.S. Pat. No. 2,895,826, Compound (17) described in U.S. Pat. No. 4,557,999, Compounds (2) and (12) described in U.S. Pat. No. 4,565,777, Compound (4) described in U.S. Pat. No. 4,124,396, and Compound (1-19) described in U.S. Pat. No. 4,613,564.

The phenol series cyan coupler also includes those described in U.S. Pat. Nos. 4,372,173, 4,564,586, and 4,430,423, JP-A Nos. 390441/1986 and 257158/1987, wherein a nitrogen-containing heterocyclic ring is condensed to the phenol nucleus, and as typical examples thereof can be mentioned Couplers (1) and (3) described in U.S. Pat. No. 4,327,173, Compounds (3) and (15) described in U.S. Pat. No. 4,564,586, Compounds (1) and (3) described in U.S. Pat. No. 4,430,423, and compounds given below:

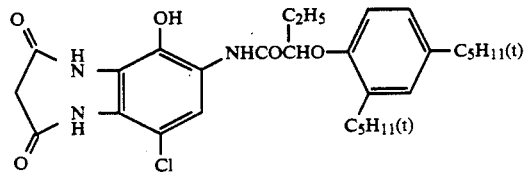

-continued
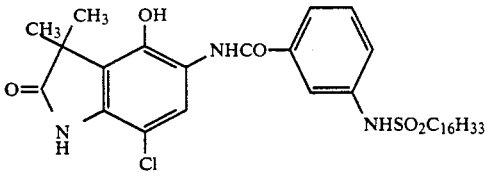
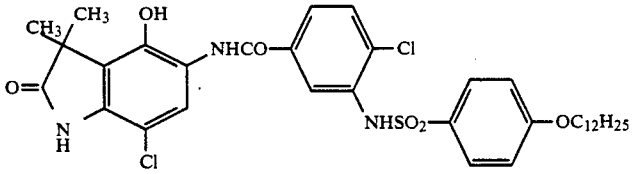
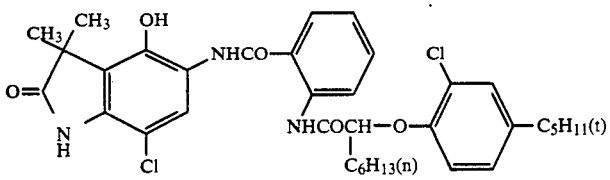
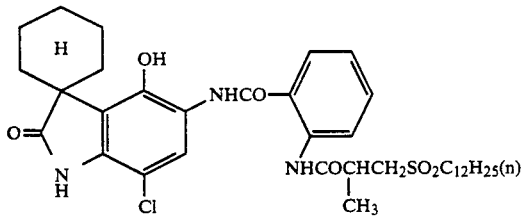
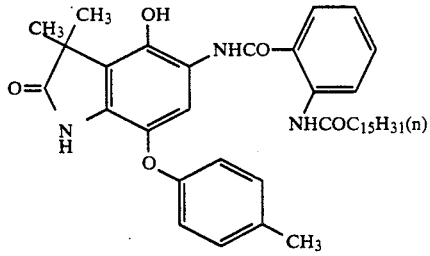
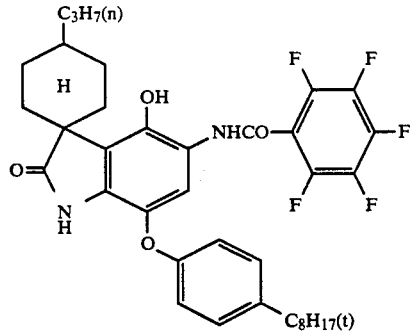
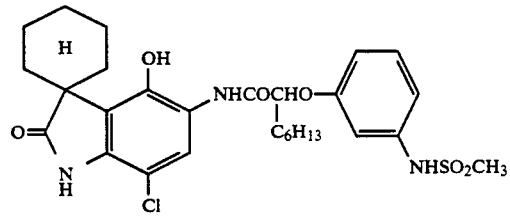

In addition to the cyan couplers of the above types, for example, diphenylimidazole cyan couplers described in European Patent Application Publication EP 0,249,453A2 can be used.

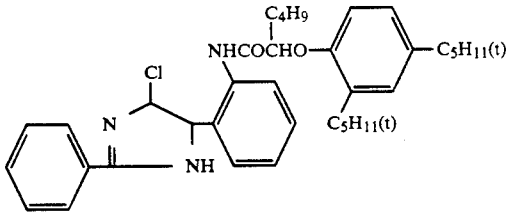

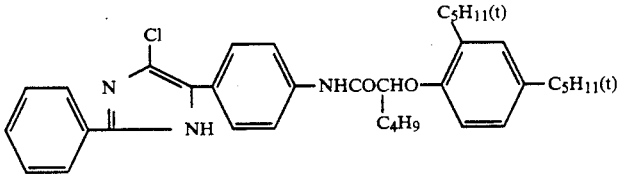

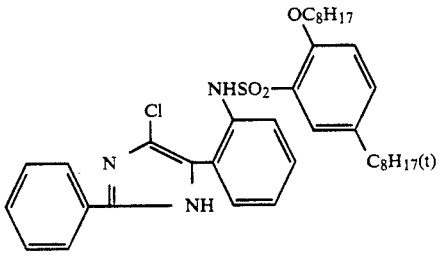

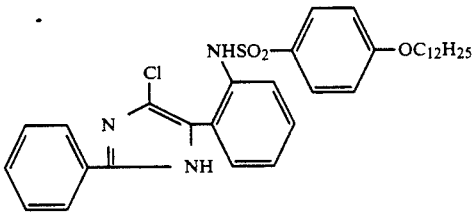

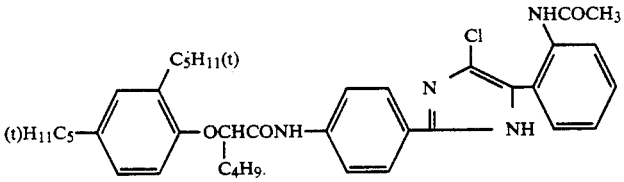

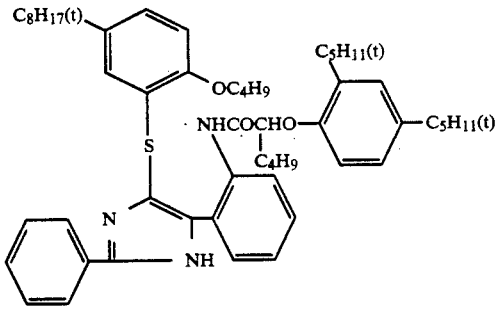

The phenol series cyan coupler further includes ureide series couplers described, for example, in U.S. Pat. Nos. 4,333,999, 4,451,559, 4,444,872, 4,427,767, and 4,579,813, and European Patent (EP) 067,689B1, and as typical examples thereof can be mentioned Coupler (7) described in U.S. Pat. No. 4,333,999, Coupler (1) described in U.S. Pat. No. 4,451,559, Coupler (14) described in U.S. Pat. No. 4,444,872, Coupler (3) described in U.S. Pat. No. 4,427,767, Couplers (6) and (24) described in U.S. Pat. No. 4,609,619, Couplers (1) and (11) described in U.S. Pat. No. 4,579,813, Couplers (45) and (50) described in European Patent (EP) 067,689B1, and Coupler (3) described in JP-A No. 42658/1986.

The naphthol series cyan coupler includes, for example, those having an N-alkyl-N-arylcarbamoyl group at the 2-position of the naphthol nucleus (e.g., see U.S.

Pat. No. 2,313,586), those having an alkylcarbamoyl group at the 2-position (e.g., see U.S. Pat. Nos. 2,474,293, and 4,282,312), those having an arylcarbamoyl group at the 2-position (e.g., see JP-B ("JP-B" means examined Japanese patent publication) No. 14523/1975), those having a carbonamido group or a sulfonamido group at the 5-position (e.g., see JP-A Nos. 237448/1985, 145557/1986, and 153640/1986), those having an aryloxy-coupling split-off group (e.g., see U.S. Pat. No. 3,476,563), those having a substituted alkoxy-coupling split-off group (e.g., see U.S. Pat. No. 4,296,199), and those having a glycolic acid-coupling split-off group (e.g., see JP-B No. 39217/1985).

These couplers can be dispersed together with at least one high-boiling organic solvent, to incorporated in an emulsion layer. As the high-boiling organic solvent, such high boiling organic solvents as described in JP-A No. 215272/1987 including the pyrazoloazole couplers of the present invention can be used. As the other high-boiling organic solvent N,N-dialkyloniline derivatives can be mentioned. Of these, a compound having an alkoxy group bonded to the ortho position of said N,N-dialkyl-amino group of the nucleus is preferable. In particular, it is preferable to use these solvents with a coupler represented by formula (M-1) or (M-2). The amount to be used is in an range of 0.1 to 5 mol, preferably 0.2 to 3 mol, per mol of coupler.

These couplers can also be emulsified and dispersed into a hydrophilic colloid aqueous solution by impregnating then into a loadable latex polymer (e.g., see U.S. Pat. No. 4,203,716) in the presence or absence of the above-mentioned high-boiling organic solvent, or by dissolving then in a water-insoluble and organic-solvent-soluble polymer.

The photographic material that is prepared according to the present invention may contain, as a color antifoggant, for example, a hydroquinone derivative, an aminophenol derivative, a gallic acid derivative, or an ascorbic acid derivative.

In the photographic material of the present invention, various anti-fading agents (discoloration preventing agents) can be used. As organic anti-fading agents for cyan, magenta, and/or yellow images, typical examples are hydroquinones, 6-hydroxychromans, 5-hydroxycoumarans, spirochromans, p-alkoxyphenols, hindered phenols, including bisphenols, gallic acid derivatives, methylenedioxybenzenes, aminophenols, and hindered amines, and ether or ester derivatives thereof, obtained by silylating or alkylating the phenolic hydroxyl group of these compounds. Metal complexes such as (bis-salicylaldoxymato)nickel complexes, and (bis-N,N-dialkyldithiocarbamato)nickel complexes can also be used.

Specific examples of organic anti-fading agents are described in the following patent specifications.

Hydroquinones are described, for example, in U.S. Pat. Nos. 2,360,290, 2,418,613, 2,700,453, 2,701,197, 2,728,659, 2,732,300, 2,735,765, 3,982,944, and 4,430,425, British Patent No. 1,363,921, and U.S. Pat. Nos. 2,710,801 and 2,816,028; 6-hydroxychromans, 5-hydroxycoumarans, and spirochromans are described, for example, in U.S. Pat. Nos. 3,432,300, 3,573,050, 3,574,627, 3,698,909, and 3,764,337, and JP-A No. 152225/1987; spiroindanes are described, for example, in U.S. Pat. No. 4,360,589; p-alkoxyphenols are described, for example, in U.S. Pat. No. 2,735,765, British Patent No. 2,066,975, JP-A No. 10539/1984, and JP-B No. 19765/1982; hindered phenols are described, for example, in U.S. Pat. No. 3,700,455, JP-A No. 72224/1977, U.S. Pat. No. 4,228,235, and JP-B No. 6623/1977; gallic acid derivatives, methylenedioxybenzenes, and aminophenols are described, for example, in U.S. Pat. Nos. 3,457,079, and 4,332,886, and JP-B No. 21144/1981, respectively; hindered amines are described, for example, in U.S. Pat. Nos. 3,336,135, and 4,268,593, British Patent Nos. 1,326,889, 1,354,313, and 1,410,846, JP-B No. 1420/1976, and JP-A Nos. 114036/1983, 53846/1984, and 78344/1984; ether and ester derivatives obtained by silylating or alkylating their phenolic hydroxyl group are described, for example, in U.S. Pat. Nos. 4,155,765, 4,174,220, 4,254,216, and 4,264,720, JP-A No. 145530/1979, 6321/1980, 105147/1983, and 10539/1984, JP-B No. 37856/1982, U.S. Pat. No. 4,279,990, and JP-B No. 3263/1978; and metal complexes are described, for example, in U.S. Pat. Nos. 4,050,938 and 4,241,155, and British Patent No. 2,027,731 (A). These compounds are coemulsified with respective couplers, generally in amounts of 5 to 100 wt. % for respective couplers, and are added to photosensitive layers to attain the purpose. To prevent the cyan dye image from being deteriorated by heat and light, it is more effective that an ultraviolet-absorbing agent is introduced into the layers opposites to the cyan color-forming layer.

Of these anti-fading agents, spiroindanes and hindered amines are particularly preferable.

The photographic material prepared in accordance with the present invention may contain, in the hydrophilic colloid layer, an ultraviolet absorber. For example, benzotriazole compounds substituted by an aryl group (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A No. 2784/1971), ester compounds of cinnamic acid (e.g., those described in U.S. Pat. Nos. 3,705,805 and 3,707,375), butadiene compounds (e.g., those described in U.S. Pat. No. 4,045,229), and benzooxydole compounds(e.g., those described in U.S. Pat. No. 3,700,455) are useful. Couplers capable of absorbing ultraviolet-radiation (e.g., -naphthol series cyan dye-forming couplers) and polymers capable of absorbing ultraviolet-radiation may be also used. Those ultraviolet absorbers may be mordanted in a specified layer.

The photographic material prepared in accordance with the present invention may contain, in the hydrophilic colloid layer, water-soluble dyes as filter dyes or to prevent irradiation and for other purposes. Such dyes include oxonol dyes, hemioxonol dyes, styryl dyes, merocyanine dyes, cyanine dyes, and azo dyes. Among others, oxonol dyes, hemioxonol dyes, and merocyanine dyes are useful.

As a binder or a protective colloid that can be used in the emulsion layers of the present photographic material, gelatin is advantageously used, but other hydrophilic colloids can be used alone or in combination with gelatin.

In the present invention, gelatin may be lime-treated gelatin or acid-processed gelatin. Details of the manufacture of gelatin is described by Arthur Veis in *The Macromolecular Chemistry of Gelatin* (published by Academic Press, 1964).

As a base to be used in the present invention, a transparent film, such as cellulose nitrate film, and polyethylene terephthalate film or a reflection-type base that is generally used in photographic materials can be used.

For the objects of the present invention, the use of a reflection-type base is more preferable.

The "reflection base" to be used in the present invention is one that enhances reflectivity, thereby making sharper the dye image formed in the silver halide emulsion layer, and it includes one having a base coated with a hydrophobic resin containing a dispersed light-reflective substance, such as titanium oxide, zinc oxide, calcium carbonate, and calcium sulfate, and also a base made of a hydrophobic resin containing a dispersed light-reflective substance. For example, there can be mentioned baryta paper, polyethylene-coated paper, polypropylene-type synthetic paper, a transparent base having a reflective layer, or additionally using a reflective substance, such as glass plate, polyester films of polyethylene terephthalate, cellulose triacetate, or cellulose nitrate, polyamide film, polycarbonate film, polystyrene film, and vinyl chloride resin, which may be suitably selected in accordance with the purpose of the application. It is advantageous that, as the light-reflective substance, a white pigment is kneaded well in the presence of a surface-active agent, and it is preferable that the surface of the pigment particles has been treated with a divalent to tetravalent alcohol.

The occupied area ratio (%) per unit area prescribed for the white pigments finely divided particles can be obtained most typically by dividing the observed area into contiguous unit areas of 6μm×6 μm, and measuring the occupied area ratio (%) (Ri) of the finely divided particles projected onto the unit areas. The deviation coefficient of the occupied area ratio (%) can be obtained based on the ratio $s/\overline{R}$, wherein s stands for the standard deviation of Ri, and $\overline{R}$ stands for the average value of Ri. Preferably, the number (n) of the unit areas to be subjected is 6 or over. Therefore, the deviation coefficient $s/\overline{R}$ can be obtained by $$\sqrt{\frac{\sum_{i=1}^{n}(Ri-R)^2}{n-1}} \Big/ \frac{\sum_{i=1}^{n} Ri}{n}.$$

In the present invention, preferably the deviation coefficient of the occupied area ratio (%) of the finely divided particles of a pigment is 0.15 or below, and particularly 0.12 or below. If the variation coefficient is 0.08 or below, it can be considered that the substantial dispersibility of the particles is substantially "uniform."

It is preferable that the color photographic material of the present invention is subjected to a color development, a bleach-fixing and an water-washing process. Bleaching and fixing process may be carried out separately other than the one-both processing as the above.

Details of color developers used in the present invention will now be described.

The color-developer for use in the present invention may contain a known aromatic primary amine color-developing agent. Preferred examples are p-phenylenediamine derivatives. Representative examples are given below, but they are not meant to limit the present invention:

D-1: N,N-Diethyl-p-phenylenediamine

D-2: 4-[N-Ethyl-N-(β-hydroxyethyl)amino]aniline

D-3: 2-Methyl-4-[N-ethyl-N-(β-hydroxyethyl amino]-aniline

D-4: 4-Amino-3-methyl-N-ethyl-N-(β-methanesulfonamido ethyl)aniline

These p-phenylenediamine derivatives may be in the form of salts, such as sulfates, hydrochloride, sulfites, and p-toluenesulfonates.

The amount of developing agent to be used is preferably about 0.1 g to about 20 g, more preferably about 0.5 g to about 10 g, per liter of developer.

In the present invention, it is required that the color developer contains chloride ions in an amount of $3.5\times10^{-2}$ to $1.5\times10^{-1}$ mol/l. Preferably chloride ions are contained in an amount of $4.0\times10^{-2}$ to $1.0\times10^{-1}$ mol/l. If the concentration of ions exceeds $1.5\times10^{-1}$ mol/l, disadvantageously the development is made slow not leading to the attainment of the objects of the present invention such as rapid processing and high Dmax. On the other hand, if the concentration of chloride ions is less than $3.5\times10^{-2}$ mol/l, the streaked pressure-sensitized fogging is not prevented, further, the fluctuation of photographic characteristics (in particular, Dmax and Dmin) involved in continuous processing becomes great, and the residual silver after processing is much in amount, not leading to the attainment of the objects of the present invention.

In the present invention, it is required that at the same time the color developer also contains bromide ions in an amount of $3.0\times10^{-5}$ to $1.0\times10^{-3}$ mol/l. Preferably bromide ions are contained in an amount of $5.0\times10^{-5}$ to $5.0\times10^{-4}$ mol/l. If the concentration of bromide ions is more than $1.0\times10^{-3}$ mol/l, the development is made slow, Dmax and the sensitivity are made low, and if the concentration of bromide ions is less than $3.0\times10^{-5}$ mol/l, the streaked pressure-sensitized fogging is not prevented, and the fluctuation of photographic characteristics (in particular, Dmin) and insufficient desilvering are not prevented, not leading to the attainment of the objects of the present invention.

Herein, chloride ions and bromide ions may be added directly to the developer, or they may be allowed to dissolve out from the photographic material in the developer.

If chloride ions are added directly to the color developer, as the chloride ion-supplying material can be mentioned sodium chloride, potassium chloride, ammonium chloride, lithium chloride, nickel chloride, magnesium chloride, manganese chloride, calcium chloride, and cadmium chloride, with sodium chloride and potassium chloride preferred.

Chloride ions and bromide ions may be supplied as a counter ion, from a brightening agent that will be added to the developer. As the bromide ion-supplying material can be mentioned sodium bromide, potassium bromide, ammonium bromide, lithium bromide, calcium bromide, magnesium bromide, manganese bromide, nickel bromide, cadmium bromide, cerium bromide, and thallium bromide, with potassium bromide and sodium bromide preferred.

When chloride ions and bromide ions are allowed to dissolve out from the photographic material in the developer, both the chloride ions and bromide ions may be supplied from the emulsion or a source other than the emulsion.

Now, the halide ions in the color-developer of the present invention will be described in detail.

Although it is well known that chloride ions are an antifoggant, the effect is low, and the use of a large amount of chloride ions would result in neither complete prevention of the increase in fogging in continuous processing nor complete prevention of the streak fogging that will occur in a process using an automatic processor, but disadvantageously it would make the development slow and would lower the maximum density.

Further, although it is well known that bromide ions are an antifoggant, bromide ions could not be used practically, because the development was suppressed and the maximum density and the sensitivity were lowered, although fogging and streaked pressure fogging involved in continuous processing could be prevented, in accordance with the amount added.

However, the present inventors have studied in various ways and found that when a high-silver-chloride photographic material having a silver chloride content of 80 mol % or over and a total coating amount of silver of 0.75 g/m$^2$ or below is processed with a color developer containing $3.5\times10^{-2}$ to $1.5\times10^{-1}$ mol of chloride ions/l and $3.0\times10^{-5}$ to $1.0\times10^{-3}$ mol of bromide ions/l, the streaked pressure fogging that occur in processing using an automatic processor, and the fluctuation of photographic quality (particularly the fluctuation of the minimum density) involved in continuous processing can be further prevented, and in addition the amount of residual silver be reduced remarkably without the lowering of the maximum density.

That such effects were first attained by the combinated use of chloride ions and bromide ions in each specified concentration according to the present invention was unexpected and is surprising, because no effect was observed with the independent use of these ions.

Although the effects of the combination of a relatively large amount of chloride ions and a relatively small amount of bromide ions are not known at all and details of the effect are not known, the effect can be assumed as follows.

It is considered that, after exposure to light, when the photographic material undergoes excessive pressure in a color developer, the pressurized part becomes intensified and is formed with fog specks, thereby forming fogging.

However, it is assumed that since the developer of the present invention contains suitable amounts of bromide ions and chloride ions, development of fog specks is selectively suppressed, so that fogging can be suppressed without delaying development and without lowering the maximum density and the sensitivity. This selective effect for development suppression by a combination of bromide ions and chloride ions in specific concentrations is not explicable by only the change of reducing potential due to the existence of halide ions, and it is assumed that the condition of adsorption of bromide ions and chloride ions on silver halide grains has a strong influence.

Further, the effect for suppressing the photographic property fluctuation inherent in continuous processing is not also explicable by, for example, the fact that the suppression depends on the balance between a high development activity, due to the use of a high-silver-chloride emulsion, and a tendency of lowering the activity, due to the presence of suitable amounts of bromide ions and chloride ions, that is a high-activity/high suppression-type development. The meaning of including a combination of bromide ions and chloride ions in the concentration range of the present invention will be elucidated by future research.

Further, the effect for remarkably suppressing insufficient desilvering is inferred as follows. It is known that a high-silver-chloride emulsion is liable to cause insufficient desilvering. The inventors found that the defective desilvering is caused by the formation of silver sulfide. It is assumed that suitable amounts of bromide and chloride ions contained in the developer change the condition of adsorption of halide on developed silver which suppresses the formation of silver sulfide.

In JP-A No. 106655/1988, a method for processing of a silver halide photographic material containing silver chloride of 70 mol % or over by a developer containing chloride of $2\times10^{-2}$ mol or over is described. However, the concentration of bromide is out of the range of the present invention, and the specific effect due to the combination of in suitable amounts of bromide ions and chloride ions is not described. Further, the problems to be solved by the present invention are not described, so that the present invention is not analogized.

Preferably the color developer used in the present invention has a pH of 9 to 12, and more preferably 9 to 11.0, and it can contain other known developer components.

In order to keep the above pH, it is preferable to use various buffers. As buffers, there are included sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The amount of buffer to be added to the color developer is preferably 0.1 mol/l or more, and particularly preferably 0.1 to 0.4 mol/l.

In addition to the color developer can be added various chelating agents to prevent calcium or magnesium from precipitating or to improve the stability of the color developer. Specific samples are shown below, but the present invention is not limited to them: nitrilotriacetic acid, diethylenediaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycol ether diaminetetraacetic acid, glycol ether diaminetetraacetic acid, ethylenediamine-ortho-hyroxyphenyltetraacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid catechol-3,4,6-trisulfonic acid, catechol-3,5-disulfonic acid, 5-sulfosalicylic acid, and 4-sulfosalicylic acid.

If necessary, two or more of these chelating agents may be used together.

With respect to the amount of these chelating agents to be added to the color developer, it is good if the amount is enough to sequester metal ions in the color developer. The amount, for example, is on the order of 0.1 g to 10 g per liter.

If necessary, any development accelerator can be added to the color developer. As development accelerators, the following can be added as desired: thioether compounds disclosed, for example, in JP-B Nos. 16088/1962, 5987/1962, 7826/1962, 12380/1969, and 9019/1970, and U.S. Pat. No. 3,813,247; p-phenylenediamine compounds disclosed in JP-A Nos. 49829/1977 and 15554/1975; quaternary ammonium salts disclosed, for example, in JP-A No. 137726/1975, JP-B No. 30074/1969, and JP-A Nos. 156826/1981 and 43429/1977; amine compounds disclosed, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkylene oxides disclosed, for example, in JP-B Nos. 16088/1962 and 25201/1967, U.S. Pat. No. 3,128,183, JP-B Nos. 11431/1966 and 23883/1967, and U.S. Pat. No. 3,532,501; 1-phenyl-3-pyrazolidones, and imidazoles.

It is preferable that the color developer of the present invention is substantially free from benzyl alcohol. Herein the term "substantially free from" means that the amount of benzyl alcohol is 2.0 ml or below per liter of the developer, or preferably benzyl alcohol is not contained in the developer at all because of being the fluctuation of photographic characteristics little.

In the present invention, if necessary, any antifoggant can be added in addition to chloride ion and bromide ion. As antifoggants, use can be made of alkali metal halides, such as potassium iodide, and organic antifoggants. As typical organic antifoggants can be mentioned, for example, nitrogen-containing heterocyclic compounds, such as benzotriazole, 6-nitrobenzimidazole, 5-nitroisoindazole, 5-methylbenzotriazole, 5-nitrobenzotriazole, 5-chloro-benzotriazole, 2-thiazolylbenzimidazole, 2-thiazolylmethyl-benzimidazole, indazole, hydroxyazaindolizine, and adenine.

In the present invention, it is preferable use the color-developing solution not containing sulfite ion substantially in view point of process-stability during the continuous processing and the prevention of pressure-sensitized streaks, but in order to restrain the retarioration of the developing solution, physical means, for example, to not use the developing solution for long time, and to use a floating cover or to decrease the opened surface-ratio in the developing bath to repress the effect of oxydation by air, and chemical means, for example, to control the temperature of developing solution, and to add an organic preservative, may be employed. Of these means the method of using an organic preservative is advantageous in view of convenience.

In the present invention, the term "organic preservative" means organic compounds generally that can reduce the rate of deterioration of aromatic primary amine color-developing agents when added to the processing solution for the color photographic material. That is, organic preservatives are organic compounds having a function to prevent color photographic agents from being oxidized with air or the like. Of these, hydroxylamine derivatives (excluding hydroxylamine, the same being applied hereinafter), hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, diamide compounds, and condensed ring- type amines are particularly effective. They are disclosed, for example, in JP-A Nos. 4235/1988, 30845/1988, 21647/1988, 4655/1988, 53551/1988, 43140/1988, 56654/1988, 81346/1988, and 43138/1988, European Patent Publication No. 254280, JP-A Nos. 44657/1988 and 44656/1988, U.S. Pat. Nos. 3,615,503 and 2,494,903, JP-A No. 143020/1987, and JP-B ("JP-B" means examined Japanese patent publication) No. 30496/1973.

Regarding the preferable organic preservatives mentioned above, their formulas and typical compounds are mentioned below, but the present invention is not limited to them.

It is desirable that the amount of the compounds mentioned below to be added to the color developer is 0.05 to 0.5 mol/l, and preferably 0.03 to 0.1 mol/l.

As hydroxylamine derivatives, the following are preferable:

Formula (IV)

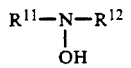

wherein $R^{11}$ and $R^{12}$ each represent a hydrogen atom, a substituted or unsubstituted alkyl group, a substituted or unsubstituted alkenyl group, a substituted or unsubstituted aryl group, or a heteroaromatic group, they do not represent hydrogen atoms at the same time, and they may bond together to form a heterocyclic ring with the nitrogen atom. The ring structure of the heterocyclic ring is a 5- to 6-membered ring, it is made of carbon atoms, halogen atoms, oxygen atoms, nitrogen atoms, sulfur atoms, etc., and it may be saturated or unsaturated.

It is preferable that $R^{11}$ and $R^{12}$ each represent an alkyl group or an alkenyl group having preferably 1 to 10 carbon atoms, more preferably 1 to 5 carbon atoms. As nitrogen-containing heterocyclic rings formed by bonding $R^{11}$ and $R^{12}$ together can be mentioned, for example, a piperidyl group, a pyrolidyl group, an N-alkylpiperazyl group, a morpholyl group, an indolinyl group, and a benztriazole group.

Preferable substituents of $R^{11}$ and $R^{12}$ are a hydroxyl group, an alkoxy group, an alkylsulfonyl group, an arylsulfonyl group, an amido group, a carboxyl group, a cyano group, a sulfo group, a nitro group, and an amino group. Exemplified compounds:

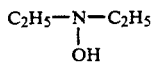

IV-1

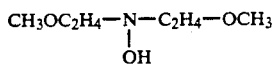

IV-2

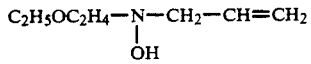

IV-3

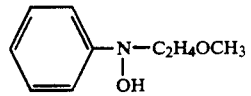

IV-4

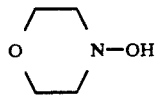

IV-5

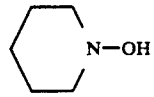

IV-6

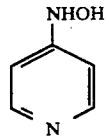

IV-7

-continued

IV-8

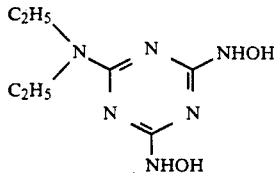

As hydrazines and hydrazides the following compounds are preferable:

Formula (V)

Formula (V)

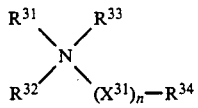

wherein $R^{31}$, $R^{32}$, and $R^{33}$ each independently represent a hydrogen atom, a substituted or unsubstituted alkyl group, a substituted or unsubstituted aryl group, or a substituted or unsubstituted heterocyclic group; $R^{34}$ represents a hydroxy group, a hydroxyamino group, a substituted or unsubstituted alkyl group, a substituted or unsubstituted heterocyclic group, a substituted or unsubstituted alkoxy group, a substituted or unsubstituted aryloxy group, a substituted or unsubstituted carbamoyl group, or a substituted or unsubstituted amino group. The heterocyclic group is a 5- or 6-membered ring made up of C, H, O, N, S, and/or a halogen atom, and it may be substituted or unsubstituted. $X^{31}$ represents a divalent group selected from —CO—, —$SO_2$—, and

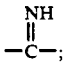

n is 0 or 1, provided that when n=0, $R^{34}$ represents a group selected from an alkyl group, an aryl group, or a heterocyclic group. $R^{33}$ and $R^{34}$ may together form a heterocyclic ring.

In formula (V), $R^{31}$, $R^{32}$, and $R^{33}$ each are preferably a hydrogen atom or an alkyl group having 1 to 10 carbon atoms, particularly $R^{31}$ and $R^{32}$ each are most preferably a hydrogen atom.

In formula (V) , $R^{34}$ is preferably an alkyl group having 1 to 20 carbon atoms, an aryl group having 6 to 20 carbon atoms, an alkoxy group having 1 to 20 carbon atoms, a carbamoyl group having 1 to 20 carbon atoms, or an amino group having 0 to 20 carbon atoms, in particular preferably an alkyl group or a substituted alkyl group. The preferable substituents of an alkyl group include a carboxyl group, a sulfo group, a nitro group, an amino group, and a phosphono group. $X^{31}$ is preferably —CO— or —$SO_2$—, most preferably —CO—.

Exemplified compound:

V-1

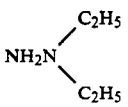

V-2 $NH_2NH(CH_2)_4SO_3H$

V-3 $NH_2NH(CH_2)_2OH$

-continued

Exemplified compound:

V-4

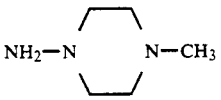

V-5

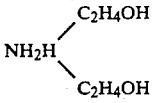

V-6 $NH_2NHCOCH_3$

V-7 $NH_2NHCOOC_2H_5$

V-8

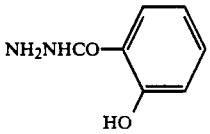

V-9

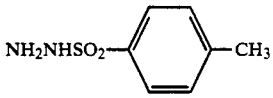

V-10 $NH_2NHCONH_2$

V-11

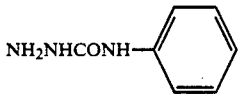

V-12 $NH_2NHSO_3H$

V-13

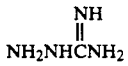

V-14 $NH_2NHCOCONHNH_2$

V-15 $NH_2NHCH_2CH_2CH_2SO_3H$

V-16

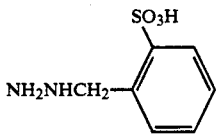

V-17

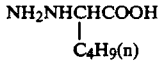

V-18 $NH_2NHCH_2CH_2COOH$

V-19

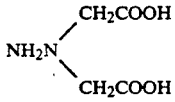

V-20

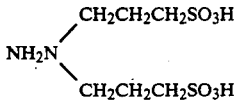

V-21

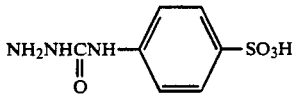

-continued

Exemplified compound:

V-22

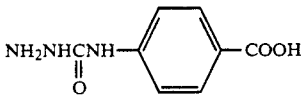

It is preferable to use the compound represented by formula (IV) or (V) in combination with the compound represented by the following formula (VI) or (VII), in view of hither stability of the color developer, that is, higher stability during continuous processing.

Formula (VI)

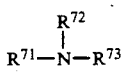

wherein $R^{71}$, $R^{72}$, and $R^{73}$ each represent a hydrogen atom, an alkyl group, an alkenyl group, an aryl group, an aralkyl group or a heterocyclic group, and $R^{71}$ and $R^{72}$, $R^{71}$ and $R^{73}$, or $R^{72}$ and $R^{73}$ may bond together to form a nitrogen-containing heterocyclic group.

$R^{71}$, $R^{72}$, and $R^{73}$ may have a substituent. Particularly preferably $R^{71}$, $R^{72}$, and $R^{73}$ each represent a hydrogen atom or an alkyl group. As a substituent can be mentioned, for example, a hydroxyl group, a sulfo group, a carboxyl group, a halogen atom, a nitro group, and an amino group.

Exemplified compounds:

VI-1 $N(CH_2CH_2OH)_3$

VI-2 $H_2NCH_2CH_2OH$

VI-3 $HN(CH_2CH_2OH)_2$

VI-4 $C_7H_{15}N(CH_2\overset{OH}{\overset{|}{C}}HCH_2OH)_2$

VI-5

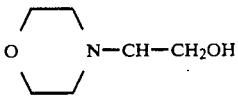

VI-6

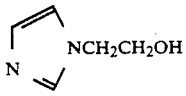

VI-7

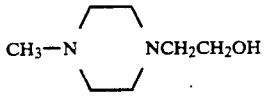

VI-8

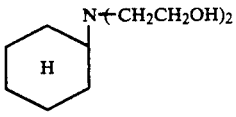

VI-9

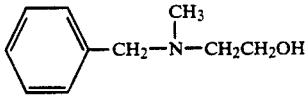

VI-10 $(HOCH_2CH_2)_2NCH_2CH_2SO_2CH_3$

VI-11 $HN(CH_2COOH)_2$

-continued

Exemplified compounds:

VI-12 $HOOCCH_2CH_2\underset{\underset{NH_2}{|}}{C}HCOOH$

VI-13 $H_2NCH_2CH_2SO_2NH_2$

VI-14 $(C_2H_5)_2N-CH_2CH_2OCH_2CH_2OH$

VI-15 $H_2N-C(CH_2OH)_2$

VI-16 $HOCH_2\underset{\underset{NH_2}{|}}{C}HCOOH$

VI-17

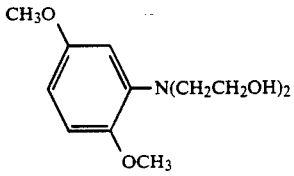

VI-18

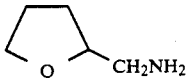

Formula (VII)

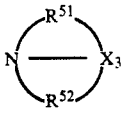

wherein $X_3$ represents a trivalent group of atoms necessary to complete a condensed ring, and $R^{51}$ and $R^{52}$ each represent an alkylene group, an arylene group, an alkenylene group, or an aralkylene group.

$R^{51}$ and $R^{52}$ may be the same or different.

Of the compounds represented by formula (VII), particularly preferable compounds are those represented by formulas (VII-a) and (VII-b):

Formula (VII-a)

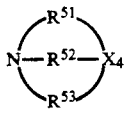

wherein $X_4$ represents

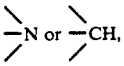

$R^{51}$ and $R^{52}$ have the same meaning as defined above for formula (VII), and $R^{53}$ has the same meaning as $R^{51}$ or $R^{52}$ or represents $-\overset{\overset{O}{\|}}{C}HC-$.

In formula (VII-a), preferably $X^4$ represents

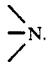

Preferably the number of carbon atoms of $R^{51}$, $R^{52}$, and $R^{53}$ is 6 or below, more preferably 3 or below, and most preferably 2.

Preferably $R^{51}$, $R^{52}$, and $R^{53}$ each represent an alkylene group or an arylene group, most preferably an alkylene group.

Formula (VII-b)

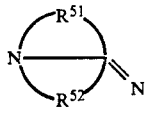

wherein $R^{51}$ and $R^{52}$ have the same meaning as defined in formula (VII).

In formula (VII-b), preferably the number of carbon atoms of $R^{51}$ and $R^{52}$ is 6 or below. Preferably $R^{51}$ and $R^{52}$ each represent an alkylene group or an arylene group, most preferably an alkylene group.

Of compounds represented by formulae (VII-a) and (V-b), those represented by formula (VII-a) are preferable.

VII-1

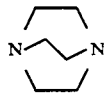

VII-2

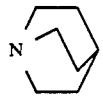

VII-3

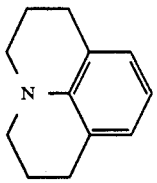

VII-4

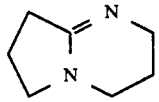

VII-5

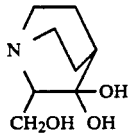

VII-6

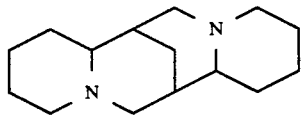

-continued

VII-7

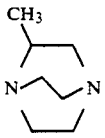

VII-8

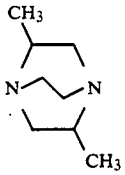

VII-9

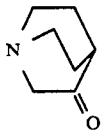

VII-10

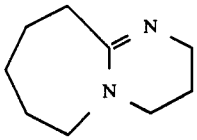

VII-11

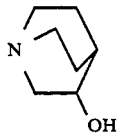

VII-12

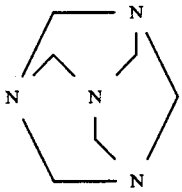

VII-13

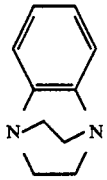

VII-14

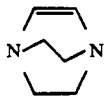

VII-15

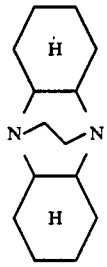

-continued

VII-16

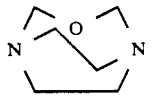

VII-17

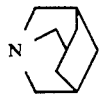

VII-18

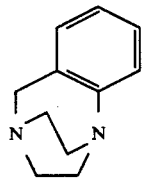

The above-mentioned organic preservatives can be commercially available, but they can also be synthesized by method described, for example, in JP-A Nos. 170642/1988 and 239447/1988.

In the above-described formulas (IV) to (VII), except the case particularly denoted, the number of carbon atoms of the aliphatic substituents (e.g., an alkyl or an alkenyl) or the groups containing them is preferably 1 to 10, more preferably 1 to 6, and the number of carbon atoms of the aromatic substituents (e.g., an aryl) or the group containing them is preferably 1 to 8, more preferably 1 to 5.

It is preferable that the color developer used in the present invention contains a brightening agent. As a brightening agent, 4,4'-diamino-2,2'-disulfostilbene compounds are preferable. The amount of brightening agent to be added is 0 to 10 g/l, and preferably 0.1 to 6 g/l.

If necessary, various surface-active agents, such as alkyl sulfonates, aryl sulfonates, aliphatic acids, and aromatic carboxylic acids, dye-forming couplers, competitive couplers, fogging agents such as sodium boronhydride, auxiliary developing agents such as 1-phenyl-3-pyrazolydone, and tackifiers may be added.

The processing temperature of the color developer of the invention is 20° to 50° C., and preferably 30° to 40° C. The processing time is 20 sec to 5 min, and preferably 30 sec to 2 min.

In the color developing, the developer is usually replenished. The replenishing amount is generally in the range of about 180 to 1000 ml per square meter of the photographic material, although it is depending on the photographic material to be processed. Replenishing is a mean to keep the constituent of color developer to be constant in order to avoid the change of finishing characteristics due to the change of constituent concentration in a development processing, such as a continuous processing for a large amount of photographic materials, for example, using an automatic processor, but is is preferable that the amount is as small as possible, in view of economy and pollution, because of a large amount of overflowed solution by replenishing. The preferable replenishing amount is 20 to 150 ml per square meter of the photographic material. The replenishing amount of 20 ml per square meter of the photographic material means that the carried-over amount of developer by the photographic material is almost equal to the replenishing amount, although the amount differs a little depending on the photographic material. The effect of the present invention can be attained at the processing carried out in such a low replenishing amount.

In the present invention, a desilvering process is carried out following a color-developing process. The desilvering process consists usually of a bleaching process and a fixing process, but it is particularly preferable to carried out the two process at the same time.

Further, the bleaching solution or the bleach-fixing solution used in the present invention can contain rehalogenizing agents, such as bromides (e.g., potassium bromide, sodium bromide, and ammonium bromide), chlorides (e.g., potassium chloride, sodium chloride, and ammonium chloride), or iodides (e.g., ammonium iodide). If necessary the bleaching solution or the bleach-fixing solution can contained, for example, one or more inorganic acids and organic acids or their alkali salts or ammonium salts having a pH-buffering function, such as borax, sodium metaborate, acetic acid, sodium acetate, sodium carbonate, potassium carbonate, phosphorous acid, phosphoric acid, sodium phosphate, citric acid, sodium citrate, and tartaric acid, and ammonium nitrate, and guanidine as a corrosion inhibitor.

The fixing agent used in the bleach-fixing solution or the bleaching solution according to the present invention can use one or more of water-soluble silver halide solvents, for example thiosulfates, such as sodium thiosulfate and ammonium thiosulfate, thiocyanates, such as sodium thiocyanate and ammonium thiocyanate, thiourea compounds and thioether compounds, such as ethylenebisthioglycolic acid and 3,6-dithia-1,8-octanedithiol. For example, a special bleach-fixing solution comprising a combination of a fixing agent described in JP-A No. 155354/1980 and a large amount of a halide, such as potassium iodide, can be used. In the present invention, it is preferable to use thiosulfates, and particularly ammonium thiosulfate. The amount of the fixing agent per liter is preferably 0.3 to 2 mol, and more preferably 0.5 to 1.0 mol.

The pH range of the bleach-fixing solution or the fixing solution is preferably 3 to 10, and particularly preferably 5 to 9. If the pH is lower than this range, the desilvering is improved, but the deterioration of the solution and the leucolization of cyan dye are accelerated. In reverse, if the pH is higher than this range, the desilvering is retarded and stain is liable to occur.

To adjust pH, if necessary, a compound such as hydrochloric acid, sulfuric acid, nitric acid, acetic acid, bicarbonate, ammonia, caustic potassium, caustic soda, sodium carbonate and potassium carbonate may be added.

Further, the bleach-fixing solution may additionally contain various brightening agents, anti-foaming agents, surface-active agents, polyvinyl pyrrolidone, and organic solvents, such as methanol.

The bleach-fixing solution or the fixing solution used in the present invention contains, as a preservative, sulfites (e.g., sodium sulfite, potassium sulfite, and ammonium sulfite), bisulfites (e.g., ammonium bisulfite, sodium bisulfite, and potassium bisulfite), and methabisulfites (e.g., potassium metabisulfite, sodium metabisulfite, and ammonium metabisulfite). Preferably these compounds are contained in an amount of 0.02 to 0.50 mol/l, and more preferably 0.04 to 0.40 mol/l, in terms of sulfite ions.

As a preservative, generally a bisulfite is added, but other compounds, such as ascorbic acid, carbonyl bisulfite addition compound, or carbonyl compounds, may be added.

If required, for example, buffers, brightening agents, chelate agents, anti-foaming agents, and mildew-proofing agents may be added.

The silver halide color photographic material used in the present invention is generally washed and/or stabilized after the fixing or the desilvering, such as the bleach-fixing.

The amount of washing water in the washing step can be set over a wide range, depending on the characteristics of the photographic material (e.g., the characteristics of the materials used, such as couplers), the application of the photographic material, the washing water temperature, the number of the washing water tanks (stages), the type of replenishing (i.e., depending on whether the replenishing is of the countercurrent type or of the down flow type), and other various conditions. The relationship between the number of washing water tanks and the amount of water in the multi-stage countercurrent system can be determined based on the method described in *Journal of the Society of Motion Picture and Television* Engineers, Vol. 64, pp. 248 to 253 (May 1955). Generally, the number of stages in a multi-stage countercurrent system is preferably 2 to 6, and particularly preferably 2 to 4.

According to the multi-stage countercurrent system, the amount of washing water can be reduced considerably. But a problem arises that bacteria can propagate due to the increase in the residence time of the water in the tanks, and the suspended matter produced will adhere to the photographic material. To solve such a problem in processing the color photographic material of the present invention, the process for reducing calcium and magnesium described in JP-A No. 131632/1986 can be used quite effectively. Further, isothiazolone compounds and thiabendazoles described in JP-A No. 8542/1982, chlorine-type bactericides, such as sodium chlorinated isocyanurates described in JP-A No. 120145/1986, benzotriazoles described in JP-A No. 267761/1986, copper ions, and bactericides described by Hiroshi Horiguch in *Bokin Bobai-zai no Kagaku, Biseibutsu no Genkin, Sakkin, Bobai Gijutsu* (edited by Eiseigijutsu-kai), and *Bokin Bobai-zai Jiten* (edited by Nihon Bokin Bobai-gakkai), can be used.

The pH range of the washing water in the processing steps for the photographic material of the present invention may be 4 to 9, preferably 5 to 8. The temperature and time of washing, which can be set according to the use or property of the photographic material, is generally in the range 15° to 45° C. and 20 sec. to 10 min, preferably 25° to 40° C. and 30 sec to 5 min.

Further, the photographic materials of the present invention can be processed directly by a stabilizing solution without a washing step. In such a stabilizing process, all known methods described, for example, in JP-A Nos. 8543/1982, 14834/1983, 184343/1984, 220345/1985, 238832/1985, 239784/1985, 239749/1985, 4045/1986, and 118749/1986 can be used. A preferred inclusion is to use a stabilizing bath containing 1-hydroxyethylidene-1,1-diphosphonate, 5-chloro-2-methyl-4-isothiazolone-3-one, a bismuth compound, or an ammonium compound.

In some cases a stabilizing process is carried out following the above-described washing process, and an example of such cases is a stabilizing bath containing formalin and a surface-active agent for use as a final bath for color photographic materials for photographing.

The time of processing process of the present invention is defined as the period from when the photographic material contacts the color developer to when it comes out of the last bath (generally, washing bath or stabilizing bath), and the effect of the present invention can be remarkably exhibited in such a rapid processing that the processing time is 4 min 30 sec or below, preferably 4 min or below.

Now the present invention will be described in detail with reference to examples, but the invention is not limited to them.

EXAMPLE 1

A multilayer color photographic paper having layer-compositions described below was prepared by coating on a paper laminated on both sides with polyethylene. Coating solutions were prepared as follows:

Preparation of the first-layer coating solution

To a mixture of 19.1 g of yellow coupler (ExY), 4.4 g of image-dye stabilizer (Cpd-1) and 0.7 g of image-dye stabilizer (Cpd-7), 27.2 ml of ethyl acetate and 8.2 g of solvent (Solv-3) were added and dissolved. The resulting solution was dispersed and emulsified in 185 ml of 10% aqueous gelatin solution containing 8 ml of sodium dodecylbenzenesulfonate. Separately another emulsion was prepared by adding two kinds of blue-sensitive sensitizing dye, shown below, to a silver chlorobromide emulsion (cubic grains having 0.88 μm of grain size and 0.07 of deviation coefficient of grain size distribution, in which 0.2 mol % of silver bromide based on all the grains was localized at the surface of the grains) in such an amount that each sensitizing dye is $2.0\times10^{-4}$ mol per mol of silver, and then by sulfur-sensitizing. The thus-prepared emulsion was mixed with and dissolved in the above-obtained emulsified dispersion to give the composition shown below, thereby preparing the first-layer coating solution. Coating solutions for the second to seventh layers were also prepared in the same manner as in the first-layer coating solution. As a gelatin hardener for the respective layers, 1-hydroxy-3,5-dichloro-s-triazine sodium salt was used.

As spectral-sensitizing dyes for the respective layers, the following compounds were used:

Blue-sensitive emulsion layer:

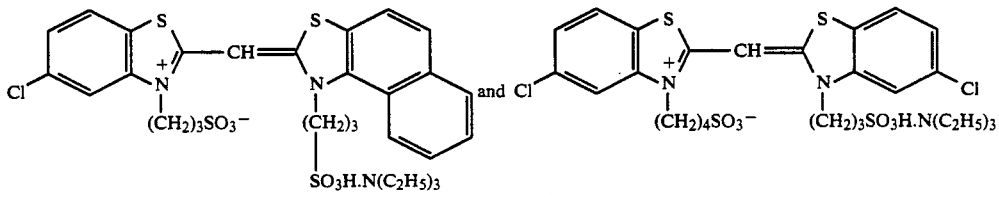

(The above two dyes were added each in an amount of $2.0\times10^{-4}$ mol per mol of silver halide.)

-continued

Green-sensitive emulsion layer:

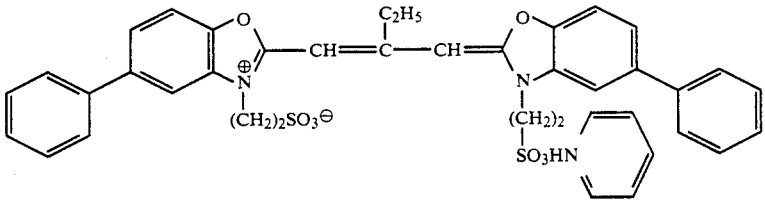

($4.0 \times 10^{-4}$ mol per mol of silver halide)

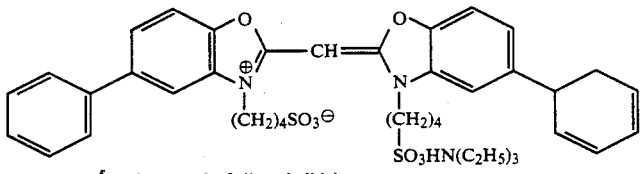

($7.0 \times 10^{-5}$ mol per mol of silver halide)

Red-sensitive emulsion layer:

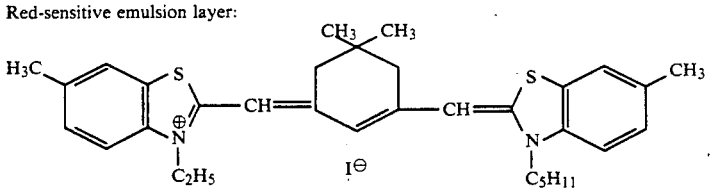

($0.9 \times 10^{-4}$ mol per mol of silver halide)

To the red-sensitive emulsion layer, the following compound was added in an amount of $2.6 \times 10^{-3}$ mol per mol of silver halide.

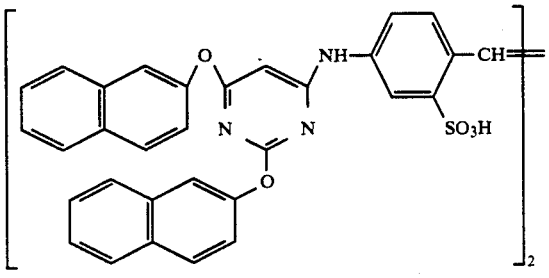

Further, 1-(5-methylureidophenyl)-5-mercaptotetrazole was added to the blue-sensitive emulsion layer, the green-sensitive emulsion layer, and the red-sensitive emulsion layer in amounts of $8.5 \times 10^{-5}$ mol, $7.7 \times 10^{-4}$ mol, and $2.5 \times 10^{-4}$ mol per mol of silver halide, respectively.

The following dyes were added to the emulsion layers to prevent irradiation.

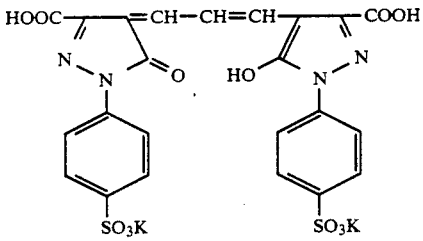

and

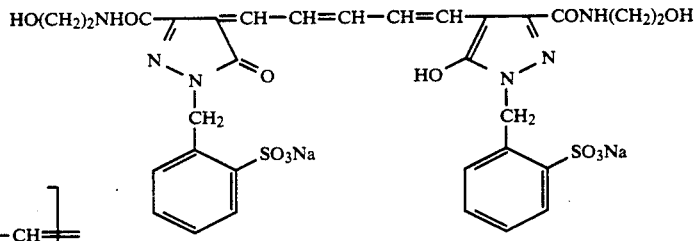

(Compositions of Layers)

The composition of each layer is shown below. The figures represent coating amounts (g/m$^2$). The coating amounts of each silver halide emulsion is represented in terms of silver.

| | |
|---|---|
| Base | |
| Paper laminated on both sides with polyethylene (a white pigment, $TiO_2$, and a bluish dye, ultramarine, were included in the first-layer side of the polyethylene-film laminated.) | |
| First Layer: Blue-sensitive emulsion layer | |
| The above-described silver chlorobromide emulsion | 0.30 |
| Gelatin | 1.86 |
| Yellow coupler (ExY) | 0.82 |
| Image-dye stabilizer (Cpd-1) | 0.19 |
| Solvent (Solv-3) | 0.35 |
| Image-dye stabilizer (Cpd-7) | 0.06 |
| Second Layer: Color-mix preventing layer | |
| Gelatin | 0.99 |
| Color mix inhibitor (Cpd-5) | 0.08 |
| Solvent (Solv-1) | 0.16 |
| Solvent (Solv-4) | 0.08 |
| Third Layer: Green-sensitive emulsion layer | |
| Silver chlorobromide emulsion (a mixture of two kinds of cubic grains having 0.55 μm and 0.39 μm of average grain sizes, and 0.10 and 0.08 of deviation coefficients of grain size distribution, respectively, in Ag molar ratio of 1:3, in which each 0.8 mol % of AgBr based on all the grains was localized on the grain surface) | 0.12 |
| Gelatin | 1.24 |
| Magenta coupler ((A-4)-12) | 0.27 |
| Image-dye stabilizer (Cpd-3) | 0.15 |
| Image-dye stabilizer (III-1) | 0.02 |
| Image dye stabilizer (I-31) | 0.03 |
| Solvent (Solv-2) | 0.54 |
| Fourth Layer: Ultraviolet absorbing layer | |
| Gelatin | 1.58 |
| UV absorber (UV-1) | 0.47 |
| Color mix inhibitor (Cpd-5) | 0.05 |
| Solvent (Solv-5) | 0.24 |
| Fifth Layer: Red-sensitive emulsion layer | |
| Silver chlorobromide emulsion (a mixture of two kinds of cubic grains having 0.58 μm and 0.45 μm of average grain sizes, and 0.09 and 0.11 of deviation coefficients of grain size distribution, respectively, in Ag molar ratio of 1:4, in which each 0.6 mol % of AgBr based on all the grains was localized on the grain surface) | 0.23 |
| Gelatin | 1.34 |
| Cyan coupler (ExC) | 0.32 |
| Image-dye stabilizer (Cpd-6) | 0.17 |
| Image-dye stabilizer (Cpd-10) | 0.04 |
| Image-dye stabilizer (Cpd-7) | 0.40 |
| Solvent (Solv-6) | 0.15 |
| Sixth Layer: Ultraviolet absorbing layer | |
| Gelatin | 0.53 |
| UV absorber (UV-1) | 0.16 |
| Color-mix inhibitor (Cpd-5) | 0.02 |
| Solvent (Solv-5) | 0.08 |
| Seventh Layer: Protective layer | |
| Gelatin | 1.33 |
| Acryl-modified copolymer of polyvinyl alcohol (Modification degree: 17%) | 0.17 |
| Liquid paraffin | 0.03 |

Compounds used are as follows:

(ExY) Yellow coupler

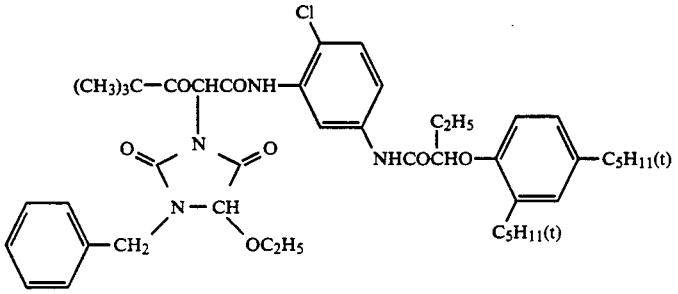

(ExC) Cyan coupler (mixture of 2:4:4 in weight ratio)

-continued
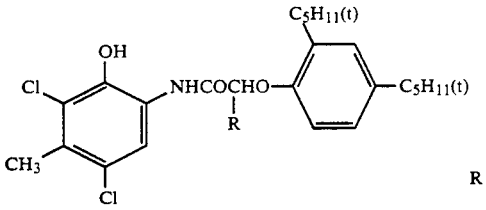
R = $C_2H_5$, $C_4H_9$
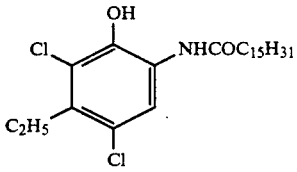
(Cpd-1) Image-dye stabilizer
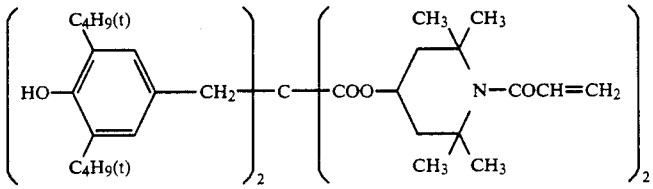
(Cpd-3) Image-dye stabilizer
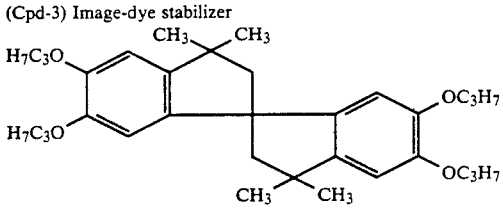
(Cpd-5) Color-mix inhibitor
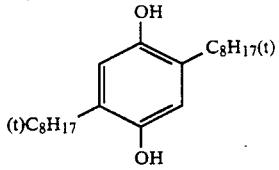
(Cpd-6) Image-dye stabilizer (mixture of 2:4:4 in weight ratio)
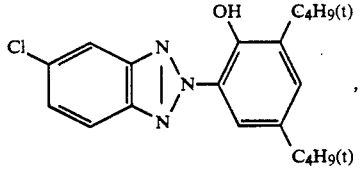
,
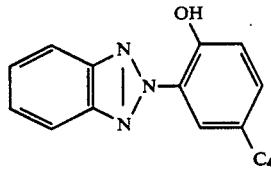
, and
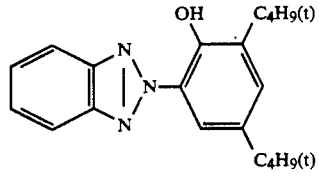
(Cpd-7) Image-dye stabilizer -continued
$$\left(CH_2-\underset{\underset{CONHC_4H_9(t)}{|}}{CH}\right)_n$$
(average molecular weight: 60,000)
(Cpd-10) Image-dye stabilizer
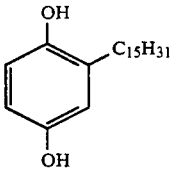
(UV-1) UV absorber (mixture of 4:2:4 in weight ratio)
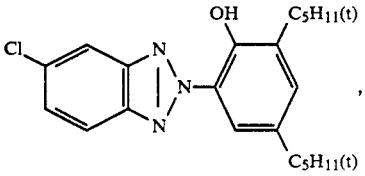
,
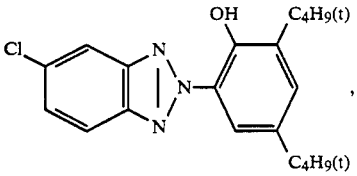
, and
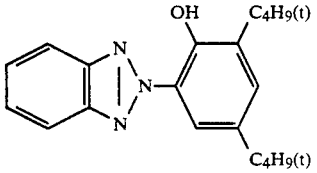
(Solv-1) Solvent
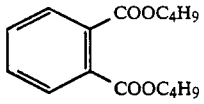
(Solv-2) Solvent (mixture of 2:1 in volume ratio)
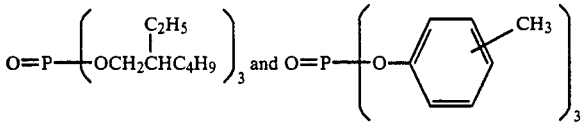
(Solv-3) Solvent
$O{=}P\left(OC_9H_{19}(iso)\right)_3$
(Solv-4) Solvent
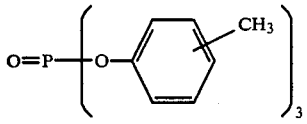
(Solv-5) Solvent
$$\begin{array}{l} COOC_8H_{17} \\ | \\ (CH_2)_8 \\ | \\ COOC_8H_{17} \end{array}$$
(Solv-6) Solvent -continued

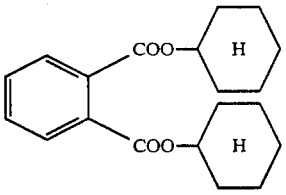

The thus-prepared sample is designated Sample No. 01.

Samples 02 to 05 were prepared in the same manner as Sample 01, except that the halogen compositions of the silver halide emulsion in the first, third, and fifth layer were changed as shown in Table 1, respectively.

TABLE 1

| Sample | Halogen composition in emulsion (Cl mol %) | | |
|---|---|---|---|
| | 1st layer (BL) | 3rd layer (GL) | 5th layer (RL) |
| 01 | 99.8 | 99.2 | 99.4 |
| 02 | 90.0 | 90.0 | 90.0 |
| 03 | 80.0 | 90.0 | 80.0 |
| 04 | 70.0 | 70.0 | 70.0 |
| 05 | 60.0 | 70.0 | 60.0 |

Next, samples were prepared in the same manner as the above using the same halogen composition in the emulsion as in Table 1, except that the magenta coupler in the third layer were changed to equimolecular amount of couplers of the present invention. These samples are designated Samples 06 to 20. Couplers used are shown in Table 2.

Further, for comparison, samples were prepared by changing the magenta coupler to an equimoleqular amount of a coupler described below in the same manner as the above. These are designated Samples 21 to 25.

Comparative magenta coupler

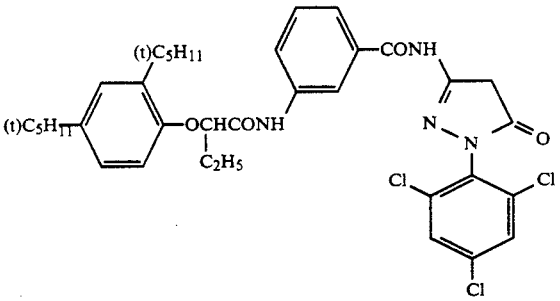

To evaluate the photographic properties of these Samples 01 to 25, the following experiments were performed.

First, each of samples was subjected to a gradation exposure to three separated colors for sensitometry using a sensitometer (FMH model made by Fuji Photo Film Co., Ltd., the color temperature of light source was 3200° K.). At that time, the exposure was carried out in such a manner that the exposure was 250 CMS with the exposure time being 0.1 sec.

After exposure to light, each sample was subjected to the processing as described below using the processing solutions of composition described below by an automatic processor. Concentrations of chloride ions and bromide ions in the color developer for processing were changed as shown in Table 2.

| Processing step | Temperature | Time |
|---|---|---|
| Color Development | 38° C. | 45 sec. |
| Bleach-fixing | 30–36° C. | 45 sec. |
| Water Washing (1) | 30–37° C. | 30 sec. |
| Water Washing (2) | 30–37° C. | 30 sec. |
| Water Washing (3) | 30–37° C. | 30 sec. |
| Drying | 70–80° C. | 60 sec. |

The composition of the respective processing solution were as follows:

| | |
|---|---|
| Color developer | |
| Water | 800 ml |
| Ethylene-N,N,N',N'-tetramethylene phophonic acid | 3.0 g |
| Organic preservative (VI-1) | 10 g |
| Sodium chloride | see Table 2 |
| Potassium bromide | see Table 2 |
| Potassium carbonate | 25 g |
| N-Ethyl-N-(β-methanesulfonamidoethyl)-3-methyl-4-aminoaniline sulfate | 5.0 g |
| Organic preservative (V-1) | 0.03 mol |
| Fluorescent brightening agent WHITEX-4, made by Sumitomo Chemical Industries | 2.0 g |
| Water to make | 1000 ml |
| pH (25° C.) | 10.05 |
| Bleach-fixing solution | |
| Water | 700 ml |
| Ammonium thiosulfate (70%) | 100 ml |
| Sodium sulfite | 17 g |
| Iron (III) ammonium ethylenediamine-tetraacetate dihydrate | 55 g |
| Disodium ethylenediaminetetraacetate | 5 g |
| Ammonium bromide | 40 g |
| Glacial acetic acid | 9 g |
| Water to make | 1000 ml |
| pH (25° C.) | 5.4 |
| Water washing solution | |
| Tap water treated by ion-exchange resins until each content of calsium and magnesium was 3 ppm or below (electric conductivity at 25° C. was 5 μs/cm) | |

Determination of image-dye density obtained by processing was carried out to obtain the value of photographic properties. Results are shown in Table 2.

Separately Samples 01 to 25 were also subjected to a uniform exposure of gray of 0.5 by using the above-described sensitometer, and were processed in the same manner as the above sensitometry, then the pressure-sensitized streaks were evaluated. Results are shown in Table 2. The evaluation was graded into the following four classes:

| Evaluation of pressure-sensitized streaks | Number of pressure-sensitized streaks per 100 $cm^2$ (10 cm × 10 cm) of sample |
|---|---|
| ○ | nil |
| Δ | 1 to 2 |

-continued

| Evaluation of pressure-sensitized streaks | Number of pressure-sensitized streaks per 100 $cm^2$ (10 cm × 10 cm) of sample |
|---|---|
| X | 3 to 4 |
| XX | 5 or over |

TABLE 2

| Processing Process | Sample | Coupler used | Halide Ion Concentration in Developer (mol/l) Chloride Ion | Bromide Ion | Photographic Performance (GL) Dmin | Dmax | Pressure-sensitized Streaks | Remarks |
|---|---|---|---|---|---|---|---|---|
| 1 | 01 | (A-4)-12 | $3.5 \times 10^{-2}$ | $3 \times 10^{-5}$ | 0.09 | 2.85 | ○ | This Invention |
| 2 | " | " | $4.0 \times 10^{-2}$ | $5 \times 10^{-5}$ | 0.09 | 2.85 | ○ | This Invention |
| 3 | " | " | $1.0 \times 10^{-1}$ | $5 \times 10^{-4}$ | 0.08 | 2.83 | ○ | This Invention |
| 4 | " | " | $1.5 \times 10^{-1}$ | $1 \times 10^{-3}$ | 0.08 | 2.83 | ○ | This Invention |
| 5 | " | " | $3.5 \times 10^{-2}$ | $1 \times 10^{-3}$ | 0.08 | 2.83 | ○ | This Invention |
| 6 | " | " | $1.5 \times 10^{-1}$ | $3 \times 10^{-5}$ | 0.08 | 2.83 | ○ | This Invention |
| 7 | " | " | $4.0 \times 10^{2}$ | — | 0.09 | 2.85 | Δ | Comparative Example |
| 8 | " | " | — | $5 \times 10^{-5}$ | 0.10 | 2.85 | X | Comparative Example |
| 9 | " | " | $1.0 \times 10^{-1}$ | $5 \times 10^{-3}$ | 0.07 | 2.78 | ○ | Comparative Example |
| 10 | " | " | $3.0 \times 10^{-1}$ | $5 \times 10^{-4}$ | 0.07 | 2.73 | ○ | Comparative Example |
| 11 | " | " | — | — | 0.12 | 2.85 | X | Comparative Example |
| 12 | 02 | " | $4.0 \times 10^{-2}$ | $5 \times 10^{-5}$ | 0.09 | 2.84 | ○ | This Invention |
| 13 | 03 | " | " | " | 0.08 | 2.82 | ○ | This Invention |
| 14 | 04 | " | " | " | 0.07 | 2.75 | ○ | Comparative Example |
| 15 | 05 | " | " | " | 0.07 | 2.61 | ○ | Comparative Example |
| 1 | 06 | (A-4)-13 | $3.5 \times 10^{-2}$ | $3 \times 10^{-5}$ | 0.09 | 2.88 | ○ | This Invention |
| 2 | " | " | $4.0 \times 10^{-2}$ | $5 \times 10^{-5}$ | 0.09 | 2.88 | ○ | This Invention |
| 3 | " | " | $1.0 \times 10^{-1}$ | $5 \times 10^{-4}$ | 0.08 | 2.87 | ○ | This Invention |
| 4 | " | " | $1.5 \times 10^{-1}$ | $1 \times 10^{-3}$ | 0.08 | 2.86 | ○ | This Invention |
| 5 | " | " | $3.5 \times 10^{-2}$ | $1 \times 10^{-3}$ | 0.08 | 2.86 | ○ | This Invention |
| 6 | " | " | $1.5 \times 10^{-1}$ | $3 \times 10^{-5}$ | 0.08 | 2.86 | ○ | This Invention |
| 7 | " | " | $4.0 \times 10^{-2}$ | — | 0.09 | 2.88 | Δ | Comparative Example |
| 8 | " | " | — | $5 \times 10^{-5}$ | 0.10 | 2.88 | X | Comparative Example |
| 9 | " | " | $1.0 \times 10^{-1}$ | $5 \times 10^{-3}$ | 0.07 | 2.80 | ○ | Comparative Example |
| 10 | " | " | $3.0 \times 10^{-1}$ | $5 \times 10^{-4}$ | 0.07 | 2.76 | ○ | Comparative Example |
| 11 | " | " | — | — | 0.12 | 2.88 | X | Comparative Example |
| 12 | 07 | " | $4.0 \times 10^{-2}$ | $5 \times 10^{-5}$ | 0.09 | 2.86 | ○ | This Invention |
| 13 | 08 | " | " | " | 0.08 | 2.84 | ○ | This Invention |
| 14 | 09 | " | " | " | 0.07 | 2.78 | ○ | Comparative Example |
| 15 | 10 | " | " | " | 0.07 | 2.65 | ○ | Comparative Example |
| 1 | 11 | (A-4)-15 | $3.5 \times 10^{-2}$ | $3 \times 10^{-5}$ | 0.09 | 2.92 | ○ | This Invention |
| 2 | " | " | $4.0 \times 10^{-2}$ | $5 \times 10^{-5}$ | 0.09 | 2.92 | ○ | This Invention |
| 3 | " | " | $1.0 \times 10^{-1}$ | $5 \times 10^{-4}$ | 0.08 | 2.90 | ○ | This Invention |
| 4 | " | " | $1.5 \times 10^{-1}$ | $1 \times 10^{-3}$ | 0.08 | 2.90 | ○ | This Invention |
| 5 | " | " | $3.5 \times 10^{-2}$ | $1 \times 10^{-3}$ | 0.08 | 2.90 | ○ | This Invention |
| 6 | " | " | $1.5 \times 10^{-1}$ | $3 \times 10^{-5}$ | 0.08 | 2.90 | ○ | This Invention |
| 7 | " | " | $4.0 \times 10^{2}$ | — | 0.09 | 2.92 | Δ | Comparative Example |

TABLE 2-continued

| Processing Process | Sample | Coupler used | Halide Ion Concentration in Developer (mol/l) Chloride Ion | Bromide Ion | Photographic Performance (GL) Dmin | Dmax | Pressure-sensitized Streaks | Remarks |
|---|---|---|---|---|---|---|---|---|
| 8 | " | " | — | $5 \times 10^{-5}$ | 0.10 | 2.92 | X | Comparative Example |
| 9 | " | " | $1.0 \times 10^{-1}$ | $5 \times 10^{-3}$ | 0.07 | 2.85 | ○ | Comparative Example |
| 10 | " | " | $3.0 \times 10^{-1}$ | $5 \times 10^{-4}$ | 0.07 | 2.81 | ○ | Comparative Example |
| 11 | " | " | — | — | 0.13 | 2.92 | X | Comparative Example |
| 12 | 12 | " | $4.0 \times 10^{-2}$ | $5 \times 10^{-5}$ | 0.09 | 2.90 | ○ | This Invention |
| 13 | 13 | " | " | " | 0.08 | 2.88 | ○ | This Invention |
| 14 | 14 | " | " | " | 0.07 | 2.82 | ○ | Comparative Example |
| 15 | 15 | " | " | " | 0.07 | 2.73 | ○ | Comparative Example |
| 1 | 16 | (A-3)-5 | $3.5 \times 10^{-2}$ | $3 \times 10^{-5}$ | 0.09 | 2.71 | ○ | This Invention |
| 2 | " | " | $4.0 \times 10^{-2}$ | $5 \times 10^{-5}$ | 0.09 | 2.71 | ○ | This Invention |
| 3 | " | " | $1.0 \times 10^{-1}$ | $5 \times 10^{-4}$ | 0.08 | 2.69 | ○ | This Invention |
| 4 | " | " | $1.5 \times 10^{-1}$ | $1 \times 10^{-3}$ | 0.08 | 2.68 | ○ | This Invention |
| 5 | " | " | $3.5 \times 10^{-2}$ | $1 \times 10^{-3}$ | 0.08 | 2.69 | ○ | This Invention |
| 6 | " | " | $1.5 \times 10^{-1}$ | $3 \times 10^{-5}$ | 0.08 | 2.68 | ○ | This Invention |
| 7 | " | " | $4.0 \times 10^{2}$ | — | 0.09 | 2.71 | Δ | Comparative Example |
| 8 | " | " | — | $5 \times 10^{-5}$ | 0.10 | 2.71 | X | Comparative Example |
| 9 | " | " | $1.0 \times 10^{-1}$ | $5 \times 10^{-3}$ | 0.07 | 2.66 | ○ | Comparative Example |
| 10 | " | " | $3.0 \times 10^{-1}$ | $5 \times 10^{-4}$ | 0.07 | 2.61 | ○ | Comparative Example |
| 11 | " | " | — | — | 0.12 | 2.71 | X | Comparative Example |
| 12 | 17 | " | $4.0 \times 10^{-2}$ | $5 \times 10^{-5}$ | 0.09 | 2.70 | ○ | This Invention |
| 13 | 18 | " | " | " | 0.08 | 2.66 | ○ | This Invention |
| 14 | 19 | " | " | " | 0.07 | 2.55 | ○ | Comparative Example |
| 15 | 20 | " | " | " | 0.07 | 2.42 | ○ | Comparative Example |
| 1 | 21 | Comparative Coupler | $3.5 \times 10^{-2}$ | $3 \times 10^{-5}$ | 0.11 | 2.48 | Δ | Comparative Example |
| 2 | " | Comparative Coupler | $4.0 \times 10^{-2}$ | $5 \times 10^{-5}$ | 0.11 | 2.47 | ○ | Comparative Example |
| 3 | " | Comparative Coupler | $1.0 \times 10^{-1}$ | $5 \times 10^{-4}$ | 0.10 | 2.45 | ○ | Comparative Example |
| 4 | " | Comparative Coupler | $1.5 \times 10^{-1}$ | $1 \times 10^{-3}$ | 0.10 | 2.53 | ○ | Comparative Example |
| 5 | " | Comparative Coupler | $3.5 \times 10^{-2}$ | $1 \times 10^{-3}$ | 0.10 | 2.44 | Δ | Comparative Example |
| 6 | " | Comparative Coupler | $1.5 \times 10^{-1}$ | $3 \times 10^{-5}$ | 0.10 | 2.43 | ○ | Comparative Example |
| 7 | " | Comparative Coupler | $4.0 \times 10^{-2}$ | — | 0.10 | 2.48 | X | Comparative Example |
| 8 | " | Comparative Coupler | — | $5 \times 10^{-5}$ | 0.11 | 2.48 | XX | Comparative Example |
| 9 | " | Comparative Coupler | $1.0 \times 10^{-1}$ | $5 \times 10^{-3}$ | 0.09 | 2.26 | ○ | Comparative Example |
| 10 | " | Comparative Coupler | $3.0 \times 10^{-1}$ | $5 \times 10^{-4}$ | 0.09 | 2.30 | ○ | Comparative Example |
| 11 | " | Comparative Coupler | — | — | 0.15 | 2.48 | XX | Comparative Example |
| 12 | 22 | Comparative Coupler | $4.0 \times 10^{-2}$ | $5 \times 10^{-5}$ | 0.11 | 2.42 | ○ | Comparative Example |
| 13 | 23 | Comparative Coupler | " | " | 0.10 | 2.37 | ○ | Comparative Example |
| 14 | 24 | Comparative Coupler | " | " | 0.09 | 2.25 | ○ | Comparative Example |
| 15 | 25 | Comparative Coupler | " | " | 0.09 | 2.12 | ○ | Comparative Example |

As is apparent from the results in Table 2, Samples 01 to 20 using pyrazoloazole couplers of the present invention gave a high Dmax and a low Dmin, in comparison with Samples 21 to 25 using comparative couplers, with the processing steps being the same.

It can be understood that when processing processes 1 to 11, wherein the halide ion concentrations in the developer were varied, as compared, if the chloride ion concentration and/or the bromide ion concentration was low, a higher Dmax was obtained and the Dmin was increased, and in addition pressure-sensitized streaks were liable to occur. In contrast, when the chloride ion concentration and/or the bromide ion concentration were high, the occurrence of pressure-sensitized streaks was suppressed, but the Dmax became low in any of the couplers. When the fluctuation of the photographic performance (Dmax and Dmin) and the degree of occurrence of pressure-sensitized streaks are both taken into consideration, it can be understood from the table that the concentrations of halide ions in the developer should be such that the chloride ion concentration is $3.5\times10^{-2}$ to $1.5\times10^{-1}$ mol/l and the bromide ion concentration is $3.0\times10^{-5}$ to $1.0\times10^{-3}$ mol/l.

EXAMPLE 2

Samples were prepared in the same manner as in Example 1, except that the magenta couplers in the third layer (green sensitive layer) in Samples 01 to 05 were replaced by an equimolar amount of (A-3)-1, (A-3)-2, (A-3)-8, (A-3)-11, (A-4)-1, (A-4)-2, (A-4)-9, or (A-4)-16. These samples were exposed to light in the same manner as in Example 1 and processed by the processes 1 to 15, shown in Table 1, with the concentrations of chloride and bromide ions in the color developer varied, as shown in Table 2.

The photographic properties (Dmax and Dmin of the GL) and the pressure-sensitized streaks that resulted from these samples showed the same tendency as those of the results shown in Table 2, and it is understood that when the halide ions (chloride ions and bromide ions) concentration in the color developer was low, the Dmax was high, but the Dmin was also high, and pressure-sensitized streaks were liable to occure, but when the halide ions concentration was high, the Dmin lowered and pressure-sensitized streaks were not observed, but the Dmax lowered. Further, it was observed that when the silver chloride content of the silver halide emulsion to use was made lower, similarly there was a tendency that the Dmax lowered and the Dmin also lowered, which tendency was the same as that of results in Table 2 of Example 1.

EXAMPLE 3

Photographic material sample was prepared by changing the composition of third layer (the green-sensitive emulsion layer) of Sample 01 in Example 1 to the following composition.

| Third layer (Green-sensitive emulsion layer) | |
|---|---|
| Silver chlorobromide emulsion (the same silver chlorobromide emulsion as used in the third layer in Example 1) | 0.12 |

-continued

| Third layer (Green-sensitive emulsion layer) | |
|---|---|
| Magenta coupler ((A-4)-13) | 0.20 |
| Image dye stabilizer (Cpd-3, the same as in Example 1) | 0.15 |
| Solvent (Solv-2, the same as in Example 1) | 0.40 |
| Image dye stabilizer | see Table 3 |

Compositions of the other layers are the same as in Sample 01.

Samples were prepared by changing the composition based on that of this photographic material to various compounds represented by formulas (I), (II), and (III). The kinds and amounts of compounds used are shown in Table 4.

These samples were subjected to the same exposure to light as in Example 1 and a processing according to the following processing steps with the processing solutions having given below, by an automatic processor.

| Processing Steps | | |
|---|---|---|
| Step | Temperature | Time |
| Color Development | 38° C. | 45 sec. |
| Bleach-fixing | 30–36° C. | 45 sec. |
| Water Washing (1) | 30–37° C. | 30 sec. |
| Water Washing (2) | 30–37° C. | 30 sec. |
| Water Washing (3) | 30–37° C. | 30 sec. |
| Drying | 70–80° C. | 60 sec. |

| | |
|---|---|
| Color developer | |
| Water | 800 ml |
| Ethylenediamine-N,N,N',N'-tetramethylene phosphonic acid | 3.0 g |
| Organic preservative (VI-1) | 10 g |
| Sodium chloride | 5 g |
| Potassium bromide | 0.05 g |
| N-Ethyl-N-(β-methanesulfonamidoethyl)-3-methyl-4-aminoaniline sulfate | 5.0 g |
| Organic preservative (V-19) | 0.03 mol |
| Fluorescent brightening agent WHITEX-4, made by Sumitomo Chemical Industries | 3.0 g |
| Water to make | 1000 ml |
| pH (25° C.) | 10.05 |
| Bleach-fixing solution | |
| Water | 700 ml |
| Ammonium thiosulfate (70%) | 100 ml |
| Sodium sulfite | 17 g |
| Iron (III) ammonium ethylenediamine-tetraacetate dihydrate | 55 g |
| Disodium ethylenediaminetetraacetate | 5 g |
| Ammonium bromide | 40 g |
| Glacial acetic acid | 9 g |
| Water to make | 1000 ml |
| pH (25° C.) | 5.40 |
| Water washing solution | |
| Tap water treated by ion-exchange resins until each content of calsium and magnesium was 3 ppm or below | |

Each density of the image dye obtained by the above processing was measured to determine the photographic properties. Dmax's of each BL, GL, and RL layer. Results are shown in Table 3.

Next, the thus-processed samples were stored under conditions of 60° C. and 70% RH, and then the density of uncolored part of blue light was meassured to determine the difference ($\Delta D_B$) of densities of blue-light for the uncolored part between before and after the test. Results are also shown in Table 3.

TABLE 3-1

| Sample | Layer and Amount added Compound represented by Formula (I), (II), or (III)[1] 1st Layer (BL) | 2nd Layer | 3rd Layer (GL) | 4th Layer | 5th Layer (RL) | 6th Layer | Photographic Performance (Dmax)[2] BL | GL | RL | Stain[3] ($\Delta D_B$) | Remarks |
|---|---|---|---|---|---|---|---|---|---|---|---|
| 31 | — | — | — | — | — | — | 0.00 | 0.00 | 0.00 | +0.05 | Comparative Example |
| 32 | — | — | I-28, $2 \times 10^{-3}$ | — | — | — | 0.00 | 0.00 | 0.00 | +0.05 | This Invention |
| 33 | — | — | I-28, $5 \times 10^{-3}$ | — | — | — | 0.00 | 0.00 | 0.00 | +0.04 | " |
| 34 | — | — | I-28, $1 \times 10^{-2}$ | — | — | — | 0.00 | 0.00 | 0.00 | +0.04 | " |
| 35 | — | — | I-28, $1 \times 10^{-1}$ | — | — | — | 0.00 | −0.05 | 0.00 | +0.03 | " |
| 36 | — | — | I-28, 2 | — | — | — | 0.00 | −0.18 | 0.00 | +0.01 | " |
| 37 | — | — | I-28, 5 | — | — | — | 0.00 | −0.27 | 0.00 | +0.01 | " |
| 38 | — | — | I-28, 10 | — | — | — | 0.00 | −0.32 | 0.00 | +0.01 | " |
| 39 | — | — | III-3, $2 \times 10^{-3}$ | — | — | — | 0.00 | 0.00 | 0.00 | +0.05 | " |
| 40 | — | — | III-3, $5 \times 10^{-3}$ | — | — | — | 0.00 | 0.00 | 0.00 | +0.04 | " |
| 41 | — | — | III-3, $1 \times 10^{-2}$ | — | — | — | 0.00 | 0.00 | 0.00 | +0.04 | " |
| 42 | — | — | III-3, $1 \times 10^{-1}$ | — | — | — | 0.00 | −0.03 | 0.00 | +0.03 | " |
| 43 | — | — | III-3, 2 | — | — | — | 0.00 | −0.14 | 0.00 | +0.01 | " |
| 44 | — | — | III-3, 5 | — | — | — | 0.00 | −0.22 | 0.00 | +0.01 | " |
| 45 | — | — | III-3, 10 | — | — | — | 0.00 | −0.26 | 0.00 | +0.01 | " |

TABLE 3-2

| Sample | Layer and Amount added Compound represented by Formula (I), (II), or (III)[1] 1st Layer (BL) | 2nd Layer | 3rd Layer (GL) | 4th Layer | 5th Layer (RL) | 6th Layer |
|---|---|---|---|---|---|---|
| 46 | — | — | I-28, $1 \times 10^{-3}$<br>III-3, $1 \times 10^{-3}$ | — | — | — |
| 47 | — | — | I-28, $25 \times 10^{-3}$<br>III-3, $25 \times 10^{-3}$ | — | — | — |
| 48 | — | — | I-28, $5 \times 10^{-3}$<br>III-3, $5 \times 10^{-3}$ | — | — | — |
| 49 | — | — | $5 \times 10^{-2}$<br>$5 \times 10^{-2}$ | — | — | — |
| 50 | — | — | 1<br>1 | — | — | — |
| 51 | — | — | 2.5<br>2.5 | — | — | — |
| 52 | — | — | 5<br>5 | — | — | — |
| 53 | I-28, $5 \times 10^{-2}$<br>III-3, $5 \times 10^{-2}$ | — | — | — | — | — |
| 54 | — | — | — | — | I-28, $5 \times 10^{-2}$<br>III-3, $5 \times 10^{-2}$ | — |
| 55 | I-28, $5 \times 10^{-2}$<br>III-3, $5 \times 10^{-2}$ | — | I-28, $5 \times 10^{-2}$<br>III-3, $5 \times 10^{-2}$ | — | I-28, $5 \times 10^{-2}$<br>III-3, $5 \times 10^{-2}$ | — |
| 56 | — | — | — | I-28, $1 \times 10^{-4}$ | — | — |
| 57 | — | — | — | II-3, $1 \times 10^{-4}$ | — | — |
| 58 | — | — | — | I-28, $5 \times 10^{-5}$<br>III-3, $5 \times 10^{-5}$ | — | — |
| 59 | — | I-28, $5 \times 10^{-5}$<br>III-3, $1 \times 10^{-5}$ | — | I-28, $5 \times 10^{-5}$<br>III-3, $5 \times 10^{-5}$ | — | I-28, $5 \times 10^{-5}$<br>III-3, $5 \times 10^{-5}$ |
| 60 | I-28, $5 \times 10^{-2}$<br>III-3, $1 \times 10^{-1}$ | I-28, $5 \times 10^{-5}$<br>III-3, $1 \times 10^{-4}$ | I-28, $1 \times 10^{-1}$<br>III-3, $2 \times 10^{-2}$ | I-28, $5 \times 10^{-5}$<br>III-3, $1 \times 10^{-4}$ | I-28, $5 \times 10^{-2}$<br>II-3, $1 \times 10^{-1}$ | I-28, $5 \times 10^{-5}$<br>III-3, $1 \times 10^{-4}$ |

| Sample | Photographic Performance (Dmax)[2] BL | GL | RL | Stain[3] ($\Delta D_B$) | Remarks |
|---|---|---|---|---|---|
| 46 | 0.00 | 0.00 | 0.00 | +0.05 | This Invention |
| 47 | 0.00 | 0.00 | 0.00 | +0.04 | " |
| 48 | 0.00 | 0.00 | 0.00 | +0.04 | " |
| 49 | 0.00 | −0.03 | 0.00 | +0.02 | " |
| 50 | 0.00 | −0.15 | 0.00 | +0.01 | " |
| 51 | 0.00 | −0.23 | 0.00 | +0.01 | " |
| 52 | 0.00 | −0.27 | 0.00 | +0.01 | " |
| 53 | −0.05 | 0.00 | 0.00 | +0.03 | " |
| 54 | 0.00 | 0.00 | −0.02 | +0.04 | " |
| 55 | −0.05 | −0.03 | −0.02 | +0.02 | " |
| 56 | 0.00 | 0.00 | 0.00 | +0.04 | " |
| 57 | 0.00 | 0.00 | 0.00 | +0.04 | " |
| 58 | 0.00 | 0.00 | 0.00 | +0.04 | " |
| 59 | 0.00 | 0.00 | 0.00 | +0.03 | " |
| 60 | −0.07 | −0.05 | −0.04 | +0.01 | " |

TABLE 3-3

| Sample | Layer and Amount added Compound represented by Formula (I), (II), or (III)[1] 1st Layer (BL) | 2nd Layer | 3rd Layer (GL) | 4th Layer | 5th Layer (RL) | 6th Layer |
|---|---|---|---|---|---|---|
| 61 | I-48, $5 \times 10^{-2}$ | | I-48, $1 \times 10^{-1}$ | — | I-48, $5 \times 10^{-2}$ | — |

TABLE 3-3-continued

| | | | | | | |
|---|---|---|---|---|---|---|
| | III-21, $1 \times 10^{-1}$ | | III-21, $2 \times 10^{-1}$ | | III-21, $1 \times 10^{-1}$ | |
| 62 | — | I-48, $5 \times 10^{-5}$ III-21, $1 \times 10^{-4}$ | — | I-48, $5 \times 10^{-5}$ III-21, $1 \times 10^{-4}$ | — | I-48, $5 \times 10^{-5}$ III-21, $1 \times 10^{-4}$ |
| 63 | I-48, $5 \times 10^{-2}$ III-21, $1 \times 10^{-1}$ | I-48, $5 \times 10^{-5}$ III-21, $1 \times 10^{-4}$ | I-48, $1 \times 10^{-1}$ III-21, $2 \times 10^{-1}$ | I-48, $5 \times 10^{-5}$ III-21, $1 \times 10^{-4}$ | I-48, $5 \times 10^{-2}$ III-21, $1 \times 10^{-1}$ | I-48, $5 \times 10^{-5}$ III-21, $1 \times 10^{-4}$ |
| 64 | I-18, $5 \times 10^{-2}$ III-22, $1 \times 10^{-1}$ | — | I-18, $1 \times 10^{-1}$ III-22, $2 \times 10^{-1}$ | — | I-18, $5 \times 10^{-2}$ III-22, $1 \times 10^{-1}$ | — |
| 65 | — | I-18, $5 \times 10^{-5}$ III-22, $1 \times 10^{-4}$ | — | I-18, $5 \times 10^{-5}$ III-22, $1 \times 10^{-4}$ | — | I-18, $5 \times 10^{-5}$ III-22, $1 \times 10^{-4}$ |
| 66 | I-18, $5 \times 10^{-2}$ III-22, $1 \times 10^{-1}$ | I-18, $5 \times 10^{-5}$ III-22, $1 \times 10^{-4}$ | I-18, $1 \times 10^{-1}$ III-22, $2 \times 10^{-1}$ | I-18, $5 \times 10^{-5}$ III-22, $1 \times 10^{-4}$ | I-18, $5 \times 10^{-2}$ III-22, $1 \times 10^{-1}$ | I-18, $5 \times 10^{-5}$ III-22, $1 \times 10^{-4}$ |
| 67 | I-36, $5 \times 10^{-2}$ III-6, $1 \times 10^{-1}$ | — | I-36, $1 \times 10^{-1}$ III-6, $2 \times 10^{-1}$ | — | I-36, $5 \times 10^{-2}$ III-6, $1 \times 10^{-1}$ | — |
| 68 | — | I-36, $5 \times 10^{-5}$ III-6, $1 \times 10^{-4}$ | — | I-36, $5 \times 10^{-5}$ III-6, $1 \times 10^{-4}$ | — | I-36, $5 \times 10^{-5}$ III-6, $1 \times 10^{-4}$ |
| 69 | I-36, $5 \times 10^{-2}$ III-6, $1 \times 10^{-1}$ | I-36, $5 \times 10^{-5}$ III-6, $1 \times 10^{-4}$ | I-36, $1 \times 10^{-1}$ III-6, $2 \times 10^{-1}$ | I-36, $5 \times 10^{-5}$ III-6, $1 \times 10^{-4}$ | I-36, $5 \times 10^{-2}$ III-6, $1 \times 10^{-1}$ | I-36, $5 \times 10^{-5}$ III-6, $1 \times 10^{-4}$ |
| 70 | I-38, $5 \times 10^{-2}$ III-18, $1 \times 10^{-1}$ | — | I-38, $1 \times 10^{-1}$ III-18, $2 \times 10^{-1}$ | — | I-38, $5 \times 10^{-2}$ III-18, $1 \times 10^{-1}$ | — |
| 71 | — | II-38, $5 \times 10^{-5}$ III-18, $1 \times 10^{-4}$ | — | I-38, $5 \times 10^{-5}$ III-18, $1 \times 10^{-4}$ | — | I-38, $5 \times 10^{-5}$ III-18, $1 \times 10^{-4}$ |
| 72 | I-38, $5 \times 10^{-2}$ III-18, $1 \times 10^{-1}$ | I-38, $5 \times 10^{-5}$ III-18, $1 \times 10^{-4}$ | I-38, $1 \times 10^{-1}$ III-18, $2 \times 10^{-1}$ | I-38, $5 \times 10^{-5}$ III-18, $1 \times 10^{-4}$ | I-38, $5 \times 10^{-2}$ III-18, $1 \times 10^{-1}$ | I-38, $5 \times 10^{-5}$ III-18, $1 \times 10^{-4}$ |
| 73 | II-1, $5 \times 10^{-2}$ II-1, $1 \times 10^{1}$ | — | II-1, $1 \times 10^{-1}$ III-1, $2 \times 10^{-1}$ | — | II-1, $5 \times 10^{-2}$ III-1, $1 \times 10^{-1}$ | — |
| 74 | — | II-1, $5 \times 10^{-5}$ III-1, $1 \times 10^{-4}$ | — | II-1, $5 \times 10^{-5}$ III-1, $1 \times 10^{-4}$ | — | II-1, $5 \times 10^{-5}$ III-1, $1 \times 10^{-4}$ |
| 75 | II-1, $5 \times 10^{-2}$ III-1, $1 \times 10^{-1}$ | II-1, $5 \times 10^{-5}$ III-1, $1 \times 10^{-4}$ | II-1, $1 \times 10^{-1}$ III-1, $2 \times 10^{-1}$ | II-1, $5 \times 10^{-5}$ III-1, $1 \times 10^{-4}$ | II-1, $5 \times 10^{2}$ III-1, $1 \times 10^{1}$ | II-1, $5 \times 10^{-5}$ III-1, $1 \times 10^{-4}$ |

| | Photographic Performance (Dmax)[2] | | | | |
|---|---|---|---|---|---|
| Sample | BL | GL | RL | Stain[3] ($\Delta D_B$) | Remarks |
| 61 | −0.04 | −0.02 | −0.02 | +0.02 | This Invention |
| 62 | 0.00 | 0.00 | 0.00 | +0.03 | " |
| 63 | −0.05 | −0.04 | −0.03 | +0.01 | " |
| 64 | −0.05 | −0.02 | −0.02 | +0.02 | " |
| 65 | 0.00 | 0.00 | 0.00 | +0.03 | " |
| 66 | −0.06 | −0.03 | −0.03 | +0.01 | " |
| 67 | −0.04 | −0.03 | −0.02 | +0.02 | " |
| 68 | 0.00 | 0.00 | 0.00 | +0.03 | " |
| 69 | −0.05 | −0.04 | −0.03 | +0.01 | " |
| 70 | −0.04 | −0.03 | −0.02 | +0.02 | " |
| 71 | 0.00 | 0.00 | 0.00 | +0.03 | " |
| 72 | −0.05 | −0.04 | −0.02 | +0.01 | " |
| 73 | −0.08 | −0.06 | −0.05 | +0.03 | " |
| 74 | 0.00 | 0.00 | 0.00 | +0.04 | " |
| 75 | −0.10 | −0.08 | −0.08 | +0.02 | " |

Note in Table 3:
[1]Amount added: Added amount per mol of coupler for BL, GL, and RL, and Coating amount per square meter for the 2nd, 4th, and 6th layer.
[2]$D_{max}$: The figure is represented in a difference between values of each sample and the standard, which is $D_{max}$ in BL, GL, and RL of sample 31, respectively. The figure denoted with + means the increase of density and the figure denoted with − means the decrease of density.
[3]Stain ($\Delta D_B$): The figure is represented in a difference of densities of uncolored part of blue light between before and after the storage under conditions of 60 C. and 70% RH for 50 days. The figure denoted with + means the increase of stain and the figure denoted with − means the decrease of stain.

From the results of this test shown in Table 3, it can be understood that when the dye stabilizer of the present invention was used alone in the GL with the amount varied, the higher the added amount of the compounds represented by formula (I) or (II) was, the more the suppression of the increase in staining in the white background after the processing was. However, when the added amount of the compound (I-28) represented by formula (I) and the compound (III-3) represented by formula (III) was 2 mol or over per mol of the coupler, the stain-suppression reached a limit, without causing an enhancement of the effect even if the amount was increased. On the other hand, it became apparent that the increase in the added amount lowered the photographic performance and the Dmax. From these facts, it can be found from Samples 31 to 45 that preferably the range of the amount of the compound represented formula (I) or (II) to be added that can exhibit a stain-suppression without spoiling the photographic property is $1 \times 10^{-2}$ to 2 mols per mol of the coupler.

It is apparent from the results of Samples 46 to 52 that when the compounds represented by formula (I) or (II) were used in the same amount, they may be used alone or in combination, but for the stain-suppression effect, it was unexpected that when they were used in combination, better results were obtained.

Further, when the dye stabilizer of the present invention was used in each of the BL and the RL, a stain-suppression was recognized, or when the dye stabilizer of the present invention was used in the BL, GL, and RL, a stain-suppression was recognized, as is apparent from Samples 53 to 55.

When the dye stabilizer of the present invention was used in a nonphotosensitive layer free from any coupler, a stain-suppression could be recognized, although the effect was weaker than when it was used in the layer containing a coupler (Samples 56 to 59). In Sample 60, wherein the dye stabilizer of the present invention was added to all the layers except the top protective layer, the stain-suppression was high and excellent. However, when the dye stabilizer was used in the nonphotosensitive layer, advantageously it did not fluctuate the photographic performance (Dmax).

In Samples 61 to 75, wherein combinations of the dye stabilizer (I) or (II) and the dye stabilizer (III) of the present invention were added to all the layers except the photosensitive layer, and the top protective layer, it was recognized that stain was suppressed in any of them, so that it was confirmed that the use of the compounds represented by formulas (I) to (III) of the present invention was effective in preventing stain.

In any of Samples 31 to 75 in the color development used in this example, pressure-sensitized streaks were not observed.

EXAMPLE 4

Samples 01, 06, 16, and 21 of Example 1 were used as a base, the comparative coupler of Sample 21 was changed to another comparative coupler given below, and the coating amounts of silver in the first, third, and fifth layers were changed as shown in Table 5, to prepare samples. The coating amount of couplers per unit area of the prepared samples was the same molar amount, and the amount of silver was varied.

TABLE 4

| Sample | | | | | Coating Amount of Ag ($g/m^2$) BL | GL | RL | Total |
|---|---|---|---|---|---|---|---|---|
| 01 | 06 | 16 | 21 | 109 | 0.30 | 0.12 | 0.23 | 0.65 |
| 81 | 88 | 95 | 102 | 110 | 0.30 | 0.17 | 0.23 | 0.70 |
| 82 | 89 | 96 | 103 | 111 | 0.30 | 0.22 | 0.23 | 0.75 |
| 83 | 90 | 97 | 104 | 112 | 0.28 | 0.26 | 0.21 | 0.75 |
| 84 | 91 | 98 | 105 | 113 | 0.30 | 0.27 | 0.23 | 0.80 |
| 85 | 92 | 99 | 106 | 114 | 0.28 | 0.31 | 0.21 | 0.80 |
| 86 | 93 | 100 | 107 | 115 | 0.30 | 0.37 | 0.23 | 0.90 |
| 87 | 94 | 101 | 108 | 116 | 0.32 | 0.33 | 0.25 | 0.90 |

Comparative coupler

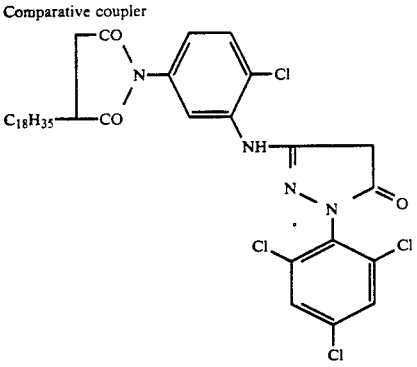

These samples were subjected to the same exposure to light as Example 1 and to a processing according to the following processing steps with the processing solutions having given below, by an automatic processor.

| Step | Processing steps Temperature | Time |
|---|---|---|
| Color Development | 37° C. | 45 sec. |
| Bleach-fixing | 37° C. | 45 sec. |
| Stabilizing (1) | 30–37° C. | 20 sec. |
| Stabilizing (2) | 30–37° C. | 20 sec. |
| Stabilizing (3) | 30–37° C. | 20 sec. |
| Stabilizing (4) | 30–37° C. | 30 sec. |
| Drying | 70–80° C. | 60 sec. |

Note:
Stabilizing steps were carried out in a 4-tanks countercurrent mode from the tank of stabilizing (4) toward the tank of stabilizing (1).

The composition of the respective processing solution were as follows:

| | |
|---|---|
| Color developer | |
| Water | 800 ml |
| Ethylenediaminetetraacetic acid | 2.0 g |
| Organic preservative (VI-1) | 8.0 g |
| Sodium chloride | $5.0 \times 10^{-2}$ mol |
| Potassium bromide | $1.0 \times 10^{-4}$ mol |
| Potassium carbonate | 25 g |
| N-Ethyl-N-(β-methanesulfonamidoethyl)-3-methyl-4-aminoaniline sulfate | 5.0 g |
| Organic preservative (IV-1) | 0.03 mol |
| 5,6-Dihydroxybenzene-1,2,4-trisufonate | 0.3 g |
| Fluorescent brightening agent (WHITEX-4, prepared by Sumitomo Chemical Industries) | 2.0 g |
| Sodium sulfite | 0.1 g |
| Water to make | 1000 ml |
| pH (25° C.) | 10.10 |
| Bleach-fixing solution | |
| Water | 400 ml |
| Ammonium thiosulfate (70%) | 100 ml |
| Sodium sulfite | 18 g |
| Iron (III) ammonium ethylenediamine-tetraacetate dihydrate | 55 g |
| Disodium ethylenediaminetetraacetate | 3 g |
| Glacial acetic acid | 8 g |
| Water to make | 1000 ml |
| pH (25° C.) | 5.5 |
| Stabilizing solution | |
| Formalin (37%) | 0.1 g |
| Formalin-sulfurous acid adduct | 0.7 g |
| 5-Chloro-2-methyl-4-isothiazolin-3-one | 0.02 g |
| 2-Methyl-4-isothiazolin-3-one | 0.01 g |
| Cupper sulfate | 0.005 g |
| Water to make | 1000 ml |
| pH (25° C.) | 4.0 |

The density at the magenta dye-image section of the dye-image obtained through the above processes was measured to evaluate photographic property of the Dmax and Dmin. The results are shown in Table 5A.

Then the above samples were exposed to light uniformly, so that the coating amount of silver might be developed 90%, they were processed, and the amount of residual silver was quantitatively measured by a fluorescent X-ray analysis. The results are also shown in Table 5A.

Further, the above samples were exposed uniformly to light using the sensitometer described in Example 1, so that a gray density having a reflection density of 0.5 might be obtained, then they were processed, and the pressure-sensitized streaks were evaluated. The standard for the evaluation followed the method described in Example 1. The results are also shown in Table 5A.

TABLE 5A

| Sample | Photographic Property (GL) $\Delta D_{min}$ | $\Delta D_{max}$ | Residual Silver ($\mu g/m^2$) | Pressure-sensitized Streaks | Remarks |
|---|---|---|---|---|---|
| 01 | 0.00 | 0.00 | 0.2 | ○ | This Invention |
| 81 | 0.00 | 0.00 | 0.3 | ○ | " |
| 82 | 0.00 | 0.00 | 0.5 | ○ | " |
| 83 | 0.00 | 0.00 | 0.5 | ○ | " |
| 84 | +0.01 | 0.00 | 3.7 | Δ | Comparative Example |
| 85 | +0.02 | 0.00 | 3.6 | Δ | Comparative Example |
| 86 | +0.04 | +0.01 | 6.5 | x | Comparative Example |
| 87 | +0.03 | 0.00 | 6.7 | x | Comparative Example |
| 06 | 0.00 | 0.00 | 0.3 | ○ | This Invention |
| 88 | 0.00 | 0.00 | 0.4 | ○ | " |
| 89 | 0.00 | 0.00 | 0.7 | ○ | " |
| 90 | 0.00 | 0.00 | 0.6 | ○ | " |
| 91 | +0.01 | 0.00 | 3.8 | Δ | Comparative Example |
| 92 | +0.02 | 0.00 | 3.6 | Δ | Comparative Example |
| 93 | +0.04 | +0.01 | 6.5 | x | Comparative |

TABLE 5A-continued

| Sample | Photographic Property (GL) $\Delta D_{min}$ | $\Delta D_{max}$ | Residual Silver ($\mu g/m^2$) | Pressure-sensitized Streaks | Remarks |
|---|---|---|---|---|---|
| 94 | +0.03 | 0.00 | 6.8 | x | Example Comparative Example |
| 16 | 0.00 | 0.00 | 0.3 | ○ | This Invention |
| 95 | 0.00 | 0.00 | 0.4 | ○ | " |
| 96 | 0.00 | 0.00 | 0.7 | ○ | " |
| 97 | 0.00 | 0.00 | 0.7 | ○ | " |
| 98 | +0.01 | 0.00 | 3.8 | Δ | Comparative Example |
| 99 | +0.02 | 0.00 | 3.7 | Δ | Comparative Example |
| 100 | +0.04 | +0.01 | 6.5 | x | Comparative Example |
| 101 | +0.03 | 0.00 | 6.7 | x | Comparative Example |
| 21 | 0.00 | 0.00 | 0.3 | ○ | Comparative Example |
| 102 | 0.00 | +0.11 | 0.4 | ○ | Comparative Example |
| 103 | +0.01 | +0.23 | 0.7 | ○ | Comparative Example |
| 104 | +0.02 | +0.34 | 0.6 | ○ | Comparative Example |
| 105 | +0.03 | +0.36 | 3.9 | x | Comparative Example |
| 106 | +0.04 | +0.43 | 3.7 | x | Comparative Example |
| 107 | +0.06 | +0.49 | 6.6 | xx | Comparative Example |
| 108 | +0.05 | +0.45 | 6.9 | xx | Comparative Example |
| 109 | 0.00 | 0.00 | 0.3 | ○ | Comparative Example |
| 110 | 0.00 | +0.08 | 0.4 | ○ | Comparative Example |
| 111 | +0.01 | +0.17 | 0.7 | ○ | Comparative Example |
| 112 | +0.02 | +0.25 | 0.6 | ○ | Comparative Example |
| 113 | +0.03 | +0.27 | 3.8 | x | Comparative Example |
| 114 | +0.04 | +0.31 | 3.7 | x | Comparative Example |
| 115 | +0.07 | +0.33 | 6.6 | xx | Comparative Example |
| 116 | +0.06 | +0.33 | 6.8 | xx | Comparative Example |

Note:
$\Delta D_{min}$ and $\Delta D_{max}$ are represented in a difference between values of each sample and the standard, which is Sample 01 in a group consisting of Samples 01 and 81 to 86. Sample 06 in a group consisting of Samples 06 and 88 to 94, and Samples having a smallest total coating amount of silver in the other groups, respectively. The figure denoted with + means the increase of the density.

As is apparent from the result in Table 5A, when the total coating amount of silver of the photographic material was increased, the Dmin increased for a coupler in the present invention, and also for a comparative coupler. It is apparent that in the case of a comparative coupler, particularly the Dmaxf luctuated greatly as the amount of silver increased. It is also apparent that the amount of residual silver increased proportionally to the coating amount of silver. It was also observed that as the coating amount of silver increased, pressure-sensitized streaks occured.

From these facts it is apparent that, with respect to the fluctuation of photographic property against the coating amount of silver, the amount of residual silver after processing, which influences the saturation of image-color, and pressure-sensitized streaks, it is advantageous that the coating amount of silver is smaller. From the results of this experiment it became apparent that, with respect to the couplers of the present invention, preferably the total coating amount of silver was 0.75 $g/m^2$ or below.

Then a photographic material sample was prepared in the same manner as Sample 01 in Example 1, except that the compositions of the first layer and the third layer were changed as follows:

First layer: Blue-sensitive emulsion layer Yellow coupler ExY was changed to an equimolar amount of the following yellow coupler:

Yellow coupler

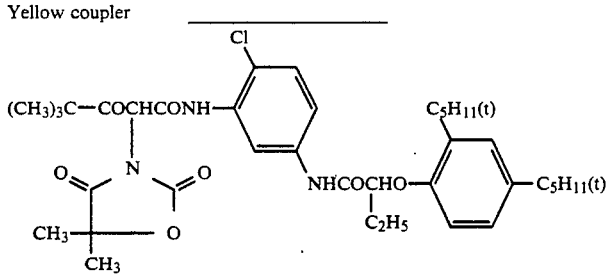

and the solvent (Solv-3) was in a coating amount of 0.56 $g/m^2$ was added.

Third layer: Green-sensitive layer Magenta coupler (A-4)-12 in Sample 01 was changed to an equimolar amount of a mixture in a molar ratio of 1:1 of magenta couplers (A-3)-5 and (A-4)-13. Image-dye stabilizers (III-1) and (I-31) were changed to each equimolar amount of (III-18) and (I-36), respectively, and the solvent (Solv-2) in a coating of 0.40 $g/m^2$ was added.

The thus-prepared sample was designated Sample 01A.

Next, photographic materials (Sample 01B to 01F) were prepared in the same manner as Sample 01 in Example 1, except that the coating amounts of silver in the first (blue-sensitive emulsion) layer, third (green-sensitive emulsion) layer, and fifth (red-sensitive emulsion) layer were reduced successively as shown in Table 5B, respectively, with each the same composition of silver chlorobromide emulsion as Sample 01.

Each of these samples was subjected to the same exposure to light as in Example 1 and to the same processing as described in Example 2.

The color-density of each thus-processed sample was measured to determine the $D_{max}$. Further, the stain ($\Delta D_B$) after storage under the same high-temperature and high-humidity conditions as in Example 2 was tested. Results are shown in Table 5B.

TABLE 5B

| Sample | Coating Amount of Silver ($g/m^2$) BL | GL | RL | Total | $\Delta D_{max}$* BL | GL | RL | $\Delta D_B$ |
|---|---|---|---|---|---|---|---|---|
| 01A | 0.30 | 0.12 | 0.23 | 0.65 | | (Standard) | | +0.03 |

TABLE 5B-continued

| Sample | Coating Amount of Silver (g/m²) BL | GL | RL | Total | $\Delta D_{max}$* BL | GL | RL | $\Delta D_B$ |
|---|---|---|---|---|---|---|---|---|
| 01B | 0.28 | 0.12 | 0.20 | 0.60 | 0.00 | 0.00 | 0.00 | +0.02 |
| 01C | 0.27 | 0.10 | 0.18 | 0.55 | 0.00 | 0.00 | 0.00 | +0.02 |
| 01D | 0.24 | 0.09 | 0.17 | 0.50 | −0.03 | −0.02 | 0.00 | +0.01 |
| 01E | 0.22 | 0.08 | 0.15 | 0.45 | −0.07 | −0.04 | −0.03 | +0.01 |
| 01F | 0.20 | 0.07 | 0.13 | 0.40 | −0.20 | −0.10 | −0.07 | +0.01 |

Note:
*$\Delta D_{max}$ is represented in a difference between values of each sample and the standard, which is the respective value of BL, GL, and RL of Sample 01A As is apparent from the results in Table 5B, it can be noticed that in Samples 01B to 01F, in which the total coating amount of silver were reduced successively with keeping the other amount (such as the coating amount of coupler) constant, stain ($\Delta D_B$) exhibits decreasing tendency with the decreasing of total coating amount of silver. However, in Sample 01F $D_{max}$ decreased as much as about 9% (density of 0.20) for the density of BL. Therefore, it can be presumed that a density necessary to form an image may be difficult to obtain at the total coating amount of silver of less than 0.40 g/m².

EXAMPLE 5

Samples 01, 85, 06, 92, 16, 99, 109, and 114 of Example 4 were subjected to an image-wise exposure to light and to a continuous processing (running test) according to the following processing steps by a paper-processor until the replenishing amount of color developer reached 2-times as much as tank volume.

| Step | Processing steps Temperature | Time | Replenisher Tank Amount* | Volume |
|---|---|---|---|---|
| Color Development | 37° C. | 45 sec | (See Table 7) | 4 l |
| Bleach-fixing | 37° C. | 45 sec | 61 ml | 4 l |
| Water Washing (1) | 30–37° C. | 30 sec | — | 2 l |
| Water Washing (2) | 30–37° C. | 30 sec | — | 2 l |
| Water Washing (3) | 30–37° C. | 30 sec | 364 ml | 2 l |
| Drying | 70–80° C. | 60 sec. | | |

Note:
*Replenisher amount per 1 m² of photographic material
Water washing was carried out in a 3-tanks counter-current mode from tank of washing (3) toward tank of washing (1). Water washing 1 solution was replenished to bleach-fixing in an amount of 122 ml per 1 m² of photographic material.

The composition of the respective processing solution were as follows:

| Color developer | |
|---|---|
| (Tank solution) | |
| Water | 800 ml |
| Ethylenediamine-N,N,N',N'-tetramethylene phosphonic acid | 3.0 g |
| Organic preservative (VI-1) | 8.0 g |

-continued

| | |
|---|---|
| Sodium chloride | see Table 7 |
| Potassium bromide | see Table 7 |
| Potassium carbonate | 25 g |
| N-Ethyl-N-(β-methanesulfonamidoethyl)-3-methyl-4-aminoaniline sulfate | 5.0 g |
| Organic preservative (V-19) | 0.03 mol |
| Fluorescent brightening agent (WHITEX-4, prepared by Sumitomo Chemical Industries) | 2.0 g |
| Water to make | 1000 ml |
| pH (25° C.) | 10.10 |

(Replenisher)

| | Replenisher (a) | (b) | (c) | (d) |
|---|---|---|---|---|
| Ethylenediamine-N,N,N',N'-tetramethylene phosphonic acid | 3 | 3 | 3 | 3 |
| Triethanolamine | 12 | 12 | 12 | 12 |
| Potassium chloride | | see Table 6 | | |
| Potassium bromide | | see Table 6 | | |
| Potassium carbonate | 26 | 26 | 26 | 26 |
| N-Ethyl-N-(β-methanesulfonamidoethyl)-3-methyl-4-aminoaniline sulfate | 6 | 7 | 9 | 11 |
| Organic preservative | 6 | 7 | 9 | 9 |
| Fluorescent brightening agent (WHITEX-4, prepared by Sumitomo Chemical Industries) | 1.5 | 2 | 2.5 | 3 |
| pH (adjusted by KOH or $H_2SO_4$) | 10.35 | 10.45 | 10.55 | 10.65 |

| Bleach-fixing solution | |
|---|---|
| (Tank solution) | |
| Water | 400 ml |
| Ammonium thiosulfate (70%) | 100 ml |
| Ammonium sulfite | 38 g |
| Iron (III) ammonium ethylenediamine-tetraacetate dihydrate | 55 g |
| Disodium ethylenediaminetetraacetate | 3 g |
| Glacial acetic acid | 9 g |
| Water to make | 1000 ml |
| pH (25° C.) | 5.40 |
| (Replenisher) | |
| 2.5-times condenced tank solution | |

| Water washing solution |
|---|
| Ion-exchanged water (each of calcium and magnesium was 3 ppm or below) |

The continuous processing was carried out by adding distilled water to each of color developer, bleach-fixing solution, and water washing solution in the respective evaporated amount to compensate the concentration by evaporation.

Before and after the continuous processing, gradation exposures were carried out according to the method described in Example 1. Each density of magenta color image of thus-obtained color image was evaluated to determine ΔDax and ΔDmin, i.e., the differences of Dmax and Dmin before and after the continuous processing. The results are shown in Table 6.

Further, each residual amount of silver after the continuous processing was determined in the manner described in Example 4. Similarly, the pressure-sensitized streaks was evaluated by the same method. The results are shown in Table 6.

TABLE 6

| Sample | Processing Process | Replenisher | Replenishing Amount* | Chloride Ions Concentration (mol/l) Tank Solution | Replenisher |
|---|---|---|---|---|---|
| 01 | (1) | (a) | 300 ml | $3.6 \times 10^{-2}$ | $2.2 \times 10^{-2}$ |
| 85 | | | | | |
| 06 | | | | | |
| 92 | | | | | |
| 16 | | | | | |

TABLE 6-continued

| | | | | | |
|---|---|---|---|---|---|
| 99 | | | | | |
| 109 | | | | | |
| 114 | | | | | |
| 01 | (2) | ⓑ | 200 ml | $6.0 \times 10^{-2}$ | $4.0 \times 10^{-2}$ |
| 85 | | | | | |
| 06 | | | | | |
| 92 | | | | | |
| 16 | | | | | |
| 99 | | | | | |
| 109 | | | | | |
| 114 | | | | | |
| 01 | (3) | c | 100 ml | $6.0 \times 10^{-2}$ | $1.7 \times 10^{-2}$ |
| 85 | | | | | |
| 06 | | | | | |
| 92 | | | | | |
| 16 | | | | | |
| 99 | | | | | |
| 109 | | | | | |
| 114 | | | | | |
| 01 | (4) | d | 30 ml | $1.2 \times 10^{-1}$ | |
| 85 | | | | | |
| 06 | | | | | |
| 92 | | | | | |
| 16 | | | | | |
| 99 | | | | | |
| 109 | | | | | |
| 114 | | | | | |

| | Bromide Ions Concentration (mol/l) | | Photographic Performance (GL) | | Remaining Amount of Silver | Pressure-sensitized | |
|---|---|---|---|---|---|---|---|
| Sample | Tank Solution | Replenisher | Δmin | Δmax | ($\mu g/cm^2$) | Streaks | Remarks |
| 01 | $4.0 \times 10^{-5}$ | $2.0 \times 10^{-5}$ | 0.01 | 0.00 | 1.1 | ∘ | This Invention |
| 85 | | | 0.03 | 0.02 | 4.5 | x | Comparative Example |
| 06 | | | 0.01 | 0.0 | 1.1 | ∘ | This Invention |
| 92 | | | 0.03 | 0.0 | 4.5 | x | Comparative Example |
| 16 | | | 0.01 | 0.0 | 1.1 | ∘ | This Invention |
| 99 | | | 0.03 | 0.0 | 4.5 | x | Comparative Example |
| 109 | | | 0.03 | 0.17 | 1.2 | ∘ | " |
| 114 | | | 0.05 | 0.13 | 4.7 | x x | " |
| 01 | $2.0 \times 10^{-4}$ | $1.4 \times 10^{-4}$ | 0.00 | 0.0 | 0.3 | ∘ | This Invention |
| 85 | | | 0.02 | 0.0 | 3.6 | Δ | Comparative Example |
| 06 | | | 0.00 | 0.0 | 0.3 | ∘ | This Invention |
| 92 | | | 0.02 | 0.0 | 3.5 | Δ | Comparative Example |
| 16 | | | 0.00 | 0.0 | 0.3 | ∘ | This Invention |
| 99 | | | 0.02 | 0.0 | 3.6 | Δ | Comparative Example |
| 109 | | | 0.02 | 0.15 | 0.4 | ∘ | " |
| 114 | | | 0.04 | 0.13 | 3.8 | x | " |
| 01 | $2.0 \times 10^{-4}$ | $8.0 \times 10^{-5}$ | 0.00 | 0.0 | 0.3 | ∘ | This Invention |
| 85 | | | 0.02 | 0.0 | 3.6 | Δ | Comparative Example |
| 06 | | | 0.00 | 0.0 | 0.3 | ∘ | This Invention |
| 92 | | | 0.02 | 0.0 | 3.6 | Δ | Comparative Example |
| 16 | | | 0.00 | 0.0 | 0.3 | ∘ | This Invention |
| 99 | | | 0.02 | 0.0 | 3.6 | Δ | Comparative Example |
| 109 | | | 0.02 | 0.15 | 0.4 | ∘ | " |
| 114 | | | 0.04 | 0.12 | 3.8 | x | " |
| 01 | $7.0 \times 10^{-4}$ | $3.5 \times 10^{-4}$ | 0.00 | 0.0 | 0.8 | ∘ | This Invention |
| 85 | | | 0.02 | 0.0 | 4.1 | Δ | Comparative Example |
| 06 | | | 0.00 | 0.0 | 0.8 | ∘ | This Invention |
| 92 | | | 0.02 | 0.0 | 4.0 | Δ | Comparative Example |
| 16 | | | 0.00 | 0.0 | 0.8 | ∘ | This Invention |
| 99 | | | 0.02 | 0.0 | 4.1 | Δ | Comparative Example |
| 109 | | | 0.02 | 0.18 | 0.9 | ∘ | " |
| 114 | | | 0.04 | 0.15 | 4.3 | x | " |

Note:
*per $m^2$ of photographic material

As is apparent from the results in Table 6, by comparing processes (1) and (4), that when the concentration of halide ions in color developer became a constant state of continuous processing, the fluctuation of the photographic performance, Dmax and Dmin involved in continuous processing in the processes (2) and (3) (wherein the concentration of chloride ions was $4.0 \times 10^{-2}$ to $1.0 \times 10^{-1}$ mol/l and the concentration of bromide ions was $5.0 \times 10^{-5}$ to $5.0 \times 10^{-4}$ mol/l, which were within the preferable ranges of the halide ions concentration of the present invention) were particularly small. Similarly, with respect to the amount of residual silver after processing, it is apparent that when processing wherein the halide ions concentration was within the preferable ranges was carried out, the amount of residual silver was small. However, in processing wherein the halide ions concentration was high, the occurrence of pressure-sensitized streaks was not observed.

It was noticed that, in the continuous processing of this experiment, when samples (01, 06, 16, and 109) having small coating amounts of silver were compared with samples (85, 92, 99 and 104) having large coating amounts of silver, even in continuous processing, the samples having large coating amounts of silver was liable to have pressure-sensitized streaks, and they had large amounts of residual silver.

As a results, it is apparent that when the samples that used couplers of the present invention with small coating amounts of silver were processed continuously with the halide ions concentration of the color developer being within specified concentration ranges, good performance was exhibited, with the fluctuation of the photographic performance being small, without having pressure-sensitized streaks, and with the amount of residual silver being small.

EXAMPLE 6

Samples 01, 85, 06, 92, 16, 99, 109, and 114 used in Example 5 were continuously processed using the replenishing solution (b), and the processing process (2) of the color developer used in Example 5 with the organic preservative of the color developing changed as shown in Table 7.

Before and after the continuous processing the samples were exposed to light for sensitometry, and the photographic performance of the magenta dye image, the ΔDmax and the ΔDmin were determined by the same way as in Example 5. The amount of residual silver and pressure-sensitized streaks were evaluated in the same way as in Example 5. The results are shown in Table 7.

TABLE 7

| Sample | Organic Preservative A | Organic Preservative B | Photographic Performance (GL) ΔDmin | Photographic Performance (GL) ΔDmax | Remaining Amount of Silver ($\mu g/cm^2$) | Pressure-sensitized Streaks | Remarks |
|---|---|---|---|---|---|---|---|
| 01 | V-19 | VI-1 | 0.00 | 0.00 | 0.3 | ○ | This Invention |
| 85 | (0.03 mol/l) | (8.0 g/l) | 0.02 | 0.02 | 3.6 | Δ | Comparative Example |
| 06 | | | 0.00 | 0.00 | 0.3 | ○ | This Invention |
| 92 | | | 0.02 | 0.02 | 3.5 | Δ | Comparative Example |
| 16 | | | 0.00 | 0.00 | 0.3 | ○ | This Invention |
| 99 | | | 0.02 | 0.02 | 3.6 | Δ | Comparative Example |
| 109 | | | 0.02 | 0.15 | 0.4 | ○ | " |
| 114 | | | 0.04 | 0.13 | 3.8 | x | " |
| 01 | V-15 | VI-1 | 0.00 | 0.00 | 0.3 | ○ | This Invention |
| 85 | (0.03 mol/l) | (8.0 g/l) | 0.02 | 0.02 | 3.6 | Δ | Comparative Example |
| 06 | | | 0.00 | 0.00 | 0.3 | ○ | This Invention |
| 92 | | | 0.02 | 0.02 | 3.5 | Δ | Comparative Example |
| 16 | | | 0.00 | 0.00 | 0.3 | ○ | This Invention |
| 99 | | | 0.02 | 0.02 | 3.6 | Δ | Comparative Example |
| 109 | | | 0.02 | 0.15 | 0.4 | ○ | " |
| 114 | | | 0.04 | 0.13 | 3.8 | x | " |
| 01 | V-10 | VI-1 | 0.01 | 0.02 | 0.3 | ○ | This Invention |
| 85 | (0.03 mol/l) | (8.0 g/l) | 0.03 | 0.05 | 3.6 | Δ | Comparative Example |
| 06 | | | 0.01 | 0.02 | 0.3 | ○ | This Invention |
| 92 | | | 0.03 | 0.05 | 3.6 | Δ | Comparative Example |
| 16 | | | 0.01 | 0.02 | 0.3 | ○ | This Invention |
| 99 | | | 0.03 | 0.05 | 3.6 | Δ | Comparative Example |
| 109 | | | 0.03 | 0.20 | 0.5 | ○ | This Invention |
| 114 | | | 0.05 | 0.17 | 3.8 | x | " |
| 01 | IV-1 | VI-1 | 0.01 | 0.02 | 0.7 | ○ | This Invention |
| 85 | (0.03 mol/l) | (8.0 g/l) | 0.03 | 0.05 | 4.0 | Δ | Comparative Example |
| 06 | | | 0.01 | 0.02 | 0.7 | ○ | This Invention |
| 92 | | | 0.03 | 0.05 | 4.0 | Δ | Comparative Example |
| 16 | | | 0.01 | 0.02 | 0.7 | ○ | This Invention |
| 99 | | | 0.03 | 0.05 | 4.1 | Δ | Comparative Example |
| 109 | | | 0.03 | 0.20 | 0.8 | ○ | " |
| 114 | | | 0.05 | 0.17 | 4.4 | x | " |
| 01 | IV-8 | VII-8 | 0.01 | 0.03 | 0.8 | ○ | This Invention |
| 85 | (0.03 mol/l) | (8.0 g/l) | 0.03 | 0.07 | 4.2 | Δ | Comparative Example |
| 06 | | | 0.01 | 0.03 | 0.8 | ○ | This Invention |
| 92 | | | 0.03 | 0.07 | 4.2 | Δ | Comparative Example |
| 16 | | | 0.01 | 0.03 | 0.9 | ○ | This Invention |
| 99 | | | 0.03 | 0.07 | 4.4 | Δ | Comparative Example |
| 109 | | | 0.03 | 0.24 | 0.9 | ○ | " |
| 114 | | | 0.05 | 0.20 | 4.6 | x | " |
| 01 | Hydroxylamine | VI-1 | 0.03 | 0.11 | 1.2 | Δ | Comparative Example |
| 85 | sulfate | (8.0 g/l) | 0.07 | 0.18 | 5.6 | x | " |
| 06 | (0.03 mol/l) | | 0.03 | 0.11 | 1.2 | Δ | " |
| 92 | | | 0.07 | 0.18 | 5.6 | x | " |
| 16 | | | 0.03 | 0.13 | 1.2 | Δ | " |
| 99 | | | 0.08 | 0.21 | 5.7 | x | " |
| 109 | | | 0.07 | 0.39 | 1.8 | x | " |
| 114 | | | 0.11 | 0.35 | 6.7 | xx | " |

As is apparent from the results in Table 7, it was observed that the use of the organic preservative in the color developer made the fluctuation of photographic performance, the Dmax, and Dmin in continuous processing small, the amount of residual silver small, and pressure-sensitized streaks occured hardly, in comparison with the samples using hydroxylamine sulfate which was a comparative preservative.

In this experiment it was also confirmed that when the coating amount of silver was large, then the amount of residual silver was large, pressure-sensitized streaks were liable to occur, and the fluctuation of the photographic performance was greater.

EXAMPLE 7

The Samples (see Table 8) prepared in the preceding Examples were exposed to light by the method described in Example 1 and processed using processing process (4) and the replenisher (d) in Example 5, which had processed continuously samples serarately image-wisely exposed until the replenishing amount reached twice as much as the tank capacity of the color developer, using a paper automatic processor.

The thus-obtained images were kept under the conditions shown below, and the fastness of the images and the stain of the white background sections were tested.

1. Fastness to light: the samples were exposed to a xenon lamp (100,000 luxes) for 10 days, 2. Fasteness to heat: the samples were kept at 100° C. for 7 days, and 3. Fasteness to heat and humidity: the samples were kept at 80° C. and 70% relative humidity for 15 days.

The evaluation of the fasteness of dye images was given in terms of the percentage of the density (D) obtained after a part having a density of 1.5 immediately after the processing was tested under the above conditions, that is, in terms of a dye image-residual ratio (%) of $D/115\times100$. Therefore, it is meant that the greater the figure is, the higher the fasteness is. The evaluation of stain in the white background was given in terms of the difference of the B density ($D_B$) of the white background after the test under the above conditions and the B density ($D_{B0}$) of the white background before the test, that is, in terms of $\Delta D_B=D_B-D_{B0}$. Therefore, it is meant that the greater the difference is, the more the stain is. The results are shown in Table 8.

TABLE 8

| | Light-stability | | | | Heat-stability | | | | Humidity and Heat Stability | | | | Remarks | |
|---|---|---|---|---|---|---|---|---|---|---|---|---|---|---|
| | Residual Ratio of Image-dye | | | Stain | Residual Ratio of Image-dye | | | Stain | Residual Ratio of Image-dye | | | Stain | Layer added Compound represented by formula | |
| Sample | BL | GL | RL | ($D_B$) | BL | GL | RL | ($D_B$) | BL | GL | RL | ($D_B$) | (I), (II), or (III) | |
| 01 | 86 | 85 | 85 | 0.04 | 94 | 99 | 96 | 0.06 | 95 | 100 | 95 | 0.04 | This Invention | GL |
| 06 | 86 | 85 | 85 | 0.04 | 94 | 99 | 96 | 0.06 | 95 | 100 | 95 | 0.04 | " | " |
| 11 | 86 | 92 | 85 | 0.05 | 94 | 97 | 96 | 0.07 | 95 | 98 | 95 | 0.05 | " | " |
| 16 | 86 | 82 | 85 | 0.04 | 94 | 98 | 96 | 0.06 | 95 | 99 | 95 | 0.04 | " | " |
| 21 | 86 | 58 | 85 | 0.16 | 94 | 92 | 96 | 0.43 | 95 | 93 | 95 | 0.33 | Comparative Example | " |
| 31 | 86 | 70 | 85 | 0.08 | 94 | 95 | 96 | 0.13 | 95 | 95 | 95 | 0.10 | " | |
| 35 | 86 | 82 | 85 | 0.06 | 94 | 97 | 96 | 0.08 | 95 | 98 | 95 | 0.07 | This Invention | GL |
| 42 | 86 | 80 | 85 | 0.06 | 94 | 96 | 96 | 0.09 | 95 | 97 | 95 | 0.08 | " | " |
| 49 | 86 | 85 | 85 | 0.04 | 94 | 99 | 96 | 0.06 | 95 | 100 | 95 | 0.04 | " | " |
| 53 | 90 | 70 | 85 | 0.07 | 96 | 95 | 96 | 0.11 | 97 | 95 | 95 | 0.09 | " | BL |
| 54 | 86 | 70 | 89 | 0.07 | 94 | 95 | 98 | 0.12 | 95 | 95 | 97 | 0.09 | " | RL |
| 55 | 90 | 85 | 89 | 0.03 | 96 | 99 | 98 | 0.05 | 97 | 100 | 95 | 0.03 | " | BL, GL, RL |
| 58 | 86 | 70 | 85 | 0.07 | 94 | 95 | 96 | 0.12 | 95 | 95 | 95 | 0.09 | " | 4th Layer |
| 59 | 86 | 70 | 85 | 0.06 | 94 | 95 | 96 | 0.11 | 95 | 95 | 97 | 0.08 | " | 2nd, 4th, and 6th Layer |
| 60 | 90 | 85 | 89 | 0.02 | 96 | 99 | 98 | 0.04 | 97 | 100 | 97 | 0.02 | " | 1st to 6th Layers |
| 63 | 90 | 85 | 89 | 0.02 | 96 | 99 | 98 | 0.04 | 97 | 100 | 97 | 0.02 | " | 1st to 6th Layers |
| 66 | 90 | 85 | 89 | 0.02 | 96 | 99 | 98 | 0.04 | 97 | 100 | 97 | 0.02 | " | 1st to 6th Layers |
| 69 | 90 | 85 | 89 | 0.02 | 96 | 99 | 98 | 0.04 | 97 | 100 | 97 | 0.02 | " | 1st to 6th Layers |
| 72 | 90 | 85 | 89 | 0.02 | 96 | 99 | 98 | 0.04 | 97 | 100 | 97 | 0.02 | " | 1st to 6th Layers |
| 75 | 89 | 84 | 88 | 0.03 | 95 | 98 | 97 | 0.05 | 96 | 100 | 96 | 0.03 | " | 1st to 6th Layers |
| 109 | 86 | 63 | 85 | 0.13 | 94 | 93 | 96 | 0.26 | 95 | 93 | 95 | 0.18 | Comparative Example | GL |

As is apparent from the results in Table 8, if a dye stabilizer represented by formula (I), (II), or (III) is added to any of photosensitive layers and non-photosensitive layers, it exhibited a stain-suppression effect. However, it can be understood that when a dye stabilizer represented by formula (I), (II), or (III) is added to photosensitive layers, it is most effective to add it to the GL, in view of the stain-prevention effect.

In addition to the stain-prevention effect, is is apparent that the dye stabilizer of the present invention exhibits its effect for any of yellow, magenta, and cyan dye images.

Thus, it is apparent that a dye stabilizer of the present invention improves the fastness of yellow, magenta, and cyan dye images, and suppresses the occurrence of stain with time after processing. Further, it became apparent that, concerning the prevention of stain, even when a dye stabilizer of the present invention was added to non-photosensitive layers, it was effective.

EXAMPLE 8

A multilayer color photographic paper was prepared by coating layers as hereinbelow described on a paper laminated on both sides with polyethylene. Coating solutions were prepared as follows:

Preparation of the first-layer coating solution

To a mixture of 60.0 g of yellow coupler (ExY) and 28.0 g of discoloration inhibitor (Cpd-1), 150 ml of ethyl acetate, 1.0 ml of solvent (Solv-3) and 3.0 ml of solvent (Solv-4) were added and dissolved. The resulting solution was added to 450 ml of 10% aqueous gelatin solution containing sodium dodecylbenzensulfonate, and then the mixture was dispersed by a supersonic homogenizer. The resulting dispersion was mixed with and dissolved in 420 g of silver chlorobromide emulsion (silver bromide: 0.7 mol %) containing a blue-sensitive sensitizing dye, described below, to prepare the first-layer coating solution. Coating solutions for the second to seventh layers were also prepared in the same manner as in the first layer coating solution. As a gelatin hardener for the respective layers, 1,2-bis(vinylsulfonyl)ethane was used.

As spectral sensitizers for the respective layers, the following compounds were used:

Blue-sensitive emulsion layer:

Anhydro-5,5' -dichloro-3,3'-disulfoethylthiacyanine hydroxide.

Green-sensitive emulsion layer:

Anhydro-9-ethyl-5,5'-diphenyl-3,3'-disulfoethylox-acarbocyanine hydroxide

Red-sensitive emulsion layer:

3,3'-Diethyl-5-methoxy-9,9'-(2,2'-dimethyl-1,3-propano)thiacarbocyanine iodide

As stabilizers for the respective layers, a mixture (7:2:1 in molar ratio) of the following compounds was used:

1-(2-Acetoaminophenyl)-5-mercaptotetrazole,
1-Phenyl-5-mercaptotetrazole, and
1-(p-Methoxyphenyl)-5-mercaptotetrazole As irradiation preventing dyes the following compounds were used.

[3-Carboxy-5-hydroxy-4(3-(3-carboxy-5-oxo-1-(2,5-sulfonatophenyl)-2-pyrazoline-4-iridene)-1-propenyl)-1-pyrazolyl]benzene-2,5-disulfonatedisodium salt, N,N'-(4,8-Dihydroxy-9,10-dioxo-3,7-disolfonatoanthrazene-1,5-diyl)bis(aminomethanesulfonato)tetrasodium salt, and

[3-Cyano-5-hydroxy-4-(3-(3-cyano-5-oxo-1-(4-sulfonatophenyl)-2-pyrazoline-4-iridene)-1-pentanyl)-1-pyrazolyl]benzene-4-sulfonato-sodium salt (Composition of layers)

The composition of each layer is shown below. The figures represent coating amounts (g/m$^2$). The coating amounts of each silver halide emulsion is represented in terms of silver. Base

| | |
|---|---|
| First Layer (Blue-sensitive emulsion layer) | |
| The above-described silver chlorobromide emulsion (AgBr: 0.7 mol %, cubic grain, average grain size: 0.9 μm) | 0.29 |
| Gelatin | 1.80 |
| Yellow coupler (ExY) | 0.60 |
| Discoloration inhibitor (Cpd-1) | 0.28 |
| Solvent (Solv-3) | 0.01 |
| Solvent (Solv-4) | 0.03 |
| Second Layer (Color-mix preventing layer) | |
| Gelatin | 0.80 |
| Color-mix inhibitor (Cpd-2) | 0.055 |
| Solvent (Solv-1) | 0.03 |
| Solvent (Solv-2) | 0.015 |
| Third Layer (Green-sensitive emulsion layer) | |
| The above-described silver chlorobromide emulsion (AgBr: 0.7 mol %, cubic grain, average grain size: 0.45 μm) | 0.18 |
| Gelatin | 1.86 |
| Magenta coupler (ExM) | 0.27 |
| Discoloration inhibitor (Cpd-3) | 0.17 |
| Discoloration inhibitor (Cpd-4) | 0.10 |
| Solvent (Solv-1) | 0.20 |
| Solvent (Solv-2) | 0.02 |
| Fourth Layer (Color-mix preventing layer) | |
| Gelatin | 1.70 |
| Color-mix inhibitor (Cpd-2) | 0.065 |
| Ultraviolet absorber (UV-1) | 0.45 |
| Ultraviolet absorber (UV-2) | 0.23 |
| Solvent (Solv-1) | 0.05 |
| Solvent (Solv-2) | 0.05 |
| Fifth Layer (Red-sensitive emulsion layer) | |
| The above-described silver chlorobromide emulsion (AgBr: 4 mol %, cubic grain, average grain size: 0.5 μm) | 0.21 |

-continued

| | |
|---|---|
| Gelatin | 1.80 |
| Cyan coupler (ExC-1) | 0.26 |
| Cyan coupler (ExC-2) | 0.12 |
| Discoloration inhibitor (Cpd-1) | 0.20 |
| Solvent (Solv-1) | 0.16 |
| Solvent (Solv-2) | 0.09 |
| Color-forming accelerator (Cpd-5) | 0.15 |
| Sixth Layer (Ultraviolet light absorbing layer) | |
| Gelatin | 0.70 |
| Ultraviolet absorber (UV-1) | 0.26 |
| Ultraviolet absorber (UV-2) | 0.07 |
| Solvent (Solv-1) | 0.30 |
| Solvent (Solv-2) | 0.09 |
| Seventh Layer (Protective layer) | |
| Gelatin | 1.07 |

Compounds used are as follows:

(ExY) Yellow coupler
α-Pivalyl-α-(3-benzyl-1-hidantoinyl)-2-chloro-5[β-(dodecylsulfonyl)butyramido]acetoanilide
(ExM) Magenta coupler ((A-3)-5)
7-Chloro-6-isopropyl-3-{3-[2-butoxy-5-tert-octyl)-benzenesulfonyl]propyl}-1H-pyrazolo[5,1-c]-1,2,4-triazole
(ExC-1) Cyan coupler
2-Pentafluorobenzamido-4-chloro-5[2-(2,4-di-tert-amylphenoxy)-3-methylbutyramidophenol
(ExC-2) Cyan coupler
2,4-Dichloro-3-methyl-6-[α-(2,4-di-tert-amyl-phenoxy)butyramido]phenol
(Cpd-1) Discoloration inhibitor
2,5-Di-tert-amylphenyl-3,5-di-tert-butylhydroxy-benzoate
(Cpd-2) Color-mix inhibitor
2,5-Di-tert-octylhydroquinone
(Cpd-3) Discoloration inhibitor
7,7'-dihydroxy-4,4,4',4'-tetramethyl-2,2'-spirocumarone
(Cpd-4) Discoloration inhibitor
N-(4-dodecyloxyphenyl)-morpholine
(Cpd-5) Color-forming accelerator
p-(p-Toluenesulfonamido)phenyl-dodecane
(Solv-3) Solvent
Di(i-nonyl)phthalate
(Solv-4) Solvent
N,N-diethylcarbonamido-methoxy-2,4-di-t-amylbenzene
(UV-1) Ultraviolet absorber
2-(2-Hydroxy-3,5-di-tert-amylphenyl)benzotriazole
(UV-2) Ultraviolet absorber
2-(2-Hydroxy-3,5-di-tert-butylphenyl)benzotriazole
(Solv-1) Solvent
Di(2-ethylhexyl)phthalate
(Solv-2) Solvent
Dibutylphthalate The thus-prepared sample is designated Sample 111.

Samples were prepared by adding an image-dye stabilizer represented by formula (I), (II), or (III), respectively, as shown in Table 9.

These samples were subjected to an exposure by the method as described in Example 1, and to a processing according to the step and the composition of processing solution described in Example 4.

The densities of magenta-image of obtained color-image were measured to evaluate their photographic characteristics, Dmax. Results are shown in Table 9.

Next the assessment for stain was carried out according to the method described in Example 1. Results are also shown in Table 9.

TABLE 9

| Sample | Layer and Amount added Compound represented by Formula (I), (II), or (III) | GL Dmax | Stain ($\Delta D_B$) | Remarks |
|---|---|---|---|---|
| 111 | | 0.00 | +0.07 | Comparative Example |
| 112 | GL: (I-2) $5 \times 10^{-2}$ and (III-18) $1 \times 10^{-1}$ | −0.05 | +0.04 | This Invention |
| 113 | BL, GL, RL: The same as the above | −0.05 | +0.03 | " |

TABLE 9-continued

| Sample | Layer and Amount added Compound represented by Formula (I), (II), or (III) | GL Dmax | Stain ($\Delta D_B$) | Remarks |
|---|---|---|---|---|
| 114 | BL, GL, RL: The same as the above<br>2nd, 4th, and 6th layers: (I-2) $5 \times 10^{-5}$ and (III-18) $1 \times 16^{-4}$ | −0.05 | +0.02 | " |
| 115 | GL: (I-36) $5 \times 10^{-2}$ and (III-20) $5 \times 10^{-2}$ | −0.03 | +0.03 | " |
| 116 | BL, GL, RL: The same as the above | −0.03 | +0.02 | " |
| 117 | BL, GL, RL: The same as the above<br>2nd, 4th, and 6th layers: (I-36) $5 \times 10^{-5}$ and (III-18) $5 \times 10^{-4}$ | −0.03 | +0.01 | " |
| 118 | GL: (I-31) $5 \times 10^{-2}$ and (III-1) $1 \times 10^{-1}$ | −0.03 | +0.03 | " |
| 119 | BL, GL, RL, The same as the above | −0.03 | +0.02 | " |
| 120 | BL, GL, RL: The same as the above<br>2nd, 4th, and 6th layers: (I-31) $5 \times 10^{-5}$ and (III-1) $1 \times 10^{-4}$ | −0.03 | +0.01 | " |
| 121 | GL: (I-48) $5 \times 10^{-2}$ and (III-3) $1 \times 10^{-1}$ | −0.04 | +0.03 | " |
| 122 | BL, GL, RL: The same as the above | −0.04 | +0.02 | " |
| 123 | GL: (II-1) $5 \times 10^{-2}$ and (III-22) $1 \times 10^{-1}$ | −0.07 | +0.04 | " |
| 124 | BL, GL, RL: The same as the above | −0.07 | +0.03 | " |

Note
Dmax: The figure is represented in a difference of values between each sample and the standard, sample 111. The figure denoted with − means the decrease of density.
Stain: Evaluation method is the same as in Example 3.

As is apparent from the results in Table 9, when a combination of a compound represented by formula (I) or (II) of the present invention with a compound represented by formula (III) of the present invention was used in the amount shown in this Example, stain was suppressed greatly without much lowering of the Dmax.

Further, it could be understood that the stain-suppression effect was improved more when the addition was made to the BL, the GL, and the RL than when the addition was made the GL only, and further, when the addition was made to each of the second to sixth layers, the stain-suppression was increased.

In processing using the processing composition of this Example, pressure-sensitized streaks were not observed, and the amount of redidual silver after processing was 1.0 $\mu g/cm^2$ or below in any of the samples for the total coating amount of silver of this Example.

Having described our invention as related to the embodiment, it is our intention that the invention be not limited by any of the details of the description, unless otherwise specified, but rather be construed broadly within its spirit and scope as set out in the accompanying claims.

What we claim is:

1. A method for processing an imagewise exposed silver halide color photographic material with a color developer containing at least one aromatic primary amine color developing agent, comprising:

providing as said silver halide color photographic material a material which contains at least one silver halide emulsion layer, said silver halide emulsion layer containing at least one pyrazoloazole coupler represented by the following formula (A):

Formula (A)

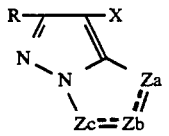

wherein R represents a hydrogen atom or a substituent, X represents a hydrogen atom or a group that can split off in a coupling reaction with an oxidized product of an aromatic primary amine developing agent, Za, Zb, and Zc each represent methine, substituted methine, =N—, or —NH—, one of the Za—Zb bond and the Zb—Zc bond is a double bond, and the other is a single bond, and when Zb—Zc is a carbon-carbon double bond, the double bond may be part of the aromatic ring, a dimer or higher polymer may be formed through R or X, and when Za, Zb, or Zc is a substituted methine, a dimer or higher polymer may be formed through the substituted methine, said material further containing at least one compound represented by the following formula (I-a) or (III-a), wherein the compound represented by formula (I-a) is a compound that reacts with p-anisidine at the second-order reaction-specific rate $k_2$ (80° C.) of $1 \times 10^{-1}$ to $1 \times 10^{-5}$ l/mol.sec.:

Formula (I-a)

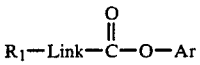

wherein $R_1$ represents an aliphatic group, an aromatic group, or a heterocyclic group; Link represents a single bond or —O—; Ar has the same meaning as that of the aromatic group defined for $R_1$, except those that will react with the aromatic amine color developing agent to release a group useful as a reducer for photography, Formula (III-a)

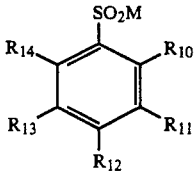

wherein M represents an atom or a radical that will form an inorganic salt or

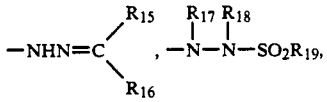

-continued

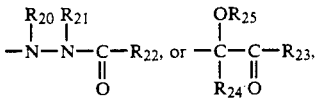

in which $R_{15}$ and $R_{16}$, which may be the same or different, each represent a hydrogen atom, an aliphatic group, an aromatic group, or a heterocyclic group, $R_{15}$ and $R_{16}$ may be bond together to form a 5- to 7-membered ring, $R_{17}$, $R_{18}$, $R_{20}$ and $R_{21}$, which may be the same or different, each represents a hydrogen atom, an aliphatic group, a heterocyclic group, an acyl group, an alkoxycarbonyl group, a sulfonyl group, a ureido group, or a urethane group, provided that at least one of $R_{17}$ and $R_{18}$ and at least one of $R_{20}$ and $R_{21}$ each is a hydrogen atom, $R_{19}$ and $R_{22}$ each represent a hydrogen atom, an aliphatic group, an aromatic group, or a heterocyclic group, $R_{19}$ may represent an alkylamino group, an arylamino group, an alkoxy group, an aryloxy group, an acyl group, an alkoxycarbonyl group, or an aryloxycarbonyl group, at least two of $R_{17}$, $R_{18}$, and $R_{19}$ may bond together to form a 5- to 7-membered ring, at least two of $R_{20}$, $R_{21}$, and $R_{22}$ may bond together to form a 5- to 7-membered ring, $R_{23}$ represents a hydrogen atom, an aliphatic group, an aromatic group, or a heterocyclic group, $R_{24}$ represents a hydrogen atom, an aliphatic group, an aromatic group, a halogen atom, an acyloxy group, or a sulfonyl group, and $R_{25}$ represents a hydrogen atom or a hydrolyzable group;

$R_{10}$, $R_{11}$, $R_{12}$, $R_{13}$, and $R_{14}$, which may be the same or different, each represent a hydrogen atom, an aliphatic group, an aromatic group, a heterocyclic group, a halogen atom, $-SR_{26}$, $-OR_{26}$,

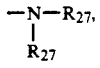

an aryloxycarbonyl group, a sulfonyl group, a a sulfonamide group, a sulfamoyl group, a ureido group, a urethane group, a carbamoyl group, a sulfo group, a carboxyl group, a nitro group, a cyano group, an alkoxalyl group, an aryloxalyl group, a sulfonyl group

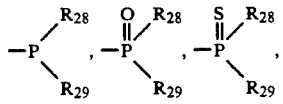

or a formyl group, in which $R_{26}$ and $R_{27}$, which may be the same or different, each represent a hydrogen atom, an aliphatic group, an aromatic group, an acyl group, or a sulfonyl group, and $R_{28}$ and $R_{29}$, which may be the same or different, each represent a hydrogen atom, an aliphatic group, an aromatic group, an alkoxy group, or an aryloxy group, said at least one silver halide emulsion layer containing said coupler represented by formula (A) comprising 80 mol % or over of silver chloride and the total coating amount of silver in the material is 0.75 g/m$^2$ or below; and developing said material, after it has been image exposed, with a color developer which contains chlorine ions in an amount of $3.5\times10^{-2}$ to $1.5\times10^{-1}$ mol/l, bromine ions in an amount of $3.0\times10^{-5}$ to $1.0\times10^{-3}$ mol/l, and said at least one aromatic primary amine color developing agent.

2. The method as claimed in claim 1, wherein the coupler represented by formula (A) is selected from the group consisting of 1H-imidazo[1,2-b]pyrazoles, 1H-pyrazolo[1,5-b]pyrazoles, 1H-pyrazolo[5,1-c][1,2,4]triazoles, 1H-pyrazolo[1,5-b][1,2,4]triazoles, 1H-pyrazolo[1,5-b]tetrazoles, and 1H-pyrazolo [1,5a]-benzimidazoles.

3. The method as claimed in claim 1, wherein the amount of the coupler represented by formula (A) is $2\times10^{-3}$ to $5\times10^{-1}$ mol per mol of silver in the emulsion layer.

4. The method as claimed in claim 1, wherein the silver halide emulsion layer containing a coupler represented by formula (A) is a green-sensitive emulsion layer comprising high-silver-halide.

5. The method as claimed in claim 1, wherein the compounds represented by formula (III-a) have a second-order reaction-specific rate $k_2$ (80° C.) with p-anisidine of $1.0\times1\times10^{-5}$ l/mol.sec.

6. The method as claimed in claim 1, wherein the compound represented by formula (I-a) is used in combination with the compound represented by formula (III-a).

7. The method as claimed in claim 1, wherein the compound represented by formula (I-a) or (III-a) is added to a hydrophilic colloid layer of the photographic material when the photographic material is produced.

8. The method as claimed in claim 1, wherein the compound represented by formula (I-a) or (III-a) is used with a coupler in an amount of $5\times10^{-3}$ to 5 mols per mol of the coupler.

9. The method as claimed in claim 1, wherein the compound represented by formula (I-a) or (III-a) is added into one of the layers of the photographic material in an amount of $1\times10^{-2}$ to $1\times10^{-7}$ mol/m$^2$.

10. The method as claimed in claim 1, wherein the content of chloride ions in the color developer is $4.0\times10^{-2}$ to $1.0\times10^{-1}$ mol/l.

11. The method as claimed in claim 1, wherein the content of bromide ions in the color developer is $5.0\times10^{-5}$ to $5.0\times10^{-4}$ mol/l.

12. The method as claimed in claim 1, wherein the color developer contains benzyl alcohol in an amount of 2.0 ml or below per liter of the developer.

13. The method as claimed in claim 1, wherein the color developer contains an organic preservative.

* * * * *